US007560214B2

(12) United States Patent
Yuasa et al.

(10) Patent No.: US 7,560,214 B2
(45) Date of Patent: Jul. 14, 2009

(54) TONER, PROCESS FOR PRODUCING TONER, TWO-COMPONENT DEVELOPER AND IMAGE FORMING APPARATUS

(75) Inventors: Yasuhito Yuasa, Osaka (JP); Hidekazu Arase, Hyogo (JP); Mamoru Soga, Osaka (JP); Masahisa Maeda, Osaka (JP)

(73) Assignee: Panasonic Corporation, Osaka (JP)

( * ) Notice: Subject to any disclaimer, the term of this patent is extended or adjusted under 35 U.S.C. 154(b) by 317 days.

(21) Appl. No.: 11/569,492

(22) PCT Filed: May 16, 2005

(86) PCT No.: PCT/JP2005/008849

§ 371 (c)(1),
(2), (4) Date: Nov. 21, 2006

(87) PCT Pub. No.: WO2005/116779

PCT Pub. Date: Dec. 8, 2005

(65) Prior Publication Data

US 2008/0160443 A1 Jul. 3, 2008

(30) Foreign Application Priority Data

May 27, 2004 (JP) ..... 2004-158286
Jul. 27, 2004 (JP) ..... 2004-218179
Sep. 17, 2004 (JP) ..... 2004-271098
Sep. 17, 2004 (JP) ..... 2004-271099

(51) Int. Cl.
*G03G 9/087* (2006.01)

(52) U.S. Cl. ..... 430/110.4; 430/137.14

(58) Field of Classification Search ..... 430/110.4, 430/137.14

See application file for complete search history.

(56) References Cited

U.S. PATENT DOCUMENTS 5,567,561 A 10/1996 Yoshikawa et al.
5,998,078 A 12/1999 Suwabe et al.
6,068,961 A 5/2000 Dutoff et al.

(Continued)

FOREIGN PATENT DOCUMENTS

JP 10-198070 7/1998

(Continued)

*Primary Examiner*—John L Goodrow
(74) *Attorney, Agent, or Firm*—Hamre, Schumann, Mueller & Larson, P.C.

(57) ABSTRACT

Toner of the present invention is produced by mixing in an aqueous medium at least a resin particle dispersion in which resin particles are dispersed, a colorant particle dispersion in which colorant particles are dispersed, and a wax particle dispersion in which wax particles are dispersed and heating and aggregating the mixed dispersion. The main component of a surface-active agent used for the resin particle dispersion is a nonionic surface-active agent. The main component of at least one surface-active agent selected from a surface-active agent used for the wax particle dispersion and a surface-active agent used for the colorant particle dispersion is a nonionic surface-active agent. With this configuration, the toner can have a smaller particle size and a sharp particle size distribution without requiring a classification process. The toner and a two-component developer can achieve oilless fixing, eliminate spent of the toner components on a carrier to make the life longer, and ensure high transfer efficiency by suppressing transfer voids or scattering during transfer.

39 Claims, 5 Drawing Sheets

U.S. PATENT DOCUMENTS

| | | | | |
|---|---|---|---|---|
| 6,120,967 | A * | 9/2000 | Hopper et al. | 430/137.14 |
| 2002/0058190 | A1 | 5/2002 | Ishiyama et al. | |
| 2002/0064724 | A1 | 5/2002 | Nakamura et al. | |
| 2002/0086229 | A1 * | 7/2002 | Yuasa et al. | 430/108.4 |

FOREIGN PATENT DOCUMENTS

| | | |
|---|---|---|
| JP | 2801507 | 7/1998 |
| JP | 10-301332 | 11/1998 |
| JP | 2000-250267 | 9/2000 |
| JP | 2001-228651 | 8/2001 |
| JP | 2001-249486 | 9/2001 |
| JP | 2002-23429 | 1/2002 |
| JP | 2002-82473 | 3/2002 |
| JP | 2002-196525 | 7/2002 |
| JP | 2002-229253 | 8/2002 |
| JP | 2002-244355 | 8/2002 |
| JP | 2003-43728 | 2/2003 |
| JP | 2003-43732 | 2/2003 |
| JP | 2003-122058 | 4/2003 |
| JP | 2003-255586 | 9/2003 |
| JP | 2004-13049 | 1/2004 |
| JP | 2004-102121 | 4/2004 |

* cited by examiner

TONER, PROCESS FOR PRODUCING TONER, TWO-COMPONENT DEVELOPER AND IMAGE FORMING APPARATUS

TECHNICAL FIELD

The present invention relates to toner used, e.g., in copiers, laser printers, plain paper facsimiles, color PPC, color laser printers, color facsimiles or multifunctional devices, a process for producing the toner, a two-component developer, and an image forming apparatus.

BACKGROUND ART

In recent years, electrophotographic apparatuses, which commonly were used in offices, have been used increasingly for personal purposes, and there is a growing demand for technologies that can achieve, e.g., a small size, a high speed, high image quality, or high reliability for those apparatuses.

During the formation of color images, toner may adhere to the surface of a fixing roller and cause offset. Therefore, a large amount of oil or the like should be applied to the fixing roller, which makes the handling or configuration of the equipment more complicated. Thus, oilless fixing (no oil is used for fixing) is required to provide compact, maintenance-free, and low-cost equipment. To achieve the oilless fixing, e.g., the configuration of toner in which a release agent (wax) with a sharp melting property is added to a binder resin is being put to practical use.

However, such toner is very prone to a transfer failure or disturbance of the toner images during transfer because of its strong cohesiveness. Therefore, it is difficult to ensure the compatibility between transfer and fixing. In the case of two-component development, spent (i.e., the adhesion of a low-melting component of the toner to the surface of a carrier) is likely to occur due to heat generated by mechanical collision or friction between the particles or between the particles and the developing unit. This decreases the charging ability of the carrier and interferes with a longer life of the developer.

Japanese Patent No. 2801507 (Patent Document 1) discloses a carrier for positively charged toner that is obtained by introducing a fluorine-substituted alkyl group into a silicone resin of the coating layer. JP 2002-23429 A (Patent Document 2) discloses a coating carrier that includes conductive carbon and a cross-linked fluorine modified silicone resin. This coating carrier is considered to have high development ability in a high-speed process and maintain the development ability for a long time. While taking advantage of the superior charging characteristics of the silicone resin, the conventional technique uses the fluorine-substituted alkyl group to obtain properties such as slidability, releasability and repellency, to increase resistance to wearing, peeling or cracking, and further to prevent spent. However, the resistance to wearing, peeling or cracking is not sufficient. Moreover, when the negatively charged toner is used, the amount of charge is too small, although the positively charged toner may have an appropriate amount of charge. Therefore, a significant amount of the reversely charged toner (positively charged toner) is generated, which leads to fog or toner scattering. Thus, the toner is not suitable for practical use.

With pulverization and classification of the conventional kneading and pulverizing processes of toner, the actual particle size can be reduced to only about 8 μm in view of the economic and performance conditions. At present, various methods are considered to produce toner having a smaller particle size. In addition, a method for achieving the oilless fixing also is considered, e.g., by adding a release agent (wax) to the resin with a low softening point during melting and kneading. However, there is a limit to the amount of wax that can be added, and increasing the amount of wax can cause problems such as low flowability of the toner, transfer voids, and fusion of the toner to a photoconductive member.

Therefore, various ways of polymerization different from the kneading and pulverizing processes have been studied as a method for producing toner. For example, toner may be produced by suspension polymerization. However, the particle size distribution of the toner is no better than that of the toner produced by the kneading and pulverizing processes, and in many cases further classification is necessary. Moreover, since the toner is almost spherical in shape, the cleaning property is extremely poor when the toner remains on the photoconductive member or the like, and thus the reliability of the image quality is reduced.

Also, toner may be produced by emulsion polymerization including the following steps: preparing an aggregated particle dispersion by forming aggregated particles in a dispersion of at least resin particles; forming adhesive particles by mixing a resin particle dispersion in which resin fine particles are dispersed with the aggregated particle dispersion so that the resin fine particles adhere to the aggregated particles; and heating and fusing the adhesive particles together.

JP 10 (1998)-198070 (Patent Document 3) discloses a process of preparing a liquid mixture by mixing at least a resin particle dispersion in which resin particles are dispersed in a surface-active agent having a polarity and a colorant particle dispersion in which colorant particles are dispersed in a surface-active agent having a polarity. The surface-active agents included in the liquid mixture have the same polarity, so that toner for electrostatic charge image development with high reliability and excellent charge and color development properties can be produced in a simple and easy manner.

JP 10 (1998)-301332 (Patent Document 4) discloses that the release agent includes at least one kind of ester composed of at least one selected from higher alcohol having a carbon number of 12 to 30 and higher fatty acid having a carbon number of 12 to 30, and the resin particles include at least two kinds of resin particles with different molecular weights. This can provide toner with an excellent fixing property, color development property, transparency, and color mixing property.

However, when the dispersibility of the release agent added is lowered, the toner images melted during fixing are prone to have a dull color. This also decreases the pigment dispersibility, and thus the color development property of the toner becomes insufficient. In the subsequent process, when resin fine particles further adhere to the surface of an aggregate, the adhesion of the resin fine particles is unstable due to low dispersibility of the release agent or the like. Moreover, the release agent that once was aggregated with the resin is liberated into an aqueous medium. Depending on the polarity or the thermal properties such as a melting point, the release agent may have a considerable effect on aggregation. Further, a specified wax is added in a large amount to achieve the oilless fixing.

When particles are formed by an aggregation reaction in the medium that contains at least a certain amount of wax, the particle size increases with heat treatment time. Therefore, it is difficult to produce small particles having a narrow particle size distribution.

The use of a release agent may achieve the oilless fixing, reduce fog during development, and improve the transfer efficiency. However, such a release agent prevents uniform mixing and aggregation of the resin particles with pigment particles in the aqueous medium during manufacture. Thus, the release agent tends to be not aggregated but suspended in the medium, and aggregated and fused particles are likely to be coarser due to the effect of the release agent.

Patent Document 1: Japanese Patent No. 2801507
Patent Document 2: JP 2002-23429 A
Patent Document 3: JP 10(1998)-198070 A
Patent Document 4: JP 10(1998)-301332 A

DISCLOSURE OF INVENTION

Therefore, with the foregoing in mind, it is an object of the present invention to provide toner that can have a smaller particle size and a sharp particle size distribution without requiring a classification process. It is another object of the present invention to perform oilless fixing (no oil is applied to a fixing roller) by using a release agent such as wax in the toner while achieving low-temperature fixability, high-temperature offset resistance, and storage stability. It is yet another object of the present invention to provide a two-component developer that can have a long life and high resistance to deterioration caused by spent, even if it is combined with the toner incorporating a release agent such as wax. It is still another object of the present invention to provide an image forming apparatus that can suppress transfer voids or scattering during transfer and ensure high transfer efficiency.

Toner of the present invention is produced by mixing in an aqueous medium at least a resin particle dispersion in which resin particles are dispersed, a colorant particle dispersion in which colorant particles are dispersed, and a wax particle dispersion in which wax particles are dispersed and heating and aggregating the mixed dispersion. The main component of a surface-active agent used for the resin particle dispersion is a nonionic surface-active agent. The main component of at least one surface-active agent selected from a surface-active agent used for the wax particle dispersion and a surface-active agent used for the colorant particle dispersion is a nonionic surface-active agent.

A method for producing toner of the present invention produces toner by mixing in an aqueous medium at least a resin particle dispersion in which resin particles are dispersed, a colorant particle dispersion in which colorant particles are dispersed, and a wax particle dispersion in which wax particles are dispersed and heating and aggregating the mixed dispersion. The method includes the following: preparing the mixed dispersion of at least the resin particle dispersion, the colorant particle dispersion, and the wax particle dispersion; adjusting the pH of the mixed dispersion in the range of 9.5 to 12.2; adding a water-soluble inorganic salt to the mixed dispersion; and heat-treating the mixed dispersion so that the resin particles, the colorant particles, and the wax particles are aggregated to form aggregated particles at least part of which is melted. The main component of a surface-active agent used for the resin particle dispersion is a nonionic surface-active agent. The main component of at least one surface-active agent selected from a surface-active agent used for the wax particle dispersion and a surface-active agent used for the colorant particle dispersion is a nonionic surface-active agent.

A two-component developer of the present invention includes a toner material and a carrier. The toner material includes the above toner base or the toner base produced by the above method, and 1 to 6 parts by weight of inorganic fine powder having an average particle size of 6 nm to 200 nm are added to 100 parts by weight of the toner base. The carrier includes magnetic particles as a core material, and at least the surface of the core material is coated with a fluorine modified silicone resin containing an aminosilane coupling agent.

BEST MODE FOR CARRYING OUT THE INVENTION

Figure 1:
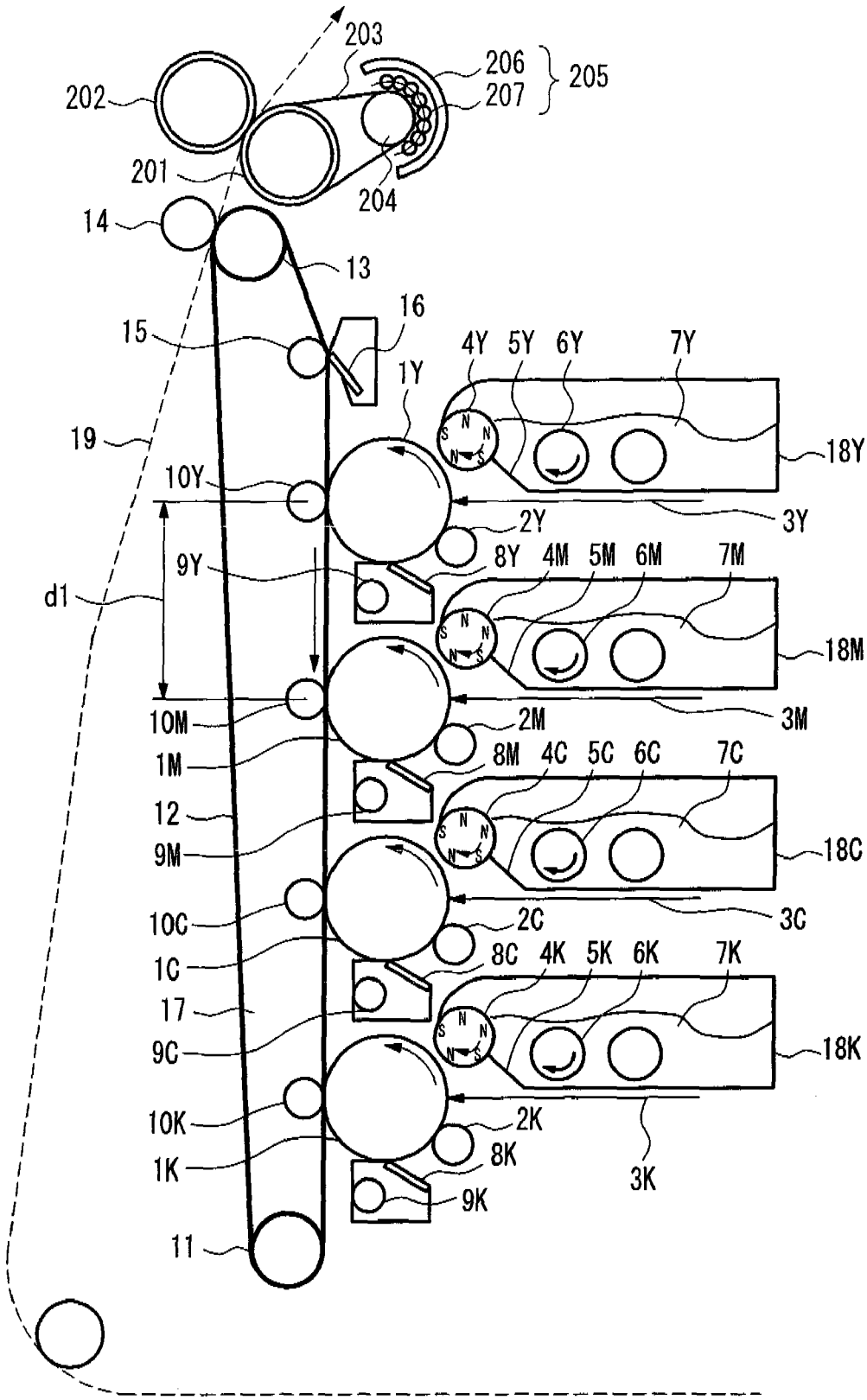
FIG. 1 is a cross-sectional view showing the configuration of an image forming apparatus used in an example of the present invention.

The present invention can produce toner having a smaller particle size and a sharp particle size distribution without requiring a classification process.

In the method of the present invention, a toner base is produced by mixing in an aqueous medium at least a resin particle dispersion in which resin particles are dispersed, a colorant particle dispersion in which colorant particles are dispersed, and a wax particle dispersion in which wax particles are dispersed and heating and aggregating the mixed dispersion. Accordingly, it is possible to eliminate the presence of wax and colorant particles that are not aggregated but suspended in the aqueous medium. The toner can have a smaller particle size and a uniform, narrow and sharp particle size distribution without requiring a classification process.

The present invention allows the toner to be fixed at low temperatures while preventing offset without using oil. The two-component developer can have high resistance to deterioration caused by spent, even if it is combined with the toner incorporating a release agent such as wax.

In the tandem color process, a plurality of image forming stations, each of which includes a photoconductive member and a developing unit, are arranged, and the transfer process is performed by successively transferring each color of toner to a transfer member. This can suppress transfer voids or reverse transfer and ensure high transfer efficiency.

The present inventors conducted a detailed study of providing i) toner for electrostatic charge image development that has a smaller particle size and a sharp particle size distribution and can achieve not only the oilless fixing but also superior glossiness, transmittance, charging characteristics, environmental dependence, cleaning property and transfer property; ii) a two-component developer using the toner; and iii) image formation that can form color images with high quality and reliability without causing toner scattering, fog, or the like.

(1) Polymerization Process

A resin particle dispersion is prepared by forming resin particles of a homopolymer or copolymer of vinyl monomers (vinyl resin) by emulsion or seed polymerization of the vinyl monomers in a surface-active agent and dispersing the resin particles in the surface-active agent. Any known dispersing devices such as a high-speed rotating emulsifier, a high-pressure emulsifier, a colloid-type emulsifier, and a ball mill, a sand mill, and Dyno mill that use a medium can be used.

Examples of a polymerization initiator include an azo- or diazo-based initiator such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, or azobisisobutyronitrile, persulfate such as potassium persulfate or ammonium persulfate, an azo compound such as 4,4'-azobis-4-cyanovaleric acid and its salt or 2,2'-azobis(2-amidinopropane) and its salt, and a peroxide compound.

A colorant particle dispersion is prepared by adding colorant particles to water that includes a surface-active agent and dispersing the colorant particles using the above dispersing device.

In a first preferred method for producing toner of the present invention, the resin particle dispersion, the colorant particle dispersion, and the wax particle dispersion are mixed in an aqueous medium. Then, the pH of the aqueous medium is adjusted under predetermined conditions, and the particles are aggregated by heating the aqueous medium at temperatures not less than the glass transition point (Tg) of the resin and/or the melting point of the wax for a predetermined time (e.g., 1 to 6 hours) in the presence of a water-soluble inorganic salt, thus producing toner base particles including aggregated particles (also referred to as core particles) at least part of which is melted. These toner base particles are mixed with an additive to form toner.

The first method includes mixing in an aqueous medium at least the resin particle dispersion in which resin particles are dispersed, the colorant particle dispersion in which colorant particles are dispersed, and the wax particle dispersion in wax particles are mixed, emulsified, and dispersed. In this case, the mixed dispersion preferably has a pH of 6.0 or less. When persulfate (e.g., potassium persulfate) is used as a polymerization initiator in the emulsion polymerization of the resin, the residue may be decomposed by heat applied during the aggregation process and may reduce the pH of the mixed dispersion. Therefore, it is preferable that a heat treatment is performed at temperatures not less than a predetermined temperature (preferably 80° C. or more for sufficient decomposition of the residue) for a predetermined time (preferably about 1 to 5 hours) after the emulsion polymerization of the resin. The pH of the dispersion of the emulsion-polymerized resin is preferably 4 or less, and more preferably 1.8 or less.

When the pH of the mixed dispersion is more than 6.0, the residue of the persulfate (polymerization initiator) is decomposed, and the pH fluctuation (pH decrease) is increased during the formation of colored resin particles by heating. Thus, particles obtained by heating and aggregation are likely to be coarser.

A water-soluble inorganic salt is added to the mixed dispersion, and the mixed dispersion is heated at temperatures not less than the glass transition point (Tg) of the resin and/or the melting point of the wax, thereby forming aggregated particles with a predetermined particle size. It is preferable that the pH of the mixed dispersion is adjusted in the range of 9.5 to 12.2 before adding the water-soluble inorganic salt and heating. In this case, 1N NaOH can be used for the pH adjustment. When the pH is less than 9.5, the resultant particles are likely to be coarser. When the pH is more than 12.2, the amount of liberated wax is increased, and it is difficult to incorporate the wax uniformly into the resin.

After the pH adjustment, the water-soluble inorganic salt is added to the mixed dispersion, which then is heat-treated for a predetermined time (e.g., 1 to 6 hours) while stirring. Consequently, the resin particles, the colorant particles, and the wax particles are aggregated to form aggregated particles having a predetermined volume-average particle size (e.g., 3 to 6 μm), and at least part of the aggregated particles is melted. The pH of the liquid at the time of forming the aggregated particles with the predetermined volume-average particle size is maintained in the range of 7.0 to 9.5. This can reduce the liberation of the wax and form the aggregated particles that incorporate the wax and have a narrow particle size distribution. The amount of NaOH added, the type or amount of aggregating agent, the pH values of the emulsion-polymerized resin dispersion, the colorant dispersion and the wax dispersion, a heating temperature, or time may be selected appropriately. When the pH of the liquid is less than 7.0 at the time of forming the aggregated particles, the aggregated particles are likely to be coarser. When the pH of the liquid is more than 9.5, the amount of liberated wax is increased due to poor aggregation.

In a second preferred method for producing toner of the present invention, according to the first method, it is also preferable that the pH further is adjusted in the range of 2.2 to 6.8, and then the mixed dispersion is heat-treated for a predetermined time (e.g., about 1 to 5 hours) to form aggregated particles. When the heat treatment is performed after adjusting the pH in the above range, the surface smoothness of the particles can be improved while suppressing secondary aggregation of the aggregated particles. Moreover, the particle size distribution can be made sharper.

In a third preferred method for producing toner of the present invention, a second resin particle dispersion in which second resin particles are dispersed may be added to an aggregated particle dispersion in which the aggregated particles produced by the first or second method are dispersed. Then, the mixed dispersion is heated so that the second resin particles are fused with the aggregated particles to form a resin surface layer. This further can improve the durability, storage stability, and high-temperature offset resistance of the toner.

When the resin surface layer is formed by heating the mixed dispersion at temperatures not less than the Tg of the second resin particles, it is necessary not only to achieve uniform adhesion of the second resin particles to the surfaces of the aggregated particles without causing liberation, but also to avoid secondary aggregation of the aggregated particles.

Therefore, it is preferable that the pH of the aggregated particle dispersion to which the second resin particle dispersion has been added is adjusted in the range of 2.2 to 6.8, and then the mixed dispersion is heat-treated at temperatures not less than the glass transition point of the second resin particles for 0.5 to 5 hours.

With this process, the second resin particles can adhere uniformly to the surfaces of the aggregated particles while reducing suspended particles. When the pH is less than 2.2, the adhesion of the second resin particles does not occur easily, and the liberated resin particles are increased. When the pH is more than 6.8, secondary aggregation of the aggregated particles is likely to occur. When the treatment time is longer than 5 hours, the particles become coarser and the particle size distribution become broader.

In a fourth preferred method for producing toner of the present invention, after the heat treatment of 0.5 to 5 hours in the third method, the pH further is adjusted in the range of 5.2 to 8.8, and then the mixed dispersion is heat-treated at temperatures not less than the glass transition point of the second resin particles for 0.5 to 5 hours.

This method can prevent the particles from being coarser and provide a sharp particle size distribution. Moreover, it can improve the surface smoothness of the particles without changing the shape.

With this process, the second resin particles can adhere uniformly to the surfaces of the core particles while reducing suspended particles. When the pH is less than 5.2, the adhesion of the second resin particles does not occur easily, and the liberated resin particles are increased. When the pH is more than 8.8, secondary aggregation of the core particles is likely to occur. When the treatment time is longer than 5 hours, the particles become coarser and the particle size distribution becomes broader.

In a fifth preferred method for producing toner of the present invention, according to the fourth method, the pH further is adjusted in the range of 2.2 to 6.8, and then the mixed dispersion is heat-treated at temperatures not less than the glass transition point of the second resin particles for 0.5 to 5 hours, so that the second resin particles are fused with the core particles. With this process, the core particles and the second resin particles are fused into particles having a narrow particle size distribution while neither the core particles nor the second resin particles cause secondary aggregation. When the pH is less than 2.2, the resin particles that once adhered to the core particles may be liberated. When the pH is more than 6.8, secondary aggregation of the core particles is likely to occur.

It is preferable that a difference in volume-average particle size between the core particles and the particles resulting from the fusion of the second resin particles with the core particles is in the range of 0.5 to 2 μm. When the difference is less than 0.5 μm, the adhesion of the second resin particles is poor, and the second resin particles themselves lack strength due to the influence of moisture. When the difference is more than 2 μm, the fixability and the glossiness are reduced.

In the first to fifth methods of the present invention, thereafter, cleaning, liquid-solid separation, and drying processes may be performed as desired to provide toner base particles. The cleaning process preferably involves sufficient substitution cleaning with ion-exchanged water to improve the chargeability. The liquid-solid separation process is not particularly limited, and any known filtration methods such as suction filtration and pressure filtration can be used preferably in view of productivity. The drying process is not particularly limited, and any known drying methods such as flash-jet drying, flow drying, and vibration-type flow drying can be used preferably in view of productivity.

The toner has to meet the following requirements simultaneously: fixing at even lower temperatures; high-temperature offset resistance in the oilless fixing (silicone oil or the like is not applied to a fixing roller during fixing); separatability of paper from the fixing roller; high transmittance of color images; and storage stability under high temperature conditions.

For this reason, a plurality of waxes that differ in melting point or skeleton depending on the function may be added to the toner so that low-temperature fixing can be achieved with the use of a release agent.

When two waxes having different melting points are mixed with the resin and the colorant to form aggregated particles in an aqueous medium, one wax may be melted fast and aggregated quickly, while the other wax may slow the aggregation reaction and not be incorporated into the aggregated particles, but suspended in the aqueous medium. Moreover, hydrocarbon wax is unlikely to be aggregated with the resin because of its conformability with the resin. Therefore, there are suspended particles of the wax that are not incorporated into the aggregated particles. Such presence of the suspended particles may hinder the progress of aggregation and make the particle size distribution broader. Thus, the development property inherent in the toner cannot be exhibited properly.

Although the dispersion stability is improved by treating the wax with an anionic surface-active agent, the aggregated particles tend to be coarser and not have a sharp particle size distribution. This phenomenon occurs particularly when the hydrocarbon wax and the ester wax are mixed to form aggregated particles.

In a first preferred configuration of the present invention, the wax may include at least a first wax including wax that has an endothermic peak temperature (melting point represented by Tmw1 (° C.)) of 50° C. to 90° C. based on a DSC method, and a second wax including wax that has an endothermic peak temperature (melting point represented by Tmw2 (° C.)) 5° C. to 70° C. higher than Tmw1 of the first wax based on the DSC method.

During heating and aggregation, the first wax may become increasingly compatible with a styrene acrylic resin, which promotes aggregation of the wax and the resin. Therefore, the wax can be incorporated uniformly, and the presence of suspended particles can be suppressed. Moreover, the first wax is used with the second wax having a higher melting point, so that the second wax can improve the high-temperature offset resistance and the first wax (having a lower melting point) further can improve the low-temperature fixability.

The melting point Tmw1 of the first wax is preferably 50° C. to 90° C., more preferably 60° C. to 85° C., and further preferably 65° C. to 80° C. When Tmw1 is lower than 50° C., the heat resistance of the toner is reduced. When Tmw1 is higher than 90° C., the aggregation of the wax is reduced to increase liberated particles in the aqueous medium, and thus the above effect cannot be obtained.

The melting point Tmw2 of the second wax is preferably 5° C. to 70° C. higher than the melting point Tmw1 of the first wax. This can separate the wax functions efficiently. When the temperature difference is less than 5° C., the function of improving the high-temperature offset resistance cannot be performed. When the temperature difference is more than 70° C., the aggregation of the wax with the resin is reduced to increase suspended particles of the wax.

The melting point Tmw2 of the second wax is preferably 80° C. to 120° C., more preferably 80° C. to 100° C. and further preferably 85° C. to 95° C. When Tmw2 is lower than 80° C., the storage stability is degraded, and the high-temperature offset resistance is reduced. When Tmw2 is higher than 120° C., the low-temperature fixability and the color transmittance cannot be improved.

The total amount of the wax added is preferably 5 to 30 parts by weight per 100 parts by weight of the binder resin. When the amount is less than 5 parts by weight, the effects of the low-temperature fixability and the releasability cannot be obtained. When the amount is more than 30 parts by weight, the control of the particles in a small particle size can be difficult.

In a second preferred configuration of the present invention, the wax may include not only the second wax including aliphatic hydrocarbon wax, but also the first wax including a specified ester wax. The use of this wax can suppress the presence of suspended particles of the aliphatic hydrocarbon wax that are not incorporated into the aggregated particles, and also can prevent the particle size distribution of the aggregated particles from being broader. Moreover, when the resin particles further are added to form a shell, the wax can reduce a phenomenon in which secondary aggregation of the aggregated particles occurs rapidly, and the particles become coarser.

When the resin, the colorant, and the aliphatic hydrocarbon wax are mixed to form aggregated particles in an aqueous medium, the aliphatic hydrocarbon wax is unlikely to be aggregated with the resin because of its conformability with the resin. Therefore, there are suspended particles of the wax that are not incorporated into the aggregated particles. Such presence of the suspended particles may hinder the progress of aggregation and make the particle size distribution broader. However, if the temperature or time of the heat treatment is changed to reduce the suspended particles or to prevent a broad particle size distribution, the particle size is increased. As will be described later, when the resin particles further are added to form a shell on the melted and aggregated particles, secondary aggregation of the aggregated particles occurs rapidly, and the particles become coarser.

With the second configuration, during heating and aggregation, the first wax may become increasingly compatible with the resin, which promotes aggregation of the aliphatic hydrocarbon wax and the resin. Therefore, the wax can be incorporated uniformly, and the presence of suspended particles can be suppressed. When the first wax is partially compatible with the resin, the low-temperature fixability can be improved further. Since the aliphatic hydrocarbon wax is not compatible with the resin, the second wax can improve the high-temperature offset resistance. In other words, the first wax functions as both a dispersion assistant for emulsifying and dispersing the second aliphatic hydrocarbon wax and a low-temperature fixing assistant.

The melting point Tmw1 of the first wax is preferably 50° C. to 90° C., more preferably 60° C. to 85° C., and further preferably 65° C. to 80° C. When Tmw1 is lower than 50° C. the heat resistance of the toner is reduced. When Tmw1 is higher than 90° C., the aggregation of the wax is reduced to increase liberated particles in the aqueous medium, and thus the above effect cannot be obtained.

The melting point Tmw2 of the second wax is preferably 80° C. to 120° C., more preferably 80° C. to 100° C., and further preferably 85° C. to 95° C. When Tmw2 is lower than 80° C., the storage stability is degraded, and the high-temperature offset resistance is reduced. When Tmw2 is higher than 120° C., the low-temperature fixability and the color transmittance cannot be improved.

The melting point Tmw2 of the second wax is preferably 5° C. to 70° C. higher than the melting point Tmw1 of the first wax. This can separate the wax functions efficiently. When the temperature difference is less than 5° C., the function of improving the high-temperature offset resistance cannot be performed. When the temperature difference is more than 70° C., the aggregation of the wax with the resin is reduced to increase suspended particles of the wax.

The total amount of the wax added is preferably 5 to 30 parts by weight per 100 parts by weight of the binder resin. When the amount is less than 5 parts by weight, the effects of the low-temperature fixability and the releasability cannot be obtained. When the amount is more than 30 parts by weight, the control of the particles in a small particle size can be difficult.

It is preferable that TW2/EW1 is 0.2 to 10 where EW1 and TW2 are weight ratios of the first wax and the second wax to 100 parts by weight of the wax in the wax particle dispersion, respectively. It is more preferable that TW2/EW1 is 1 to 9. When TW2/EW1 is less than 0.2, the effect of the high-temperature offset resistance cannot be obtained, and the storage stability is degraded. When TW2/EW1 is more than 10, the low-temperature fixing cannot be achieved, and the above problems remain unsolved.

It is preferable that the wax particle dispersion is produced by mixing, emulsifying, and dispersing the first wax and the second wax. In this method, the first wax and the second may be mixed at a predetermined mixing ratio, and then heated, emulsified, and dispersed in an emulsifying and dispersing device. The first wax and the second wax may be put in the device either separately or simultaneously. However, the wax particle dispersion thus produced preferably includes the first wax and the second wax in the mixed state. If a wax dispersion obtained by emulsifying and dispersing the first wax and the second wax separately is mixed with the resin dispersion and the colorant dispersion, and then the mixed dispersion is heated and aggregated, the above effects cannot be obtained, and problems such as suspended particles of the wax or a broad particle size distribution of the aggregated particles remain unsolved. Moreover, the problem of rapid secondary aggregation of the aggregated particles in forming a shell also cannot be solved fully.

Although the dispersion stability is improved by treating the wax with an anionic surface-active agent, the aggregated particles tend to be coarser and not have a sharp particle size distribution. Therefore, it is preferable that the wax particle dispersion is produced by mixing, emulsifying, and dispersing the first wax and the second wax with a surface-active agent that includes a nonionic surface-active agent as the main component. When the surface-active agent including a nonionic surface-active agent as the main component is used for mixing with the ester wax, dispersing and forming an emulsion dispersion, aggregation of the wax particles themselves can be suppressed to improve the dispersion stability. Then, the wax dispersion thus produced, the resin dispersion, and the colorant dispersion are mixed to form aggregated particles. In such a case, the wax is not liberated, and the aggregated particles can have a smaller particle size and a narrow sharp particle size distribution.

The surface-active agent allows the dispersed particles of the wax and the resin to be hydrated by many water molecules. Therefore, the particles are not likely to adhere to each other. However, when an electrolyte is added, it takes the water molecules away from the hydrated particles. Accordingly, the particles can adhere easily, so that more and more particles join and grow into larger particles. In this case, when an ionic surface-active agent, e.g., an anionic surface-active agent is used for the resin dispersion and the wax dispersion, although the aggregated particles are formed, some wax particles repel each other while the water molecules are taken away by the electrolyte. Thus, there may be particles that are formed by aggregating only the wax and suspended independently. The presence of such particles can cause filming of the toner on a photoconductive member, a reduction in image density during development, and an increase in fog. Moreover, the suspended particles gradually join with the aggregated particles in the process of heating for a predetermined time. Consequently, the resultant particles become coarser and have a broad particle size distribution.

In the case of the wax particle dispersion using a nonionic surface-active agent, when an electrolyte is added, it takes the water molecules away from the hydrated particles. Accordingly, the particles can adhere easily, so that more and more particles join and grow into larger particles. Since the nonionic surface-active agent is used, the effect of repulsion of the wax particles is small while the water molecules are taken away by the electrolyte. This can suppress the presence of particles that are formed by aggregating only the wax and suspended independently, resulting in particles having a uniform sharp particle size distribution.

In a preferred embodiment for forming the aggregated particles, the main component of the surface-active agent used for each of the resin particle dispersion, the colorant particle dispersion, and the wax particle dispersion may be a nonionic surface-active agent. In the context of the present invention, the term "main component" means 50 wt % or more of the surface-active agent used.

In the surface-active agent used for the colorant particle dispersion and the wax particle dispersion, the nonionic surface-active agent is preferably 50 to 100 wt %, and more preferably 60 to 100 wt % of the whole surface-active agent. This configuration eliminates the presence of colorant or wax particles that are not aggregated but suspended in the aqueous medium, and thus can provide core particles having a smaller particle size and a uniform, narrow and sharp particle size distribution. Moreover, the second resin particles can be fused uniformly with the core particles while reducing suspended particles, which is effective to achieve a sharp particle size distribution.

The surface-active agent used for the resin particle dispersion may be a mixture of a nonionic surface-active agent and an ionic (preferably anionic) surface-active agent, and the nonionic surface-active agent is preferably 60 to 95 wt %, more preferably 65 to 90 wt %, and further preferably 70 to 90 wt % of the whole surface-active agent. When the nonionic surface-active agent is less than 60 wt %, the particle size of the aggregated particles is not uniform. When it is more than 95 wt %, the dispersion of the resin particles is not stable.

In a preferred embodiment, the surface-active agent used for the resin particle dispersion may be a mixture of a nonionic surface-active agent and an ionic surface-active agent, and the main component of the surface-active agent used for the wax particle dispersion may be only a nonionic surface-active agent.

In a preferred embodiment, the surface-active agent used for the resin particle dispersion may be a mixture of a nonionic surface-active agent and an ionic surface-active agent, the main component of the surface-active agent used for the colorant particle dispersion may be only a nonionic surface-active agent, and the main component of the surface-active agent used for the wax particle dispersion may be only a nonionic surface-active agent. When the mixture of nonionic and ionic surface-active agents is used for the resin particle dispersion, the nonionic surface-active agent is preferably 60 to 95 wt %, more preferably 65 to 90 wt %, and further preferably 70 to 90 wt % of the whole surface-active agent. When the nonionic surface-active agent is less than 60 wt %, the particle size of the core particles is not uniform. When it is more than 95 wt %, the dispersion of the resin particles is not stable.

In a configuration where the second resin particles are fused with the aggregated particles, it is preferable that the main component of the surface-active agent used for the second resin particles dispersion is a nonionic surface-active agent. Moreover, the surface-active agent used for the second resin particle dispersion may be a mixture of a nonionic surface-active agent and an ionic (preferably anionic) surface-active agent, and the nonionic surface-active agent is preferably 50 to 95 wt %, more preferably 60 to 90 wt %, and further preferably 70 to 90 wt % of the whole surface-active agent. When the nonionic surface-active agent is less than 50 wt %, it is difficult to promote the adhesion of the second resin particles to the core particles. When it is more than 95 wt %, the dispersion of the second resin particles is not stable.

The water-soluble inorganic salt used in this embodiment may be, e.g., an alkali metal salt or an alkaline-earth metal salt. Examples of the alkali metal include lithium, potassium, and sodium. Examples of the alkaline-earth metal include magnesium, calcium, strontium, and barium. Among these, potassium, sodium, magnesium, calcium, and barium are preferred. The counter ions (the anions constituting a salt) of the above alkali metals or alkaline-earth metals may be, e.g., a chloride ion, bromide ion, iodide ion, carbonate ion, or sulfate ion.

The nonionic surface-active agent may be, e.g., a polyethylene glycol-type nonionic surface-active agent or a polyol-type nonionic surface-active agent. Examples of the polyethylene glycol-type nonionic surface-active agent include a higher alcohol ethylene oxide adduct, alkylphenol ethylene oxide adduct, fatty acid ethylene oxide adduct, polyol fatty acid ester ethylene oxide adduct, fatty acid amide ethylene oxide adduct, ethylene oxide adduct of fats and oils, and polypropylene glycol ethylene oxide adduct. Examples of the polyol-type nonionic surface-active agent include fatty acid ester of glycerol, fatty acid ester of pentaerythritol, fatty acid ester of sorbitol and sorbitan, fatty acid ester of cane sugar, polyol alkyl ether, and fatty acid amide of alkanolamines.

In particular, the polyethylene glycol-type nonionic surface-active agent such as a higher alcohol ethylene oxide adduct or alkylphenol ethylene oxide adduct can be used preferably.

Examples of the aqueous medium include water such as distilled water or ion-exchanged water, and alcohols. They can be used individually or in combinations of two or more. The content of the polar surface-active agent need not be defined generally and may be selected appropriately depending on the purposes.

In the present invention, when the nonionic surface-active agent is used with the ionic surface-active agent, the polar surface-active agent may be, e.g., a sulfate-based, sulfonate-based, or phosphate-based anionic surface-active agent or an amine salt-type or quaternary ammonium salt-type cationic surface-active agent.

Specific examples of the anionic surface-active agent include sodium dodecyl benzene sulfonate, sodium dodecyl sulfate, sodium alkyl naphthalene sulfonate, and sodium dialkyl sulfosuccinate.

Specific examples of the cationic surface-active agent include alkyl benzene dimethyl ammonium chloride, alkyl trimethyl ammonium chloride, and distearyl ammonium chloride. They can be used individually or in combinations of two or more.

(2) Wax

Preferred examples of the second wax include fatty acid hydrocarbon wax such as low molecular-weight polypropylene wax, low molecular-weight polyethylene wax, polypropylene-polyethylene copolymer wax, microcrystalline wax, paraffin wax, or Fischer-Tropsch wax.

As the second wax, e.g., wax obtained by the reaction of long chain alkyl alcohol, unsaturated polycarboxylic acid or its anhydride, and synthetic hydrocarbon wax also can be used. The long chain alkyl alcohol may have a carbon number of 4 to 30, and the wax preferably has an acid value of 10 to 80 mgKOH/g.

Moreover, the second wax may be obtained by the reaction of long chain alkylamine, unsaturated polycarboxylic acid or its anhydride, and unsaturated hydrocarbon wax. Alternatively, the second wax may be obtained by the reaction of long chain fluoroalkyl alcohol, unsaturated polycarboxylic acid or its anhydride, and unsaturated hydrocarbon wax. In either case, the long chain alkyl group can promote the releasing action, the ester group can improve the dispersibility of the wax with the resin, and the vinyl group can enhance the durability and the offset resistance.

This wax preferably has an acid value of 10 to 80 mgKOH/g and a melting point of 80° C. to 120° C., more preferably an acid value of 10 to 50 mgKOH/g and a melting point of 80° C. to 100° C., and further preferably an acid value of 35 to 50 mgKOH/g and a melting point of 85° C. to 95° C.

The wax can contribute to higher offset resistance, glossiness, and OHP transmittance in the oilless fixing. Moreover, the wax does not decrease the storage stability at high temperatures. When an image is formed by arranging three layers of color toner on a thin paper, the wax is particularly effective for improving the separability of the paper from the fixing roller or belt.

It is also possible to produce smaller particles that are emulsified and dispersed uniformly in a dispersant. Therefore, the wax can be mixed and aggregated uniformly with the resin particles and the pigment particles, which eliminates the presence of suspended solids and suppresses a dull color Thus, the oilless fixing that provides high glossiness and high transmittance can be achieved at low temperatures while preventing offset without using oil.

When the carbon number of the long chain alkyl group of the wax is less than 4, the releasing action is weakened, so that the separability and the high-temperature offset resistance are degraded. When the carbon number is more than 30, the mixing and aggregation of the wax with the resin become poor, resulting in low dispersibility. When the acid value is less than 10 mgKOH/g, the amount of charge of the toner is reduced over a long period of use. When the acid value is more than 80 mgKOH/g, the moisture resistance is decreased to increase fog under high humidity. Moreover, it is difficult to reduce the particle size of the emulsified and dispersed particles of the wax.

When the melting point is less than 80° C., the storage stability of the toner is reduced, and the high-temperature offset resistance is likely to be degraded. When it is more than 120° C., the low-temperature fixability is weakened, and the color transmittance is lowered. Moreover, it is difficult to reduce the particle size of the emulsified and dispersed particles of the wax.

Examples of the alcohol include alcohols having an alkyl chain with a carbon number of 4 to 30 such as octanol ($C_8H_{17}OH$), dodecanol ($C_{12}H_{25}OH$), stearyl alcohol ($C_{38}H_{37}OH$), nonacosanol ($C_{29}H_{59}OH$), and pentadecanol ($C_{15}H_{31}OH$). Examples of the amines include N-methylhexylamine, nonylamine, stearylamine, and nonadecylamine. Examples of the fluoroalkyl alcohol include 1-methoxy-(perfluoro-2-methyl-1-propene), and 3-perfluorooctyl-1,2-epoxypropane.

Examples of the unsaturated polycarboxylic acid or its anhydride include maleic acid, maleic anhydride, itaconic acid, itaconic anhydride, citraconic acid, and citraconic anhydride. They can be used individually or in combinations of two or more. In particular, the maleic acid and the maleic anhydride are preferred. Examples of the unsaturated hydrocarbon wax include ethylene, propylene, and α-olefin.

The unsaturated polycarboxylic acid or its anhydride is polymerized using alcohol or amine, and then is added to the synthetic hydrocarbon wax in the presence of dicumyl peroxide or tert-butylperoxy isopropyl monocarbonate.

The first wax includes at least one type of ester that includes at least one of higher alcohol having a carbon number of 16 to 24 and higher fatty acid having a carbon number of 16 to 24. The use of this wax can suppress the presence of suspended particles of the aliphatic hydrocarbon wax that are not incorporated into the aggregated particles, and also can prevent the particle size distribution of the aggregated particles from being broader. Moreover, when the resin particles further are added to form a shell, the wax can reduce a phenomenon in which secondary aggregation of the aggregated particles occurs rapidly, and the particles become coarser. The wax also can facilitate fixing of the toner at low temperatures.

Examples of the alcohol components include monoalcohol of methyl, ethyl, propyl, or butyl, glycols such as ethylene glycol or propylene glycol and polymers thereof, triols such as glycerin and polymers thereof, polyalcohol such as pentaerythritol, sorbitan, and cholesterol. When these alcohol components are polyalcohol, the higher fatty acid may be either monosubstituted or polysubstituted.

Specific examples are as follows: esters composed of higher alcohol having a carbon number of 16 to 24 and higher fatty acid having a carbon number of 16 to 24 such as stearyl stearate, palmityl palmitate, behenyl behenate, or stearyl montanate; esters composed of higher fatty acid having a carbon number of 16 to 24 and lower monoalcohol such as butyl stearate, isobutyl behenate, propyl montanate, or 2-ethylhexyl oleate; esters composed of higher fatty acid having a carbon number of 16 to 24 and polyalcohol such as montanic acid monoethylene glycol ester, ethylene glycol distearate, glyceride monostearate, glyceride monobehenate, glyceride tripalmitate, pentaerythritol monobehenate, pentaerythritol dilinoleate, pentaerythritol trioleate, or pentaerythritol tetrastearate; and esters composed of higher fatty acid having a carbon number of 16 to 24 and a polyalcohol polymer such as diethylene glycol monobehenate, diethylene glycol dibehenate, dipropylene glycol monostearate, diglyceride distearate, triglyceride tetrastearate, tetraglyceride hexabehenate, or decaglyceride decastearate. These waxes can be used individually or in combinations of two or more.

When the carbon number of the alcohol component and/or the acid component is less than 16, the wax is not likely to function as a dispersion assistant. When it is more than 24, the wax is not likely to function as a low-temperature fixing assistant.

The first wax preferably has an iodine value of not more than 25 and a saponification value of 30 to 300. By using the first wax with the second wax, an increase in the particle size can be prevented, thus producing toner base particles having a small particle size and a narrow particle size distribution. When the iodine value is more than 25, suspended solids in the aqueous medium are increased significantly, and the wax, resin, and colorant particles cannot be formed uniformly into aggregated particles. Thus, the particles become coarser and the particle size distribution tends to be broader. If such suspended solids remain in the toner, filming of the toner on a photoconductive member or the like occurs easily. This makes it difficult to relieve the repulsion caused by the charging action of the toner during multilayer transfer in the primary transfer process. The environmental dependence is large, and a change in chargeability of the material is increased and impairs the image stability over a long period of continuous use. Further, a developing memory can be generated easily. When the saponification value is less than 30, the presence of unsaponifiable matter and hydrocarbon is increased and makes it difficult to form small uniform aggregated particles. This may result in filming of the toner on a photoconductive member, low chargeability of the toner, and a reduction in chargeability during continuous use. When the saponification value is more than 300, suspended solids in the aqueous medium are increased significantly. Thus, the repulsion caused by the charging action of the toner is not likely to be relieved. Moreover, fog or toner scattering may be increased.

The wax preferably has a heating loss of not more than 8 wt % at 220° C. When the heating loss is more than 8 wt %, the glass transition point of the toner becomes low, and the storage stability is degraded. Therefore, such wax adversely affects the development property and allows fog or filming of the toner on a photoconductive member to occur. The particle size distribution of the toner becomes broader.

In the molecular weight characteristics of the wax based on gel permeation chromatography (GPC), it is preferable that the number-average molecular weight is 100 to 5000, the weight-average molecular weight is 200 to 10000, the ratio (weight-average molecular weight/number-average molecular weight) of the weight-average molecular weight to the number-average molecular weight is 1.01 to 8, the ratio (Z-average molecular weight/number-average molecular weight) of the Z-average molecular weight to the number-average molecular weight is 1.02 to 10, and there is at least one molecular weight maximum peak in the range of $5\times10^2$ to $1\times10^4$. It is more preferable that the number-average molecular weight is 500 to 4500, the weight-average molecular weight is 600 to 9000, the weight-average molecular weight/number-average molecular weight ratio is 1.01 to 7, and the Z-average molecular weight/number-average molecular weight ratio is 1.02 to 9. It is further preferable that the number-average molecular weight is 700 to 4000, the weight-average molecular weight is 800 to 8000, the weight-average molecular weight/number-average molecular weight ratio is 1.01 to 6, and the Z-average molecular weight/number-average molecular weight ratio is 1.02 to 8.

When the number-average molecular weight is less than 100, the weight-average molecular weight is less than 200, and the molecular weight maximum peak is in the range smaller than $5\times10^2$, the storage stability is degraded. Moreover, the handling property of the toner in a developing unit is reduced and impairs the stability of the toner concentration in two-component development. The filming of the toner on a photoconductive member may occur. The particle size distribution of the toner becomes broader.

When the number-average molecular weight is more than 5000, the weight-average molecular weight is more than 10000, the weight-average molecular weight/number-average molecular weight ratio is more than 8, the Z-average molecular weight/number-average molecular weight ratio is more than 10, and the molecular weight maximum peak is in the range larger than $1\times10^4$, the releasing action is weakened, and the fixing functions such as fixability and offset resistance are degraded. Moreover, it is difficult to reduce the particle size of the emulsified and dispersed particles of the wax.

An endothermic peak temperature (melting point: Tmw) based on a DSC method is preferably 50° C. to 90° C., more preferably 60° C. to 85° C., and further preferably 650° C. to 80° C. when the endothermic peak temperature is lower than 50° C., the storage stability of the toner is degraded. When the endothermic peak temperature is higher than 90° C., it is difficult to reduce the particle size of the emulsified and dispersed particles of the wax. The aggregation of the wax is reduced, and thus liberated particles may be increased in the aqueous medium.

Materials for the wax may be, e.g., meadowfoam oil, jojoba oil, Japan wax, beeswax, ozocerite, carnauba wax, candelilla wax, ceresin wax, rice wax, and derivatives thereof. They can be used individually or in combinations of two or more.

Examples of the meadowfoam oil derivative include meadowfoam oil fatty acid, a metal salt of the meadowfoam oil fatty acid, meadowfoam oil fatty acid ester, hydrogenated meadowfoam oil, and meadowfoam oil triester. These materials can produce an emulsified dispersion having a small particle size and a uniform particle size distribution. Moreover, the materials are effective to perform the oilless fixing, to increase the life of a developer, and to improve the transfer property. They can be used individually or in combinations of two or more.

Examples of the meadowfoam oil fatty acid ester include methyl, ethyl, butyl, and esters of glycerin, pentaerythritol, polypropylene glycol and trimethylol propane. In particular, e.g., meadowfoam oil fatty acid pentaerythritol monoester, meadowfoam oil fatty acid pentaerythritol triester, or meadowfoam oil fatty acid trimethylol propane ester is preferred. These materials can improve the cold offset resistance as well as the high-temperature offset resistance.

The hydrogenated meadowfoam oil can be obtained by adding hydrogen to meadowfoam oil to convert unsaturated bonds to saturated bonds. This can improve the offset resistance, glossiness, and transmittance.

Examples of the jojoba oil derivative include jojoba oil fatty acid, a metal salt of the jojoba oil fatty acid, jojoba oil fatty acid ester, hydrogenated jojoba oil, jojoba oil triester, a maleic acid derivative of epoxidized jojoba oil, an isocyanate polymer of jojoba oil fatty acid polyol ester, and halogenated modified jojoba oil. These materials can produce an emulsified dispersion having a small particle size and a uniform particle size distribution. The resin and the wax can be mixed and dispersed uniformly. Moreover, the materials are effective to perform the oilless fixing, to increase the life of a developer, and to improve the transfer property. They can be used individually or in combinations of two or more.

Examples of the jojoba oil fatty acid ester include methyl, ethyl, butyl, and esters of glycerin, pentaerythritol, polypropylene glycol and trimethylol propane. In particular, e.g., jojoba oil fatty acid pentaerythritol monoester, jojoba oil fatty acid pentaerythritol triester, or jojoba oil fatty acid trimethylol propane ester is preferred. These materials can improve the cold offset resistance as well as the high-temperature offset resistance.

The hydrogenated jojoba oil can be obtained by adding hydrogen to jojoba oil to convert unsaturated bonds to saturated bonds. This can improve the offset resistance, glossiness, and transmittance.

The saponification value is the milligrams of potassium hydroxide (KOH) required to saponify a 1 g sample and corresponds to the sum of an acid value and an ester value. When the saponification value is measured, a sample is saponified with approximately 0.5N potassium hydroxide in an alcohol solution, and then excess potassium hydroxide is titrated with 0.5N hydrochloric acid.

The iodine value may be determined in the following manner. The amount of halogen absorbed by a sample is measured while the halogen acts on the sample. Then, the amount of halogen absorbed is converted to iodine and expressed in grams per 100 g of the sample. The iodine value is grams of iodine absorbed, and the degree of unsaturation of fatty acid in the sample increases with the iodine value. A chloroform or carbon tetrachloride solution is prepared as a sample, and an alcohol solution of iodine and mercuric chloride or a glacial acetic acid solution of iodine chloride is added to the sample. After the sample is allowed to stand, the iodine that remains without undergoing any reaction is titrated with a sodium thiosulfate standard solution, thus calculating the amount of iodine absorbed.

The heating loss may be measured in the following manner. A sample cell is weighed precisely to the first decimal place (W1 mg). Then, 10 to 15 mg of sample is placed in the sample cell and weighed precisely to the first decimal place (W2 mg). This sample cell is set in a differential thermal balance and measured with a weighing sensitivity of 5 mg. After measurement, the weight loss (W3 mg) of the sample at 220° C. is read to the first decimal place using a chart. The measuring device is, e.g., TGD-3000 (manufactured by ULVAC-RICO, Inc.), the rate of temperature rise is 10° C./min, the maximum temperature is 220° C., and the retention time is 1 min. Accordingly, the heating loss (%) can be determined by $W3/(W2-W1)\times100$.

Thus, the transmittance in color images and the offset resistance can be improved. Moreover, it is possible to suppress spent on a carrier and to increase the life of a developer.

Preferred materials that can be used together or instead of the ester wax as the second wax may be, e.g., a derivative of hydroxystearic acid, glycerin fatty acid ester, glycol fatty acid ester, or sorbitan fatty acid ester. They can be used individually or in combinations of two or more. These materials can produce smaller particles that are emulsified and dispersed uniformly. By using the first wax with the second wax, an increase in the particle size can be prevented, thus producing toner base particles having a small particle size and a narrow particle size distribution.

Thus, the oilless fixing that provides high glossiness and high transmittance can be achieved at low temperatures while preventing offset without using oil. In addition to the oilless fixing, the life of a developer can be increased. While the uniformity of the toner in a developing unit can be maintained, the generation of a developing memory also can be reduced.

Examples of the derivative of hydroxystearic acid include methyl 12-hydroxystearate, butyl 12-hydroxystearate, propylene glycol mono 12-hydroxystearate, glycerin mono 12-hydroxystearate, and ethylene glycol mono 12-hydroxystearate. These materials have the effects of preventing filming and winding of a paper in the oilless fixing.

Examples of the glycerin fatty acid ester include glycerol stearate, glycerol distearate, glycerol tristearate, glycerol monopalmitate, glycerol dipalmitate, glycerol tripalmitate, glycerol behenate, glycerol dibehenate, glycerol tribehenate, glycerol monomyristate, glycerol dimyristate, and glycerol trimyristate. These materials have the effects of relieving cold offset at low temperatures in the oilless fixing and preventing a reduction in transfer property.

Examples of the glycol fatty acid ester include propylene glycol fatty acid ester such as propylene glycol monopalmitate or propylene glycol monostearate and ethylene glycol fatty acid ester such as ethylene glycol monostearate or ethylene glycol monopalmitate. These materials have the effects of improving the oilless fixability and preventing spent on a carrier while increasing the sliding property in development.

Examples of the sorbitan fatty acid ester include sorbitan monopalmitate, sorbitan monostearate, sorbitan tripalmitate, and sorbitan tristearate. Moreover, stearic acid ester of pentaerythritol, mixed esters of adipic acid and stearic acid or oleic acid, and the like are preferred. They can be used individually or in combinations of two or more. These materials have the effects of preventing filming and winding of a paper in the oilless fixing.

The above wax should be incorporated uniformly into the resin so as not to be liberated or suspended during mixing and aggregation. This may be affected by the particle size distribution, composition, and melting property of the wax.

The wax particle dispersion may be prepared in such a manner that wax is mixed in an aqueous medium (e.g., ion-exchanged water) including the surface-active agent, and then is heated, melted, and dispersed.

In this case, the wax may be emulsified and dispersed so that the particle size is 20 to 200 nm for 16% diameter (PR16), 40 to 300 nm for 50% diameter (PR50), not more than 400 nm for 84% diameter (PR84), and PR84/PR16 is 1.2 to 2.0 in a cumulative volume particle size distribution obtained by accumulation from the smaller particle diameter side. It is preferable that the ratio of particles having a diameter not greater than 200 nm is 65 vol % or more, and the ratio of particles having a diameter of greater than 500 nm is 10 vol % or less.

Preferably, the particle size may be 20 to 100 nm for 16% diameter (PR16), 40 to 160 nm for 50% diameter (PR50), not more than 260 nm for 84% diameter (PR84), and PR84/PR16 is 1.2 to 1.8 in the cumulative volume particle size distribution obtained by accumulation from the smaller particle diameter side. It is preferable that the ratio of particles having a diameter not greater than 150 nm is 65 vol % or more, and the ratio of particles having a diameter greater than 400 nm is 10 vol % or less.

More preferably, the particle size may be 20 to 60 nm for 16% diameter (PR16), 40 to 120 nm for 50% diameter (PR50), not more than 220 nm for 84% diameter (PR84), and PR84/PR16 is 1.2 to 1.8 in the cumulative volume particle size distribution obtained by accumulation from the smaller particle diameter side. It is preferable that the ratio of particles having a diameter not greater than 130 nm is 65 vol % or more, and the ratio of particles having a diameter greater than 300 nm is 10 vol % or less.

When the resin particle dispersion, the colorant particle dispersion, and the wax particle dispersion are mixed to form aggregated particles, the wax with a particle size of 20 to 200 nm for 16% diameter (PR16) can be dispersed finely and incorporated easily into the resin particles. Therefore, it is possible to prevent aggregation of the wax particles themselves that are not aggregated with the resin particles and the colorant particles, to achieve uniform dispersion, and to eliminate the suspended particles in the aqueous medium.

Moreover, when the aggregated particles are heated and melted in the aqueous medium, the molten wax is covered with the molten resin particles due to surface tension, so that the wax can be incorporated easily into the resin particles.

When the particle size is more than 200 nm for PR16, more than 300 nm for PR50, and more than 400 nm for PR84, PR84/PR16 is more than 2.0, the ratio of particles having a diameter not greater than 200 nm is than 65 vol %, and the ratio of particles having a diameter greater than 500 nm is more than 10 vol %, the wax particles are not incorporated easily into the resin particles and thus are prone to aggregation by themselves. Therefore, a large number of particles that are not incorporated into the resin particles are likely to be suspended in the aqueous medium. When the aggregated particles are heated and melted in the aqueous medium, the molten wax is not covered with the molten resin particles, so that the wax cannot be incorporated easily into the resin particles. Moreover, the amount of wax that is exposed on the surfaces of the aggregated particles and liberated therefrom is increased while further resin particles are fused. This may increase filming of the toner on a photoconductive member or spent of the toner on a carrier, reduce the handling property of the toner in a developing unit, and cause a developing memory.

When the particle size is less than 20 nm for PR16 and less than 40 nm for PR50, and PR84/PR16 is less than 1.2, it is difficult to maintain the dispersion state, and reaggregation of the wax occurs during the time it is allowed to stand, so that the standing stability of the particle size distribution can be degraded. Moreover, the load and heat generation are increased while the particles are dispersed, thus reducing productivity.

When the particle size for 50% diameter (PR50) of the wax dispersed in the wax particle dispersion is smaller than the particle size for 50% diameter (PR50) of the resin particles in forming the aggregated particles, the wax can be incorporated easily into the resin particles. Therefore, it is possible to prevent aggregation of the wax particles themselves that are not aggregated with the resin particles and the colorant particles, to achieve uniform dispersion, and to eliminate the suspended particles in the aqueous medium. Moreover, when the aggregated particles are heated and melted in the aqueous medium, the molten wax is covered with the molten resin particles due to surface tension, so that the wax can be incorporated easily into the resin particles. It is more preferable that the particle size for 50% diameter (PR50) of the wax is at least 20% smaller than that of the resin particles.

The wax particles can be dispersed finely in the following manner. A wax melt in which the wax is melted at a concentration of not more than 40 wt % is emulsified and dispersed into a medium that includes a surface-active agent and is maintained at temperatures not less than the melting point of the wax by utilizing the effect of a strong shearing force generated when a rotating body rotates at high speed relative to a fixed body with a predetermined gap between them.

Figure 3:
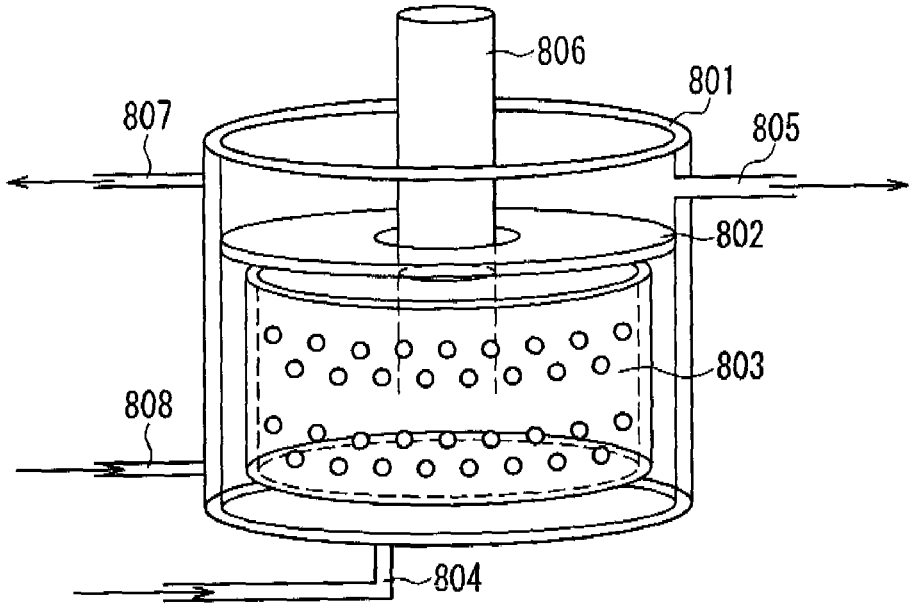
FIG. 3 is a schematic view showing a stirring/dispersing device used in an example of the present invention.
Figure 4:
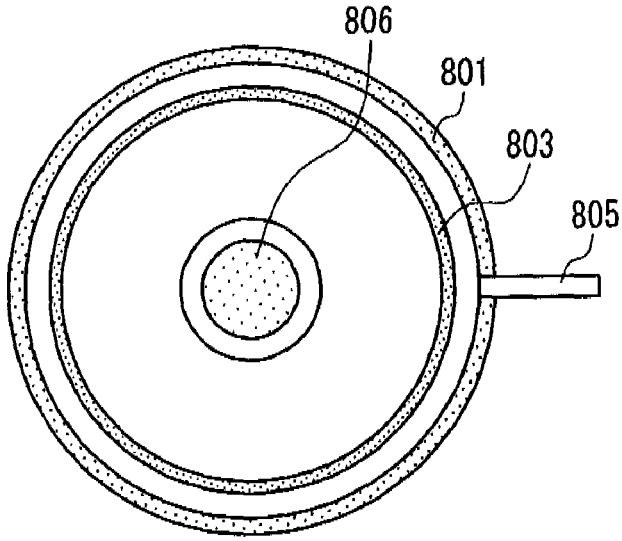
FIG. 4 is a plan view of the stirring/dispersing device in FIG. 3.

As shown in FIGS. 3 and 4, e.g., a rotating body may be placed in a tank having a certain capacity so that there is a gap of about 0.1 mm to 10 mm between the side of the rotating body and the tank wall. The rotating body rotates at a high speed of not less than 30 m/s, preferably not less than 40 m/s, and more preferably not less than 50 m/s and exerts a strong shearing force on the liquid, thus producing an emulsified dispersion with a finer particle size. A 30-second to 5-minute treatment may be enough to obtain the fine dispersion.

Figure 5:
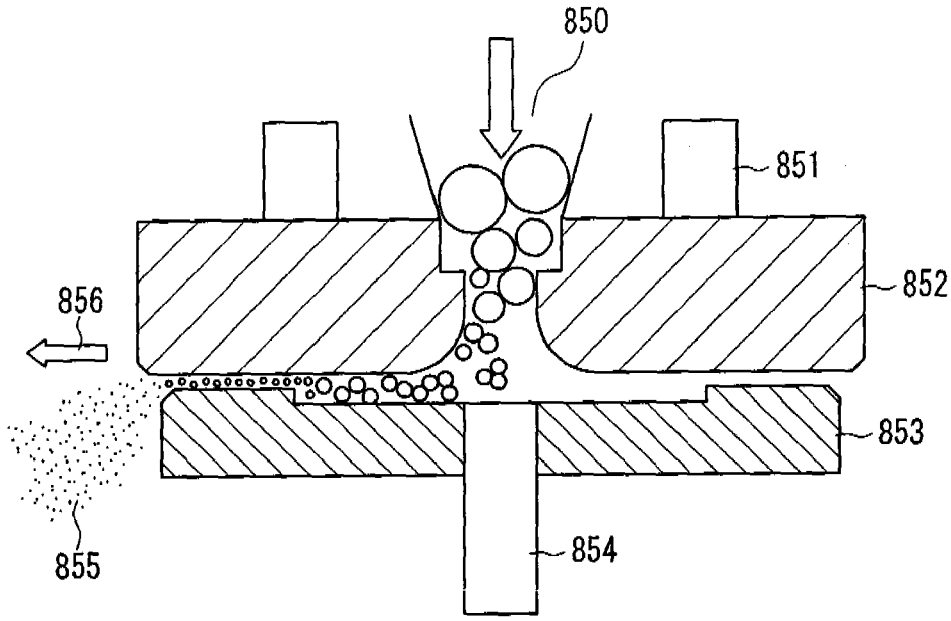
FIG. 5 is a schematic view showing a stirring/dispersing device used in an example of the present invention.
Figure 6:
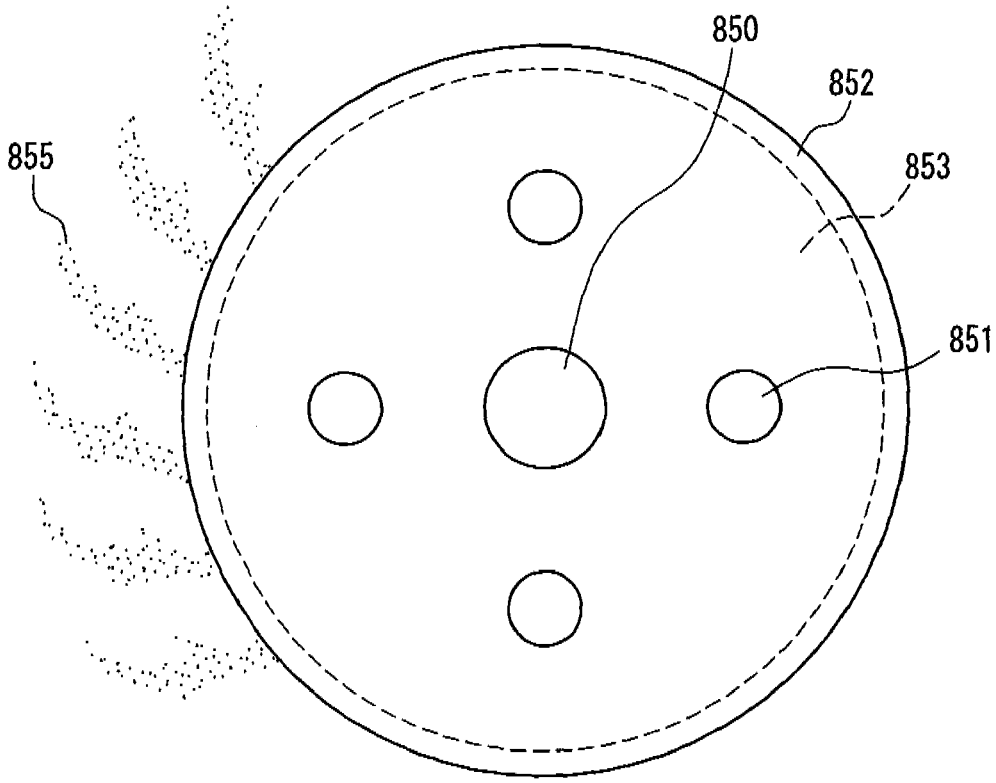
FIG. 6 is a plan view of the stirring/dispersing device in FIG. 5.

As shown in FIGS. 5 and 6, e.g., a rotating body may rotate at a speed of not less than 30 m/s, preferably not less than 40 m/s, and more preferably not less than 50 m/s relative to a fixed body, while a gap of about 1 to 100 μm is kept between them. This configuration also can provide the effect of a strong shearing force, thus producing a fine dispersion.

In this manner, it is possible to form a narrower and sharper particle size distribution of the fine particles than using a dispersing device such as a homogenizer. It is also possible to maintain a stable dispersion state without causing any reaggregation of the fine particles in the dispersion even when left standing for a long time. Thus, the standing stability of the particle size distribution can be improved.

When the wax has a high melting point, it may be heated under high pressure to form a melt. Alternatively, the wax may be dissolved in an oil solvent. This solution is blended with a surface-active agent or polyelectrolyte and dispersed in water to make a fine particle dispersion by using either of the dispersing devices as shown in FIGS. 3 and 4 and FIGS. 5 and 6, and then the oil solvent is evaporated by heating or under reduced pressure.

The particle size can be measured, e.g., by using a laser diffraction particle size analyzer LA920 (manufactured by Horiba, Ltd.) or SALD2100 (manufactured by Shimadzu Corporation).

(3) Resin

As the resin particles of the toner of this embodiment, e.g., a thermoplastic binder resin can be used. Specific examples of the thermoplastic binder resin include the following: styrenes such as styrene, parachloro styrene, and α-methyl styrene; acrylic monomers such as methyl acrylate, ethyl acrylate, n-propyl acrylate, lauryl acrylate, and 2-ethylhexyl acrylate; methacrylic monomers such as methyl methacrylate, ethyl methacrylate, n-propyl methacrylate, lauryl methacrylate, and 2-ethylhexyl methacrylate; a homopolymer of unsaturated polycarboxylic acid monomers having a carboxyl group as a dissociation group such as acrylic acid, methacrylic acid, maleic acid, or fumaric acid; a copolymer of two or more or these monomers; or a mixture of these substances.

The content of resin particles in the resin particle dispersion is generally 5 to 50 wt %, and preferably 10 to 30 wt %. The molecular weights of the resin, wax, and toner can be measured by gel permeation chromatography (GPC) using several types of monodisperse polystyrene as standard samples.

The measurement may be performed with HPLC 8120 series manufactured by TOSOH CORP., using TSK gel super HM-H H4000/H3000/H2000 (7.8 mm diameter, 150 mm×3) as a column and THF (tetrahydrofuran) as an eluent, at a flow rate of 0.6 ml/min, a sample concentration of 0.1%, an injection amount of 20 μL, RI as a detector, and at a temperature of 40° C. Prior to the measurement, the sample is dissolved in THF, and then is filtered through a 0.45 μm filter so that additives such as silica are removed to measure the resin component. The measurement requirement is that the molecular weight distribution of the subject sample is in the range where the logarithms and the count numbers of the molecular weights in the analytical curve obtained from the several types of monodisperse polystyrene standard samples form a straight line.

The wax obtained by the reaction of long chain alkyl alcohol, unsaturated polycarboxylic acid or its anhydride, and synthetic hydrocarbon wax can be measured with GPC-150C (manufactured by Waters Corporation), using Shodex HT806M (8.0 mm I.D.–30 cm×2) as a column and o-dichlorobenzene as an eluent, at a flow rate of 1.0 mL/min, a sample concentration of 0.3%, an injection amount of 200 μL, RI as a detector, and at a temperature of 130° C. Prior to the measurement, the sample is dissolved in a solvent, and then is filtered through a 0.5 μm sintered metal filter. The measurement requirement is that the molecular weight distribution of the subject sample is in the range where the logarithms and the count numbers of the molecular weights in the analytical curve obtained from the several types of monodisperse polystyrene standard samples form a straight line.

The softening point of the binder resin can be measured with a capillary rheometer flow tester (CFT-500, constant-pressure extrusion system, manufactured by Shimadzu Corporation). A load of about $9.8\times10^5$ N/m$^2$ is applied to a 1 cm$^3$ sample with a plunger while heating the sample at a temperature increase rate of 6° C./min, so that the sample is extruded from a die having a diameter of 1 mm and a length of 1 mm. Based on the relationship between the piston stroke of the plunger and the temperature increase characteristics, when the temperature at which the piston stroke starts to rise is a flow start temperature (Tfb), one-half the difference between the minimum value of a curve and the flow end point is determined. Then, the resultant value and the minimum value of the curve are added to define a point, and the temperature of this point is identified as a melting point (softening point Tm) according to a ½ method.

The glass transition point of the resin can be measured with a differential scanning calorimeter (DSC-50 manufactured by Shimadzu Corporation). The temperature of a sample is raised to 100° C., retained for 3 minutes, and reduced to room temperature at 10° C./min. Subsequently, the temperature is raised at 10° C./min, and a thermal history of the sample is measured. In the thermal history, an intersection point of an extension line of the base line lower than a glass transition point and a tangent that shows the maximum inclination between the rising point and the highest point of a peak is determined. The temperature of this intersection point is identified as a glass transition point.

The melting point at an endothermic peak of the wax based on the DSC method can be measured with a differential scanning calorimeter (DSC-50 manufactured by Shimadzu Corporation). The temperature of a sample is raised to 200° C. at 5° C./min, retained for 5 minutes, and reduced to 10° C. rapidly. Subsequently, the sample is allowed to stand for 15 minutes, and the temperature is raised at 5° C./min. Then, the melting point is determined from the endothermic (melt) peak. The amount of the sample placed in a cell is 10 mg±2 mg.

(4) Pigment

Preferred examples of a colorant (pigment) used in this embodiment include the following. As black pigments, carbon black, iron black, graphite, nigrosine, or a metal complex of azo dyes can be used.

As yellow pigments, acetoacetic acid aryl amide monoazo yellow pigments such as C. I. Pigment Yellow 1, 3, 74, 97, and 98, acetoacetic acid aryl amide disazo yellow pigments such as C. I. Pigment Yellow 12, 13, 14, and 17, C. I. Solvent Yellow 19, 77, and 79, or C. I. Disperse Yellow 164 can be used. In particular, benzimidazolone pigments of C. I. Pigment Yellow 93, 180, and 185 are suitable.

As magenta pigments, red pigments such as C. I. Pigment Red 48, 49:1, 53:1, 57, 57:1, 81, 122 and 5, or red dyes such as C. I. Solvent Red 49, 52, 58 and 8 can be used.

As cyan pigments, blue dyes/pigments of phthalocyanine and its derivative such as C. I. Pigment Blue 15:3 can be used. The added amount is preferably 3 to 8 parts by weight per 100 parts by weight of the binder resin.

The median diameter of the pigment particles is generally not more than 1 μm, and preferably 0.01 to 1 μm. When the median diameter is more than 1 μm, toner as a final product for electrostatic charge image development can have a broader particle size distribution. Moreover, liberated particles are generated and tend to reduce the performance or reliability. When the median diameter is within the above range, these disadvantages are eliminated, and the uneven distribution of the toner is decreased. Therefore, the dispersion of the pigment particles in the toner can be improved, resulting in a smaller variation in performance and reliability. The median diameter can be measured, e.g., by a laser diffraction particle size analyzer (LA 920 manufactured by Horiba, Ltd.).

(5) Additive

In this embodiment, inorganic fine powder is added as an additive. Examples of the additive include metal oxide fine powder such as silica, alumina, titanium oxide, zirconia, magnesia, ferrite, or magnetite, titanate such as barium titanate, calcium titanate, or strontium titanate, zirconate such as barium zirconate, calcium zirconate, or strontium zirconate, and a mixture of these substances. The additive can be made hydrophobic as needed.

A preferred silicone oil material that is used to treat the additive is expressed by Chemical Formula (1).

Chemical Formula (1):

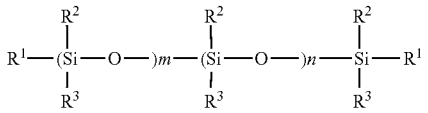

(where $R^2$ is an alkyl group having a carbon number of 1 to 3, $R^3$ is an alkyl group having a carbon number of 1 to 3, a halogen modified alkyl group, a phenyl group, or a substituted phenyl group, $R^1$ is an alkyl group having a carbon number of 1 to 3 or an alkoxy group having a carbon number of 1 to 3, and m and n are integers of 1 to 100).

Examples of the silicone oil material include dimethyl silicone oil, methyl hydrogen silicone oil, methyl phenyl silicone oil, cyclic dimethyl silicone oil, epoxy modified silicone oil, fluorine modified silicone oil, amino modified silicone oil, and chlorophenyl modified silicone oil. The additive that is treated with at least one of the above silicone oil materials is used preferably. For example, SH200, SH510, SF230, SH203, BY16-823, or BY16-855B manufactured by Toray-Dow Corning Co., Ltd. can be used.

The treatment may be performed by mixing the additive and the silicone oil material with a mixer (e.g., a Henshel mixer, FM20B manufactured by Mitsui Mining Co., Ltd.). Moreover, the silicone oil material may be sprayed onto the additive. Alternatively, the silicone oil material may be dissolved or dispersed in a solvent, and mixed with the additive, followed by removal of the solvent. The amount of silicone oil material is preferably 1 to 20 parts by weight per 100 parts by weight of the additive.

Examples of a silane coupling agent include dimethyldichlorosilane, trimethylchlorosilane, allyldimethylchlorosilane, and hexamethyldisilazane. The silane coupling agent may be treated by a dry treatment in which the additive is fluidized by agitation or the like, and an evaporated silane coupling agent is reacted with the fluidized additive, or a wet treatment in which a silane coupling agent dispersed in a solvent is added dropwise to the additive.

It is also preferable that the silicone oil material is treated after a silane coupling treatment.

The additive having positive chargeability may be treated with aminosilane, amino modified silicone oil expressed by Chemical Formula (2), or epoxy modified silicone oil.

Chemical Formula (2):

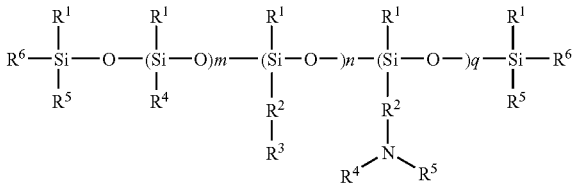

(where $R^1$ and $R^6$ are hydrogen, an alkyl group having a carbon number of 1 to 3, an alkoxy group, or an aryl group, $R^2$ is an alkylene group having a carbon number of 1 to 3 or a phenylene group, $R^3$ is an organic group including a nitrogen heterocyclic ring, $R^4$ and $R^5$ are hydrogen, an alkyl group having a carbon number of 1 to 3, or an aryl group, m is positive numbers of not less than 1, and n and q are positive integers including 0).

To enhance a hydrophobic treatment, hexamethyldisilazane, dimethyldichlorosilane, or other silicone oil also can be used along with the above materials. For example, at least one selected from dimethyl silicone oil, methylphenyl silicone oil, and alkyl modified silicone oil is preferred to treat the inorganic fine powder.

It is preferable that 1 to 6 parts by weight of the additive having an average particle size of 6 nm to 200 nm is added to 100 parts by weight of toner base particles. When the average particle size is less than 6 nm, suspended particles are generated, and filming of the toner on a photoconductive member is likely to occur. Therefore, it is difficult to avoid the occurrence of reverse transfer. When the average particle size is more than 200 nm, the flowability of the toner is decreased. When the amount of the additive is less than 1 part by weight, the flowability of the toner is decreased, and it is difficult to avoid the occurrence of reverse transfer. When the amount of the additive is more than 6 parts by weight, suspended particles are generated, and filming of the toner on a photoconductive member is likely to occur, thus degrading the high-temperature offset resistance.

Moreover, it is preferable that 0.5 to 2.5 parts by weight of the additive having an average particle size of 6 nm to 20 nm, and 0.5 to 3.5 parts by weight of the additive having an average particle size of 20 nm to 200 nm are added to 100 parts by weight of toner base particles. With this configuration, the additives of different functions can improve both the charge-imparting property and the charge-retaining property, and also can ensure larger margins against reverse transfer, transfer voids, and scattering of the toner during transfer. In this case, the ignition loss of the additive having an average particle size of 6 nm to 20 nm is preferably 0.5 to 20 wt %, and the ignition loss of the additive having an average particle size of 20 nm to 200 nm is preferably 1.5 to 25 wt %. When the ignition loss of the additive having an average particle size of 20 nm to 200 nm is larger than that of the additive having an average particle size of 6 nm to 20 nm, it is effective in improving the charge-retaining property and suppressing reverse transfer and transfer voids.

By specifying the ignition loss of the additive, larger margins can be ensured against reverse transfer, transfer voids, and scattering of the toner during transfer. Moreover, the handling property of the toner in a developing unit can be improved, thus increasing the uniformity of the toner concentration. The generation of a developing memory also can be reduced.

When the ignition loss of the additive having an average particle size of 6 nm to 20 nm is less than 0.5 wt %, the margins against reverse transfer and transfer voids become narrow. When the ignition loss is more than 20 wt %, the surface treatment is not uniform, resulting in charge variations. The ignition loss is preferably 1.5 to 17 wt %, and more preferably 4 to 10 wt %.

When the ignition loss of the additive having an average particle size of 20 nm to 200 nm is less than 1.5 wt %, the margins against reverse transfer and transfer voids become narrow. When the ignition loss is more than 25 wt %, the surface treatment is not uniform, resulting in charge variations. The ignition loss is preferably 2.5 to 20 wt %, and more preferably 5 to 15 wt %.

Further, it is preferable that 0.5 to 2 parts by weight of the additive having an average particle size of 6 nm to 20 nm and an ignition loss of 0.5 to 20 wt %, 0.5 to 3.5 parts by weight of the additive having an average particle size of 20 nm to 100 nm and an ignition loss of 1.5 to 25 wt %, and 0.5 to 2.5 parts by weight of the additive having an average particle size of 100 nm to 200 nm and an ignition loss of 0.1 to 10 wt % are added to 100 parts by weight of toner base particles. With this configuration, the additives of different functions, having the specified average particle size and ignition loss, can improve both the charge-imparting property and the charge-retaining property, suppress reverse transfer and transfer void, and remove a substance attached to the surface of a carrier.

It is also preferable that 0.2 to 1.5 parts by weight of a positively charged additive having an average particle size of 6 nm to 200 nm and an ignition loss of 0.5 to 25 wt % are added further to 100 parts by weight of toner base particles.

The addition of the positively charged additive can suppress the overcharge of the toner for a long period of continuous use and increase the life of a developer. Therefore, the scattering of the toner during transfer caused by overcharge also can be reduced. Moreover, it is possible to prevent spent on a carrier. When the amount of positively charged additive is less than 0.2 parts by weight, these effects are not likely to be obtained. When it is more than 1.5 parts by weight, fog is increased significantly during development. The ignition loss is preferably 1.5 to 20 wt %, and more preferably 5 to 19 wt %.

A drying loss (%) can be determined in the following manner. A container is dried, allowed to stand and cool, and weighed precisely beforehand. Then, a sample (about 1 g) is put in the container, weighed precisely, and dried for 2 hours with a hot-air dryer at 105° C.±1° C. After cooling for 30 minutes in a desiccator, the weight is measured, and the drying loss is calculated by the following formula.

$$\text{Drying loss}(\%)=[\text{weight loss}(g)\text{by drying/sample amount}(g)]\times 100.$$

An ignition loss can be determined in the following manner. A magnetic crucible is dried, allowed to stand and cool, and weighed precisely beforehand. Then, a sample (about 1 g) is put in the crucible, weighed precisely, and ignited for 2 hours in an electric furnace at 500° C. After cooling for 1 hour in a desiccator, the weight is measured, and the ignition loss is calculated by the following formula.

$$\text{Ignition loss}(\%)=[\text{weight loss}(g)\text{by ignition/sample amount}(g)]\times 100.$$

(6) Powder Physical Characteristics of Toner

In this embodiment, it is preferable that toner base particles including a binder resin, a colorant, and wax have a volume-average particle size of 3 to 7 μm, the content of the toner base particles having a particle size of 2.52 to 4 μm in a number distribution is 10 to 75% by number, the toner base particles having a particle size of 4 to 6.06 μm in a volume distribution is 25 to 75% by volume, the toner base particles having a particle size of not less than 8 μm in the volume distribution is not more than 5% by volume, P46/V46 is in the range of 0.5 to 1.5 where V46 is the volume percentage of the toner base particles having a particle size of 4 to 6.06 μm in the volume distribution and P46 is the number percentage of the toner base particles having a particle size of 4 to 6.06 μm in the number distribution, the coefficient of variation in the volume-average particle size is 10 to 25%, and the coefficient of variation in the number particle size distribution is 10 to 28%.

More preferably, the toner base particles have a volume-average particle size of 3 to 6.5 μm, the content of the toner base particles having a particle size of 2.52 to 4 μm in the number distribution is 20 to 75% by number, the toner base particles having a particle size of 4 to 6.06 μm in the volume distribution is 35 to 75% by volume, the toner base particles having a particle size of not less than 8 μm in the volume distribution is not more than 3% by volume, P46/V46 is in the range of 0.5 to 1.3 where V46 is the volume percentage of the toner base particles having a particle size of 4 to 6.06 μm in the volume distribution and P46 is the number percentage of the toner base particles having a particle size of 4 to 6.06 μm in the number distribution, the coefficient of variation in the volume-average particle size is 10 to 20%, and the coefficient of variation in the number particle size distribution is 10 to 23%.

Further preferably, the toner base particles have a volume-average particle size of 3 to 5 μm, the content of the toner base particles having a particle size of 2.52 to 4 μm in the number distribution is 40 to 75% by number, the toner base particles having a particle size of 4 to 6.06 μm in the volume distribution is 45 to 75% by volume, the toner base particles having a particle size of not less than 8 μm in the volume distribution is not more than 3% by volume, P46/V46 is in the range of 0.5 to 0.9 where V46 is the volume percentage of the toner base particles having a particle size of 4 to 6.06 μm in the volume distribution and P46 is the number percentage of the toner base particles having a particle size of 4 to 6.06 μm in the number distribution, the coefficient of variation in the volume-average particle size is 10 to 15%, and the coefficient of variation in the number particle size distribution is 10 to 18%.

The toner base particles with the above characteristics can provide high-resolution image quality, prevent reverse transfer and transfer voids during tandem transfer, and achieve the oilless fixing. The fine powder in the toner affects the flowability, image quality, and storage stability of the toner, filming of the toner on a photoconductive member, developing roller, or transfer member, the aging property, the transfer property, and particularly the multilayer transfer property in a tandem system. The fine powder also affects the offset resistance, glossiness, and transmittance in the oilless fixing. When the toner includes wax or the like to achieve the oilless fixing, the amount of fine powder may affect compatibility between the oilless fixing and the tandem transfer property.

When the volume-average particle size is more than 7 μm, the image quality and the transfer property cannot be ensured together. When the volume-average particle size is less than 3 μm, the handling property of the toner particles in development is reduced.

When the content of the toner base particles having a particle size of 2.52 to 4 μm in the number distribution is less than 10% by number, the image quality and the transfer property cannot be ensured together. When it is more than 75% by number, the handling property of the toner particles in development is reduced. Moreover, the filming of the toner on a photoconductive member, developing roller, or transfer member is likely to occur. The adhesion of the fine powder to a heat roller is large, and thus tends to cause offset. In the tandem system, the agglomeration of the toner is likely to be stronger, which easily leads to a transfer failure of the second color during multilayer transfer. Therefore, an appropriate range is necessary.

When the toner base particles having a particles size of 4 to 6.06 μm in the volume distribution is more than 75% by volume, the image quality and the transfer property cannot be ensured together. When it is less than 30% by volume, the image quality is degraded.

When the toner base particles having a particle size of not less than 8 μm in the volume distribution is more than 5% by volume, the image quality is degraded to cause a transfer failure.

When P461V46 (V46 is the volume percentage of the toner base particles having a particle size of 4 to 6.06 μm in the volume distribution and P46 is the number percentage of the toner base particles having a particle size of 4 to 6.06 μm in the number distribution) is less than 0.5, the amount of fine powder is increased excessively, so that the flowability and the transfer property are decreased, and fog becomes worse. When P46/V46 is more than 1.5, the number of large particles is increased, and the particle size distribution becomes broader. Thus, high image quality cannot be achieved.

The purpose of controlling P46/V46 is to provide an index for reducing the size of the toner particles and narrowing the particle size distribution.

The coefficient of variation is obtained by dividing a standard deviation by an average particle size of the toner particles based on the measurement using a Coulter Counter (manufactured by Coulter Electronics, Inc.). When the particle sizes of n particles are measured, the standard deviation can be expressed by the square root of the value that is obtained by dividing the square of a difference between each of the n measured values and the mean value by (n−1).

In other words, the coefficient of variation indicates the degree of expansion of the particle size distribution. When the coefficient of variation of the volume particle size distribution or the number particle size distribution is less than 10%, the production becomes difficult, and the cost is increased. When the coefficient of variation of the volume particle size distribution is more than 25%, or when the coefficient of variation of the number particle size distribution is more than 28%, the particle size distribution is broader, and the agglomeration of toner is stronger. This may lead to filming of the toner on a photoconductive member, a transfer failure, and difficulty of recycling the residual toner in a cleanerless process.

The particle size distribution is measured, e.g., by using a Coulter Counter TA-II (manufactured by Coulter Electronics, Inc.). An interface (manufactured by Nikkaki Bios Co., Ltd.) for outputting a number distribution and a volume distribution and a personal computer are connected to the Coulter Counter TA-II. An electrolytic solution (about 50 ml) is prepared by including a surface-active agent (sodium lauryl sulfate) so as to have a concentration of 1%. About 2 mg of measuring toner is added to the electrolytic solution. This electrolytic solution in which the sample is suspended is dispersed for about 3 minutes with an ultrasonic dispersing device, and then is measured using the 70 μm aperture of the Coulter Counter TA-II. In the 70 μm aperture system, the measurement range of the particle size distribution is 1.26 μm to 50.8 μm. However, the region smaller than 2.0 μm is not suitable for practical use because the measurement accuracy or reproducibility is low under the influence of external noise or the like. Therefore, the measurement range is set from 2.0 μm to 50.8 μm.

(7) Carrier

A carrier of this embodiment includes magnetic particles as a core material, and the surface of the core material is coated with a fluorine modified silicone resin containing an aminosilane coupling agent. Moreover, the carrier may include composite magnetic particles including at least magnetic particles and a binder resin, and the surfaces of the composite magnetic particles are coated with the fluorine modified silicone resin containing an aminosilane coupling agent.

A thermosetting resin is suitable for the binder resin of the composite magnetic particles. Examples of the thermosetting resin include a phenol resin, an epoxy resin, a polyamide resin, a melamine resin, a urea resin, an unsaturated polyester resin, an alkyd resin, a xylene resin, an acetoguanamine resin, a furan resin, a silicone resin, a polyimide resin, and a urethane resin. Although these resins can be used individually or in combinations of two or more, it is preferable to include at least the phenol resin.

The composite magnetic particles of the present invention may be spherical particles having an average particle size of 10 to 50 μm, preferably 10 to 40 μm, more preferably 10 to 30 μm, and most preferably 15 to 30 μm. The specific gravity of the composite magnetic particles may be 2.5 to 4.5, and particularly 2.5 to 4.0. The BET specific surface area based on nitrogen adsorption of the carrier is preferably 0.03 to 0.3 $m^2/g$. When the average particle size of the carrier is less than 10 μm, the abundance ratio of fine particles in the carrier particle distribution is increased, and the magnetization per carrier particle is reduced. Therefore, the carrier is likely to be developed on a photoconductive member. When the average particle size is more than 50 μm, the specific surface area of the carrier particles is smaller, and the toner retaining ability is decreased to cause toner scattering. For full color images including many solid portions, the reproduction of the solid portions is particularly worse.

A conventional carrier including ferrite core particles has a large specific gravity of 5 to 6, and also has a large particle size of 50 to 80 μm. Therefore, the BET specific surface area is small, and the mixing of the carrier with the toner is weak during stirring. Thus, the charge build-up property is insufficient when the toner is supplied, and toner consumption is increased. For this reason, at the time of supplying a large amount of toner, considerable fog is likely to be generated. Moreover, if the ratio of concentration of the toner to the carrier is not controlled in a narrow range, it is difficult to reduce fog and toner scattering while maintaining the image density. However, the carrier having a large specific surface area value can suppress the image deterioration, even if the concentration ratio is controlled in a broad range, so that the toner concentration can be controlled roughly.

The above toner is substantially spherical in shape and has a specific surface area value close to that of the carrier Therefore, the carrier and the toner can be mixed more uniformly by stirring, and the charge build-up property is good when the toner is supplied. Moreover, even if the concentration ratio of the toner to the carrier is controlled in a broader range, the image deterioration is suppressed, and fog and toner scattering can be reduced while maintaining the image density.

In this case, the image quality can be stabilized by satisfying the relationship TS/CS=2 to 110, where TS ($m^2/g$) represents the specific surface area value of the toner and CS ($m^2/g$) represents the specific surface area value of the carrier. TS/CS is preferably 2 to 50, and more preferably 2 to 30. When TS/CS is less than 2, the adhesion of the carrier is likely to occur. When it is more than 110, the concentration ratio of the toner to the carrier has to be narrow so as to reduce fog and toner scattering while maintaining the image density. Thus, the image deterioration is caused easily. The conventional carrier including ferrite core particles has a small specific surface area value. The conventional pulverized toner is irregular in shape and has a large specific surface area value.

The composite magnetic particles including magnetic particles and a phenol resin may be produced in such a manner that phenols and aldehydes react and cure while they are stirred into an aqueous medium in the presence of the magnetic particles and a basic catalyst.

The average particle size of the composite magnetic particles can be controlled by controlling the agitating speed of an agitator so that appropriate shear or consolidation is applied in accordance with the amount of water used.

The composite magnetic particles using an epoxy resin as the binder resin may be produced in such a manner that bisphenol, epihalohydrin, and lipophilized inorganic compound particles are dispersed in an aqueous medium and react in an alkaline aqueous medium.

The composite magnetic particles of the present invention may include 1 to 20 wt % of a binder resin and 80 to 99 wt % of magnetic particles. When the content of the magnetic particles is less than 80 wt %, the saturation magnetization is reduced. When it is more than 99 wt %, the binding between the magnetic particles with the phenol resin is likely to be weaker. In view of the strength of the composite magnetic particles, the content of the magnetic particles is preferably 97 wt % or less.

Examples of the magnetic particles include spinel ferrite such as magnetite or gamma iron oxide, spinel ferrite including one or more than one metal (Mn, Ni, Zn, Mg, Cu, etc.) other than iron, magnetoplumbite ferrite such as barium ferrite, and iron or alloy fine particles having an oxide layer on the surface thereof. The magnetic particles may be granular, spherical, or acicular in shape. Ferromagnetic fine particles of iron or the like also can be used, particularly when high magnetization is required. In view of the chemical stability, however, it is preferable to use ferromagnetic fine particles of the spinel ferrite such as magnetite or gamma iron oxide or the magnetoplumbite ferrite such as barium ferrite. The composite magnetic particles with desired saturation magnetization can be obtained by selecting the type and content of the ferromagnetic fine particles appropriately.

According to the measurement under a magnetic field of 1000 oersted (79.57 kA/m), the magnetization strength may be 30 to 70 $\mu m^2/kg$, and preferably 35 to 60 $Am^2/kg$, the residual magnetization (σr) may be 0.1 to 20 $Am^2/kg$, and preferably 0.1 to 10 $Am^2/kg$, and the specific resistance value may be $1\times10^6$ to $1\times10^{14}\Omega\cdot cm$, preferably $5\times10^6$ to $5\times10^{13}\Omega\cdot cm$, and more preferably $5\times10^6$ to $5\times10^9$ Ωcm.

In a method for producing the carrier of the present invention, phenols and aldehydes, together with magnetic particles and a suspension stabilizer, react in an aqueous medium in the presence of a basic catalyst.

Examples of the phenols used as the binder resin include phenol, alkylphenol such as m-cresol, p-tert-butyl phenol, o-propylphenol, resorcinol, or bisphenol A, and a compound having a phenolic hydroxyl group such as halogenated phenol in which part or all of the benzene nucleus or the alkyl group is replaced by chlorine or bromine atoms. Above all, phenol is most preferred. When compounds other than phenol are used, particles are not formed easily or may have an irregular shape, even if they are formed. Therefore, phenol is most preferred in view of the shape of the particles.

Examples of the aldehydes used in the method for producing the composite magnetic particles include formaldehyde in the form of either formalin or paraformaldehyde and furfural. Above all, formaldehyde is particularly preferred.

A fluorine modified silicone resin is essential for the resin coating of the present invention. The fluorine modified silicone resin may be a cross-linked fluorine modified silicone resin obtained by the reaction between an organosilicon compound containing a perfluoroalkyl group and polyorganosiloxane. It is preferable that 3 to 20 parts by weight of the organosilicon compound containing a perfluoroalkyl group is mixed with 100 parts by weight of the polyorganosiloxane. Compared to the coating on the conventional ferrite core particles, the adhesion of the composite magnetic particles in which magnetic particles are dispersed in a curable resin is strengthened, thus improving the durability along with the chargeability (as will be described later).

The polyorganosiloxane preferably has at least one repeating unit selected from the following Chemical Formulas (3) and (4).

Chemical Formula (3):

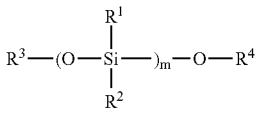

(where $R^1$ and $R^2$ are a hydrogen atom, a halogen atom, a hydroxy group, a methoxy group, an alkyl group having a carbon number of 1 to 4, or a phenyl group, $R^3$ and $R^4$ are an alkyl group having a carbon number of 1 to 4 or a phenyl group, and m represents a mean degree of polymerization and is positive integers (preferably in the range of 2 to 500, and more preferably in the range of 5 to 200)).

Chemical Formula (4):

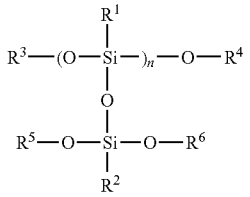

(where $R^1$ and $R^2$ are a hydrogen atom, a halogen atom, a hydroxy group, a methoxy group, an alkyl group having a carbon number of 1 to 4, or a phenyl group, $R^3$, $R^4$, $R^5$ and $R^6$ are an alkyl group having a carbon number of 1 to 4 or a phenyl group, and n represents a mean degree of polymerization and is positive integers (preferably in the range of 2 to 500, and more preferably in the range of 5 to 200)).

Examples of the organosilicon compound containing a perfluoroalkyl group include $CF_3CH_2CH_2Si(OCH_3)_3$, $C_4F_9CH_2CH_2Si(CH_3)(OCH_3)_2$, $C_8F_{17}CH_2CH_2Si(OCH_3)_3$, $C_8F_{17}CH_2CH_2Si(OC_2H_5)_3$, and $(CF_3)_2CF(CF_2)_sCH_2CH_2Si(OCH_3)_3$. In particular, a compound containing a trifluoropropyl group is preferred.

In this embodiment, the aminosilane coupling agent is included in the resin coating. As the aminosilane coupling agent, e.g., the following known materials can be used: γ-(2-aminoethyl)aminopropyltrimethoxysilane, γ-(2-aminoethyl) aminopropylmethyldimethoxysilane, and octadecylmethyl [3-(trimethoxysilyl)propyl]ammonium chloride (corresponding to SH6020, SZ6023, and AY43-021 manufactured by Toray-Dow Corning Co., Ltd.); KBM602, KBM603, KBE903, and KBM573 (manufactured by Shin-Etsu Chemical Co., Ltd.). In particular, the primary amine is preferred. The secondary or tertiary amine that is substituted with a methyl group, an ethyl group, or a phenyl group has weak polarity and is less effective for the charge build-up property of the toner. When the amino group is replaced by an aminomethyl group, an aminoethyl group, or an aminophenyl group, the end of a straight chain extended from silane of the silane coupling agent can be the primary amine. However, the amino group contained in the organic group of the straight chain does not contribute to the charge build-up property and is affected by moisture under high humidity. Therefore, although the carrier may have charging ability for the initial toner because the amino group is at the end, the charging ability is decreased during printing, resulting in a short life of the carrier.

By using the above aminosilane coupling agent with the fluorine modified silicone resin of this embodiment, the toner can be charged negatively while maintaining a sharp charge distribution. When the toner is supplied, it shows a quick rise in charge, and thus the toner consumption can be reduced. Moreover, the aminosilane coupling agent has the effect comparable to that of a cross-linking agent, and therefore can increase the degree of cross-linking of the coating of fluorine modified silicone resin as a base resin. The hardness of the resin coating is improved further, so that abrasion or peeling can be reduced over a long period of use. Accordingly, higher resistance to spent can be obtained, and the electrification can be stabilized by suppressing a decrease in the charging ability of the carrier, thus improving the durability.

When wax having a low melting point is added to toner with the above configuration in an amount greater than a given value, the chargeability of the toner is rather unstable because the toner surface consists mainly of resin. There may be some cases where the chargeability is weaker and the rise in charge is slower. This tends to cause fog, poor uniformity of a solid image, and transfer voids or skipping in characters during transfer. However, combining the toner with the carrier of this embodiment can overcome these problems and improve the handling property of the toner in a developing unit. Moreover, a so-called developing memory, i.e., a history that is left after taking a solid image, can be reduced.

The ratio of the aminosilane coupling agent to the resin is 5 to 40 wt %, and preferably 10 to 30 wt %. When the ratio is less than 5 wt %, no effect of the aminosilane coupling agent is observed. When the ratio is more than 40 wt %, the degree of cross-linking of the resin coating is excessively high, and a charge-up phenomenon is likely to occur. This may lead to image defects such as underdevelopment.

The resin coating also may include conductive fine powder to stabilize the electrification and to prevent charge-up. Examples of the conductive fine powder include carbon black such as oil furnace black or acetylene black, a semiconductive oxide such as titanium oxide or zinc oxide, and powder of titanium oxide, zinc oxide, barium sulfate, aluminum borate, or potassium titanate coated with tin oxide, carbon black, or metal. The specific resistance is preferably not more than $10^{10}\Omega\cdot$cm. The content of the conductive fine powder is preferably 1 to 15 wt %. When the conductive fine powder is included to some extent in the resin coating, the hardness of the resin coating can be improved by a filler effect. However, when the content is more than 15 wt %, the conductive fine powder may interfere with the formation of the resin coating, resulting in lower adherence and hardness. An excessive amount of conductive fine powder in a full color developer may cause the color contamination of the toner that is transferred and fixed on paper.

A method for forming a coating on the composite magnetic particles is not particularly limited, and any known coating methods can be used, such as a dipping method of dipping the composite magnetic particles in a solution for forming a coating layer, a spraying method of spraying a solution for forming a coating layer on the surfaces of the composite magnetic particles, a fluidized bed method of spraying a solution for forming a coating layer to the composite magnetic particles that are floated by fluidizing air, and a kneader and coater method of mixing the composite magnetic particles and a solution for forming a coating layer in a kneader and coater, and removing a solvent. In addition to these wet coating methods, a dry coating method also can be used. The dry coating method includes, e.g., mixing resin powder and the composite magnetic particles at high speed, and fusing the resin powder on the surfaces of the composite magnetic particles by utilizing the frictional heat. In particular, the wet coating method is preferred for coating of the fluorine modified silicone resin containing an aminosilane coupling agent of the present invention.

A solvent of the solution for forming a coating layer is not particularly limited as long as it dissolves the coating resin, and can be selected in accordance with the coating resin to be used. Examples of the solvent include aromatic hydrocarbons such as toluene and xylene, ketones such as acetone and methyl ethyl ketone, and ethers such as tetrahydrofuran and dioxane.

The amount of coating resin is preferably 0.2 to 6.0 wt %, more preferably 0.5 to 5.0 wt %, further preferably 0.6 to 4.0 wt %, and most preferably 0.7 to 3 wt % with respect to the composite magnetic particles. When the amount of coating resin is less than 0.2 wt %, a uniform coating cannot be formed on the composite magnetic particles. Therefore, the carrier is affected significantly by the characteristics of the composite magnetic particles and cannot provide a sufficient effect of the fluorine modified silicone resin containing an aminosilane coupling agent. When the amount of coating resin is more than 6.0 wt %, the coating is too thick, and granulation between the composite magnetic particles occurs. Therefore, the composite magnetic particles are not likely to be uniform.

It is preferable that a baking treatment is performed after coating the composite magnetic particles with the fluorine modified silicone resin containing an aminosilane coupling agent. A means for the baking treatment is not particularly limited, and either of external and internal heating systems may be used. For example, a fixed or fluidized electric furnace, a rotary kiln electric furnace, or a burner furnace can be used as well. Alternatively, baking may be performed with a microwave. The baking temperature should be high enough to provide the effect of fluorine modified silicone that can improve the spent resistance of the resin coating, e.g., preferably 200° C. to 350° C., and more preferably 220° C. to 280° C. The treatment time is preferably 1.5 to 2.5 hours. A lower temperature may degrade the hardness of the resin coating itself, while an excessively high temperature may cause a charge reduction.

(8) Tandem Color Process

This embodiment employs the following transfer process for high-speed color image formation. A plurality of toner image forming stations, each of which includes a photoconductive member, a charging member, and a toner support member, are used. In a primary transfer process, an electrostatic latent image formed on the photoconductive member is made visible by development, and a toner image thus developed is transferred to an endless transfer member that is in contact with the photoconductive member. The primary transfer process is performed continuously in sequence so that a multilayer toner image is formed on the transfer member. Then, a secondary transfer process is performed by collectively transferring the multilayer toner image from the transfer member to a transfer medium such as paper or OHP sheet. The transfer process satisfies the relationship expressed by $$d1/v \leqq 0.65$$

where d1 (mm) is a distance between the first primary transfer position and the second primary transfer position, and v (mm/s) is a circumferential velocity of the photoconductive member. This configuration can reduce the machine size and improve the printing speed. To process at least 20 sheets (A4) per minute and to make the size small enough to be used for SOHO (small office/home office) purposes, a distance between the toner image forming stations should be as short as possible, while the processing speed should be enhanced. Thus, $d1/v \leqq 0.65$ is considered as the minimum requirement to achieve both small size and high printing speed.

However, when the distance between the toner image forming stations is too short, e.g., when a period of time from the primary transfer of the first color (yellow toner) to that of the second color (magenta toner) is extremely short, the charge of the transfer member or the charge of the transferred toner hardly is relieved. Therefore, when the magenta toner is transferred onto the yellow toner, it is repelled by the charging action of the yellow toner. This may lead to lower transfer efficiency and transfer voids. When the third color (cyan) toner is transferred onto the yellow and the magenta toner, the cyan toner may be scattered to cause a transfer failure or considerable transfer voids. Moreover, toner having a specified particle size is developed selectively with repeated use, and the individual toner particles differ significantly in flowability, so that frictional charge opportunities are different. Thus, the charge amount is varied and further reduces the transfer property.

In such a case, therefore, the toner or two-component developer of this embodiment can be used to stabilize the charge distribution and suppress the overcharge and flowability variations. Accordingly, it is possible to prevent lower transfer efficiency, transfer voids, and reverse transfer without sacrificing the fixing property.

(9) Oilless Color Fixing

The toner of this embodiment can be used preferably in an electrographic apparatus having a fixing process with an oilless fixing configuration that applies no oil to any fixing means. As a heating means, electromagnetic induction heating is suitable in view of reducing a warm-up time and power consumption. The oilless fixing configuration includes a magnetic field generation means and a heating and pressing means. The heating and pressing means includes a rotational heating member and a rotational pressing member. The rotational heating member includes at least a heat generation layer for generating heat by electromagnetic induction and a release layer. There is a certain nip between the rotational heating member and the rotational pressing member. The toner that has been transferred to a transfer medium such as copy paper is fixed by passing the transfer medium between the rotational heating member and the rotational pressing member. This configuration is characterized by the warm-up time of the rotational heating member that has a quick rising property as compared with a conventional configuration using a halogen lamp. Therefore, the copying operation starts before the temperature of the rotational pressing member is raised sufficiently. Thus, the toner is required to have the low-temperature fixability and a wide range of the offset resistance.

Another configuration in which a heating member is separated from a fixing member and a fixing belt runs between the two members also may be used preferably. The fixing belt may be, e.g., a nickel electroformed belt having heat resistance and deformability or a heat-resistant polyimide belt. Silicone rubber, fluorocarbon rubber, or fluorocarbon resin may be used as a surface coating to improve the releasability.

In the conventional fixing process, release oil has been applied to prevent offset. The toner that exhibits releasability without using oil can eliminate the need for application of the release oil. However, if the release oil is not applied to the fixing means, it can be charged easily. Therefore, when an unfixed toner image is close to the heating member or the fixing member, the toner may be scattered due to the influence of charge. Such scattering is likely to occur particularly at low temperature and low humidity.

In contrast, the toner of this embodiment can achieve the low-temperature fixability and a wide range of the offset resistance without using oil. The toner also can provide high color transmittance. Thus, the use of the toner of this embodiment can suppress overcharge as well as scattering caused by the charging action of the heating member or the fixing member.

EXAMPLES

Carrier Core Producing Example

In a 1 liter flask were placed 52 g of phenol, 75 g of formalin (37 wt %), 400 g of spherical magnetite particles with an average particle size of 0.24 μm, 15 g of ammonia water (28 wt %), 1.0 g of calcium fluoride, and 50 g of water, and then the temperature was raised to 85° C. for 60 minutes while stirring the mixture. Subsequently, the mixture was reacted and hardened for 120 minutes at the same temperature, thus producing composite magnetic particles of the phenol resin and the spherical magnetite particles.

After the content of the flask was cooled to 30° C., 0.5 liter of water was added, and the supernatant liquor was removed. The precipitate on the bottom of the flask was washed with water and air-dried. This was further dried at 50° C. to 60° C. under a reduced pressure (5 mmHg or less), so that the composite magnetic particles (carrier core A) was obtained.

In a 1 liter flask were placed 50 g of phenol, 65 g of formalin (37 wt %), 450 g of spherical magnetite particles with an average particle size of 0.24 μm, 15 g of ammonia water (28 wt %), 1.0 g of calcium fluoride, and 50 g of water, and then the temperature was raised to 85° C. for 60 minutes while stirring the mixture. Subsequently, the mixture was reacted and hardened for 120 minutes at the same temperature, thus producing composite magnetic particles of the phenol resin and the spherical magnetite particles.

After the content of the flask was cooled to 30° C., 0.5 liter of water was added, and the supernatant liquor was removed. The precipitate on the bottom of the flask was washed with water and air-dried. This was further dried at 50° C. to 60° C. under a reduced pressure (5 mmHg or less), so that the composite magnetic particles (carrier core B) was obtained.

In a 1 liter flask were placed 47.5 g of phenol, 62 g of formalin (37 wt %), 480 g of spherical magnetite particles with an average particle size of 0.24 μm, 15 g of ammonia water (28 wt %), 1.0 g of calcium fluoride, and 50 g of water, and then the temperature was raised to 85° C. for 60 minutes while stirring the mixture. Subsequently, the mixture was reacted and hardened for 120 minutes at the same temperature, thus producing composite magnetic particles of the phenol resin and the spherical magnetite particles.

After the content of the flask was cooled to 30° C., 0.5 liter of water was added, and the supernatant liquor was removed. The precipitate on the bottom of the flask was washed with water and air-dried. This was further dried at 50° C. to 60° C. under a reduced pressure (5 mmHg or less), so that the composite magnetic particles (carrier core C) was obtained.

A core material d of ferrite particles having an average particle size of 80 μm and a saturation magnetization of 65 $Am^2/kg$ in an applied magnetic field of 238.74 kA/m (3000 oersted) was used as a comparative example.

Carrier Producing Example 1

Next, 250 g of polyorganosiloxane expressed by the following Chemical Formula (5) in which $R^1$ and $R^2$ are methyl groups, i.e., $(CH_3)_2SiO_{2/2}$ unit is 15.4 mol % and the following Chemical Formula (6) in which $R^3$ is a methyl group, i.e., $C_{1-3}SiO_{3/2}$ unit is 84.6 mol % was allowed to react with 21 g of $CF_3CH_2CH_2Si(OCH_3)_3$ to produce a fluorine modified silicone resin. Then, 100 g of the fluorine modified silicone resin (as represented in terms of solid content) and 10 g of aminosilane coupling agent (γ-aminopropyltriethoxysilane) were weighed and dissolved in 300 cc of toluene solvent.

Chemical Formula (5):

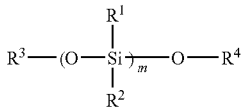

(where $R^1$, $R^2$, $R^3$, and $R^4$ are a methyl group, and m is a mean degree of polymerization of 100)

Chemical Formula (6):

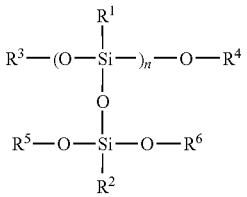

(where $R^1$, $R^2$, $R^5$, $R^4$, $R^5$, and $R^6$ are a methyl group, and n is a mean degree of polymerization of 80)

Using a dip and dry coater, 10 kg of the carrier core A was coated by stirring the resin coating solution for 20 minutes, and then was baked at 260° C. for 1 hour, providing a carrier A1.

The carrier A1 was spherical particles including 80.4 mass % spherical magnetite particles and had an average particle size of 30 μm, a specific gravity of 3.05, a magnetization value of 61 $Am^2/kg$, a volume resistivity of $3\times10^9\Omega\cdot cm$, and a specific surface area of 0.098 $m^2/g$.

Carrier Producing Example 2

A carrier B1 was produced in the same manner as the Carrier Producing Example 1 except that the carrier core B was used, and $CF_3CH_2CH_2Si(OCH_3)_3$ was changed to $C_8F_{17}CH_2CH_2Si(OCH_3)_3$.

The carrier B1 was spherical particles including 88.4 mass % spherical magnetite particles and had an average particle size of 45 μm, a specific gravity of 3.56, a magnetization value of 65 $Am^2/kg$, a volume resistivity of $8\times10^{10}\Omega\cdot cm$, and a specific surface area of 0.057 $m^2/g$.

Carrier Producing Example 3

A carrier C1 was produced in the same manner as the Carrier Producing Example 1 except that the carrier core C was used, and a conductive carbon (manufactured by Ketjenblack International Corporation EC) was dispersed in an amount of 5 wt % per the resin solid content by using a ball mill.

The carrier C1 was spherical particles including 92.5 mass % spherical magnetite particles and had an average particle size of 48 μm, a specific gravity of 3.98, a magnetization value of 69 $Am^2/kg$, a volume resistivity of $2\times10^7\Omega\cdot cm$, and a specific surface area of 0.043 $m^2/g$.

Carrier Producing Example 4

A carrier A2 was produced in the same manner as the Carrier Producing Example 1 except that the amount of aminosilane coupling agent to be added was changed to 30 g.

The carrier A2 was spherical particles including 80.4 mass % spherical magnetite particles and had an average particle size of 30 μm, a specific gravity of 3.05, a magnetization value of 61 $Am^2/kg$, a volume resistivity of $2\times10^{10}\Omega\cdot cm$, and a specific surface area of 0.01 $m^2/g$.

Carrier Producing Example 5

A core material was produced in the same manner as the Carrier Producing Example 1 except that the amount of aminosilane coupling agent to be added was changed to 50 g, and a coating was applied, thus providing a carrier a1.

Carrier Producing Example 6

As a coating resin, 100 g of straight silicone (SR-2411 manufactured by Dow Corning Toray Silicone Co., Ltd.) was weighed in terms of solid content and dissolved in 300 cc of toluene solvent. Using a dip and dry coater, 10 kg of the ferrite particles d were coated by stirring the resin coating solution for 20 minutes, and then were baked at 210° C. for 1 hour, providing a carrier d2. The carrier d2 had an average particle size of 80 μm, a specific gravity of 6, a magnetization value of 75 $Am^2/kg$, a volume resistivity of $2\times10^{12}$ Ωcm, and a specific surface area of 0.024 $m^2/g$.

Carrier Producing Example 7

As a coating resin, 100 g of acrylic modified silicone resin (KR-9706 manufactured by Shin-Etsu Chemical Co., Ltd.) was weighed in terms of solid content and dissolved in 300 cc of toluene solvent. Using a dip and dry coater, 10 kg of the ferrite particles d were coated by stirring the resin coating solution for 20 minutes, and then were baked at 210° C. for 1 hour, providing a carrier d3. The carrier d3 had an average particle size of 80 μm, a specific gravity of 6, a magnetization value of 75 $Am^2/kg$, a volume resistivity of $2\times10^{11}$ Ωcm, and a specific surface area of 0.022 $m^2/g$.

Example 1

Next, examples of the toner of the present invention will be described, but the present invention is not limited by any of the following examples.

Resin Dispersion Production

Table 1 shows the characteristics of the resins used. In Table 1, Mn is a number-average molecular weight, Mw is a weight-average molecular weight, Mz is a Z-average molecular weight, Mp is a peak value of the molecular weight, Tm (° C.) is a softening point, and Tg (° C.) is a glass transition point. Styrene, n-butylacrylate, and acrylic acid are indicated with the mixing amount (g). Table 2 shows the amount of nonion (g) and the amount of anion (g) of the surface-active agents used for each of the resin dispersions, and the ratio of the amount of nonion to the total amount of the surface-active agents.

TABLE 1

| | Mn ($\times10^4$) | Mw ($\times10^4$) | Mz ($\times10^4$) | Wm = Mw/Mn | Wz = Mz/Mn | Mp ($\times10^4$) | Tg ° C. | Tm ° C. |
|---|---|---|---|---|---|---|---|---|
| RL1 | 0.37 | 1.12 | 3.88 | 3.03 | 10.49 | 0.81 | 42 | 110 |
| RL2 | 0.62 | 6.24 | 26.9 | 10.06 | 43.39 | 0.81 | 56 | 127 |
| RL3 | 0.28 | 1.88 | 9.54 | 6.71 | 34.07 | 0.37 | 47 | 105 |
| RH4 | 4.45 | 27.3 | 58.1 | 6.13 | 13.06 | 18.2 | 78 | 199 |
| RH5 | 4.09 | 25.2 | 57.8 | 6.16 | 14.13 | 15.4 | 76 | 194 |

TABLE 2

| | Amount of nonion (g) | Amount of anion (g) | Ratio of nonion |
|---|---|---|---|
| RL1 | 2.5 | 1 | 71.4% |
| RL2 | 5 | 1 | 83.3% |
| RL3 | 5.5 | 0.5 | 91.7% |
| RH4 | 2.5 | 0.5 | 83.3% |
| RH5 | 2.5 | 0.5 | 83.3% |

(1) Preparation of Resin Particle Dispersion RL1

A monomer solution including 96 g of styrene, 24 g of n-butylacrylate, and 3.6 g of acrylic acid was dispersed in 180 g of ion-exchanged water with 2.5 g of nonionic surface-active agent (NONIPOL 400 manufactured by Sanyo Chemical Industries, Ltd.), 1 g of anionic surface-active agent (NEOGEN RK manufactured by Dai-Ichi Kogyo Seiyaku Co., Ltd.), 6 g of dodecanethiol, and 1.2 g of carbon tetrabromide. Then, 1.2 g of potassium persulfate was added to the resultant solution, and emulsion polymerization was performed at 70° C. for 6 hours, followed by an aging treatment at 90° C. for 3 hours. Thus, a resin particle dispersion RL1 was prepared, in which the resin particles having Mn of 3700, Mw of 11200, Mz of 38800, Mp of 8100, Tm of 110° C., Tg of 42° C., and a median diameter of 0.12 μm were dispersed.

(2) Preparation of Resin Particle Dispersion RL2

A monomer solution including 204 g of styrene, 36 g of n-butylacrylate, and 3.6 g of acrylic acid was dispersed in 360 g of ion-exchanged water with 5 g of nonionic surface-active agent (ELEMINOL NA 400 manufactured by Sanyo Chemical Industries, Ltd.), 1 g of anionic surface-active agent (NEOGEN RK manufactured by Dai-Ichi Kogyo Seiyaku Co., Ltd.), 6 g of dodecanethiol, and 1.2 g of carbon tetrabromide. Then, 2.4 g of potassium persulfate was added to the resultant solution, and emulsion polymerization was performed at 70° C. for 5 hours, followed by an aging treatment at 90° C. for 5 hours. Thus, a resin particle dispersion RL2 was prepared, in which the resin particles having Mn of 6200, Mw of 62400, Mz of 269000, Mp of 8100, Tm of 127° C., Tg of 56° C., and a median diameter of 0.18 μm were dispersed.

(3) Preparation of Resin Particle Dispersion RL3

A monomer solution including 204 g of styrene, 36 g of n-butylacrylate, and 3.6 g of acrylic acid was dispersed in 360 g of ion-exchanged water with 5.5 g of nonionic surface-active agent (ELEMINOL NA 400 manufactured by Sanyo Chemical Industries, Ltd.), 0.5 g of anionic surface-active agent (NEOGEN RK manufactured by Dai-Ichi Kogyo Seiyaku Co., Ltd.), 12 g of dodecanethiol, and 2.4 g of carbon tetrabromide. Then, 2.4 g of potassium persulfate was added to the resultant solution, and emulsion polymerization was performed at 70° C. for 5 hours, followed by an aging treatment at 90° C. for 2 hours. Thus, a resin particle dispersion RL3 was prepared, in which the resin particles having Mn of 2800, Mw of 18800, Mz of 95400, Mp of 3700, Tm of 105° C., Tg of 47° C., and a median diameter of 0.18 μm were dispersed.

(4) Preparation of Resin Particle Dispersion RH4

A monomer solution including 102 g of styrene, 18 g of n-butylacrylate, and 1.8 g of acrylic acid was dispersed in 180 g of ion-exchanged water with 2.5 g of nonionic surface-active agent (NONIPOL 400 manufactured by Sanyo Chemical Industries, Ltd.), 0.5 g of anionic surface-active agent (NEOGEN RK manufactured by Dai-Ichi Kogyo Seiyaku Co., Ltd.), while neither dodecanethiol nor carbon tetrabromide was used. Then, 1.2 g of potassium persulfate was added to the resultant solution, and emulsion polymerization was performed at 75° C. for 5 hours, followed by an aging treatment at 90° C. for 2 hours. Thus, a resin particle dispersion RH4 was prepared, in which the resin particles having Mn of 44500, Mw of 273000, Mz of 581000, Mp of 182000, Tm of 199° C., Tg of 78° C., and a median diameter of 0.12 μm were dispersed.

(5) Preparation of Resin Particle Dispersion RH5

A monomer solution including 102 g of styrene, 18 g of n-butylacrylate, and 1.8 g of acrylic acid was dispersed in 180 g of ion-exchanged water with 2.5 g of nonionic surface-active agent (ELEMINOL NA 400 manufactured by Sanyo Chemical Industries, Ltd.), 0.5 g of anionic surface-active agent (NEOGEN RK manufactured by Dai-Ichi Kogyo Seiyaku Co., Ltd.), while neither dodecanethiol nor carbon tetrabromide was used. Then, 1.2 g of potassium persulfate was added to the resultant solution, and emulsion polymerization was performed at 70° C. for 5 hours, followed by an aging treatment at 90° C. for 2 hours. Thus, a resin particle dispersion RH5 was prepared, in which the resin particles having Mn of 40900, Mw of 252000, Mz of 578000, Mp of 154000, Tm of 194° C., Tg of 76° C., and a median diameter of 0.22 μm were dispersed.

Example 2

Pigment Dispersion Production

Table 3 shows the pigments used. Table 4 shows the amount of nonion (g) and the amount of anion (g) of the surface-active agents used for each of the pigment dispersions, and the ratio of the amount of nonion to the total amount of the surface-active agents.

TABLE 3

| | |
|---|---|
| PM1 | PERMANENT RUBINE F6B (Clariant) |
| PC1 | KETBLUE111 (Dainippon Ink and Chemicals, Inc.) |
| PY1 | PY74 (Sanyo Color Works, Ltd.) |
| PB1 | MA100S (Mitsubishi Chemical Corporation) |

TABLE 4

| | Ma pigment (g) | Amount of nonion (g) | Amount of anion (g) | Ratio of nonion |
|---|---|---|---|---|
| PM1 | 20 | 2 | 0 | 100.0% |
| PM2 | 20 | 1.5 | 1.2 | 55.6% |
| pm3 | 20 | 1.2 | 1.4 | 46.2% |
| pm4 | 20 | 0 | 2 | 0.0% |

s (1) Preparation of Colorant Particle Dispersion PM1

20 g of magenta pigment (PERMANENT RUBINE F6B manufactured by Clariant), 2 g of nonionic surface-active agent (ELEMINOL NA 400 manufactured by Sanyo Chemical Industries, Ltd.), and 78 g of ion-exchanged water were mixed and dispersed by using an ultrasonic dispersing device at an oscillation frequency of 30 kHz for 20 minutes. Thus, a colorant particle dispersion PM1 was prepared, in which the colorant particles having a median diameter of 0.12 μm were dispersed.

(2) Preparation of Colorant Particle Dispersion PC1

20 g of cyan pigment (KETBLUE111 manufactured by Dainippon Ink and Chemicals, Inc.), 2 g of nonionic surface-active agent (ELEMINOL NA 400 manufactured by Sanyo Chemical Industries, Ltd.), and 78 g of ion-exchanged water were mixed and dispersed by using an ultrasonic dispersing device at an oscillation frequency of 30 kHz for 20 minutes. Thus, a colorant particle dispersion PC1 was prepared, in which the colorant particles having a median diameter of 0.12 μm were dispersed.

(3) Preparation of Colorant Particle Dispersion PY1

20 g of yellow pigment (PY74 manufactured by Sanyo Color Works, Ltd.), 2 g of nonionic surface-active agent (ELEMINOL NA 400 manufactured by Sanyo Chemical Industries, Ltd.), and 78 g of ion-exchanged water were mixed and dispersed by using an ultrasonic dispersing device at an oscillation frequency of 30 kHz for 20 minutes. Thus, a colorant particle dispersion PY1 was prepared, in which the colorant particles having a median diameter of 0.12 μm were dispersed.

(4) Preparation of Colorant Particle Dispersion PB1

20 g of black pigment (MA100S manufactured by Mitsubishi Chemical Corporation), 2 g of nonionic surface-active agent (ELEMINOL NA 400 manufactured by Sanyo Chemical Industries, Ltd.), and 78 g of ion-exchanged water were mixed and dispersed by using an ultrasonic dispersing device at an oscillation frequency of 30 kHz for 20 minutes. Thus, a colorant particle dispersion PB1 was prepared, in which the colorant particles having a median diameter of 0.12 μm were dispersed.

(5) Preparation of Colorant Particle Dispersion PM2

20 g of magenta pigment (PERMANENT RUBINE F6B manufactured by Clariant), 1.5 g of nonionic surface-active agent (NONIPOL 400 manufactured by Sanyo Chemical Industries, Ltd.), 6 g of anionic surface-active agent (S20-F, 20 wt % concentration aqueous solution, manufactured by Sanyo Chemical Industries, Ltd.), and 78 g of ion-exchanged water were mixed and dispersed by using an ultrasonic dispersing device at an oscillation frequency of 30 kHz for 20 minutes. Thus, a colorant particle dispersion PM2 was prepared, in which the colorant particles having a median diameter of 0.12 μm were dispersed.

(6) Preparation of Colorant Particle Dispersion PM3

20 g of magenta pigment (PERMANENT RUBINE F6B manufactured by Clariant), 1.2 g of nonionic surface-active agent (NONIPOL 400 manufactured by Sanyo Chemical Industries, Ltd.), 7 g of anionic surface-active agent (S20-F, 20 wt % concentration aqueous solution, manufactured by Sanyo Chemical Industries, Ltd.), and 78 g of ion-exchanged water were mixed and dispersed by using an ultrasonic dispersing device at an oscillation frequency of 30 kHz for 20 minutes. Thus, a colorant particle dispersion pm3 was prepared, in which the colorant particles having a median diameter of 0.12 μm were dispersed.

(7) Preparation of Colorant Particle Dispersion pm4

20 g of magenta pigment (PERMANENT RUBINE F6B manufactured by Clariant), 10 g of anionic surface-active agent (S20-F, 20 wt % concentration aqueous solution, manufactured by Sanyo Chemical Industries, Ltd.), and 78 g of ion-exchanged water were mixed and dispersed by using an ultrasonic dispersing device at an oscillation frequency of 30 kHz for 20 minutes. Thus, a colorant particle dispersion pm4 was prepared, in which the colorant particles having a median diameter of 0.12 μm were dispersed.

Example 3

Wax Dispersion Production

Tables 5, 6, 7, 8, 9, 10, 11, and 12 show the characteristics of the waxes used.

Tables 5 and 6 show the characteristics of first waxes. Table 7 shows the characteristics of second waxes. Tmw1 (° C.) represents a melting point, and Ck (wt %) represents a heating loss.

Table 8 shows the molecular weight characteristics of the waxes. Mnr represents a number-average molecular weight, Mwr represents a weight-average molecular weight, Mzr represents a Z-average molecular weight, and Mpr represents a molecular weight peak.

Tables 9 and 10 show the cumulative volume particle size distribution obtained by accumulation from the smaller particle diameter side of each wax dispersion, in which PR16 represents 16% diameter, PR50 represents 50% diameter, and PR84 represents 84% diameter. Tables 11 and 12 show the amount of nonion (g) and the amount of anion (g) of the surface-active agents used for each of the wax dispersions, and the ratio of the amount of nonion to the total amount of the surface-active agents.

TABLE 5

| Wax | Material | Melting point Tmw1 (° C.) | Heating loss Ck (wt %) | Iodine value[1)] | Saponification value[2)] |
|---|---|---|---|---|---|
| W-1 | Maximum hydrogenated *jojoba* oil | 68 | 2.8 | 2 | 95.7 |
| W-2 | Candelilla wax | 72 | 2.4 | 15 | 62 |
| W-3 | Maximum hydrogenated meadowfoam oil | 71 | 2.5 | 2 | 90 |
| W-4 | Carnauba wax | 84 | 1.5 | 8 | 88 |
| W-5 | Jojoba oil fatty acid pentaerythritol monoester | 84 | 3.4 | 2 | 120 |

(Note 1)
The unit of the iodine value is g/100 g. The iodine value is determined in such a manner that when halogen acts on a sample, the amount of halogen absorbed by the sample is converted to iodine and expressed in grams per 100 g of the sample.
(Note 2)
The unit of the saponification value is mgKOH/g. The saponification value is the milligrams of potassium hydroxide required to saponify a 1 g sample.

TABLE 6

| Wax | Material | Melting point Tmw1 (° C.) | Heating loss Ck (wt %) |
|---|---|---|---|
| W-6 | Stearyl stearate | 58 | 2 |
| W-7 | Triglyceride stearate | 63 | 1.5 |
| W-8 | Pentaerythritol tetrastearate | 70 | 0.9 |
| W-9 | Behenyl behenate | 74 | 1.2 |
| W-10 | Glycerol triester (hydrogenated castor oil) | 85 | 1.9 |

TABLE 7

| | | Melting point Tmw2 (° C.) | Acid value | Penetration number |
|---|---|---|---|---|
| W-11 | Saturated hydrocarbon wax (FNP0090 manufactured by Nippon Seiro Co., Ltd.) | 90.2 | | 1 |
| W-12 | Polypropylene/maleic anhydride/alcohol-type wax with a carbon number of 30 or less/tert-butylperoxy isopropyl monocarbonate: 100/20/8/4 parts by weight | 98 | 45 | 1 |
| W-13 | Thermally degradable low-density polyethylene wax (NL200 manufactured by Mitsui Chemicals, Inc.) | 104 | | 1 |

TABLE 8

| | Mnr | Mwr | Mzr | Mwr/Mnr | Mzr/Mnr | Mpr |
|---|---|---|---|---|---|---|
| W-1 | 1009 | 1072 | 1118 | 1.06 | 1.11 | $1.02 \times 10^3$ |
| W-3 | 1015 | 1078 | 1124 | 1.06 | 1.11 | $1.03 \times 10^3$ |
| W-8 | 1100 | 1980 | 3050 | 1.80 | 2.77 | $3.5 \times 10^3$ |
| W-10 | 1050 | 1120 | 1290 | 1.07 | 1.23 | $3.1 \times 10^3$ |
| W-12 | 1240 | 2100 | 2760 | 1.69 | 2.23 | $1.4 \times 10^3$ |

TABLE 9

| Dispersion | First wax | Second wax | PR16 (nm) | PR50 (nm) | PR84 (nm) | PR84/PR16 |
|---|---|---|---|---|---|---|
| WA1 | W-1 (1) | W-11 (5) | 94 | 128 | 162 | 1.72 |
| WA2 | W-2 (1) | W-12 (2) | 105 | 155 | 205 | 1.95 |
| WA3 | W-3 (1) | W-13 (1) | 186 | 267 | 348 | 1.87 |
| WA4 | W-4 (1) | W-11 (2) | 88 | 106 | 124 | 1.41 |
| WA5 | W-5 (1) | W-12 (4) | 194 | 273 | 352 | 1.81 |
| WA6 | W-1 (1) | W-13 (5) | 188 | 279 | 370 | 1.97 |
| WA7 | W-2 (1) | W-11 (9) | 184 | 276 | 368 | 2.00 |
| WA8 | W-3 (1) | W-12 (7) | 128 | 176 | 224 | 1.75 |
| WA9 | W-4 (1) | W-13 (1) | 182 | 272 | 362 | 1.99 |
| WA10 | W-5 (1) | W-11 (5) | 124 | 176 | 228 | 1.84 |
| WA11 | W-6 (1) | W-11 (5) | 112 | 168 | 224 | 2.00 |
| WA12 | W-7 (1) | W-12 (3) | 125 | 187 | 249 | 1.99 |
| WA13 | W-8 (1) | W-13 (1.2) | 186 | 267 | 348 | 1.87 |
| WA14 | W-9 (1) | W-11 (1) | 112 | 158 | 204 | 1.82 |
| WA15 | W-10 (1) | W-12 (1.5) | 184 | 266 | 348 | 1.89 |
| WA16 | W-6 (1) | W-13 (1) | 186 | 277 | 368 | 1.98 |
| WA17 | W-7 (1) | W-11 (4) | 204 | 297 | 390 | 1.91 |
| WA18 | W-8 (1) | W-12 (8) | 182 | 273 | 364 | 2.00 |
| WA19 | W-9 (1) | W-13 (1) | 204 | 296 | 388 | 1.90 |

TABLE 10

| Dispersion | First wax | Second wax | PR16 (nm) | PR50 (nm) | PR84 (nm) | PR84/PR16 |
|---|---|---|---|---|---|---|
| wa21 | W-4 (1.5) | W-11 (1) | 189 | 289 | 389 | 2.06 |
| wa22 | W-6 (1) | W-11 (5) | 132 | 199.5 | 267 | 2.02 |
| wa23 | W-6 (1) | W-11 (5) | 119 | 208.5 | 298 | 2.50 |
| wa24 | W-1 (1) | | 112 | 155 | 198 | 1.77 |
| wa25 | W-2 (1) | | 109 | 155 | 201 | 1.84 |
| wa26 | W-6 (1) | | 168 | 236 | 304 | 1.81 |
| wa27 | W-7 (1) | | 148 | 213 | 278 | 1.88 |
| wa28 | W-11 (1) | | 188 | 278 | 368 | 1.96 |
| wa29 | W-12 (1) | | 148 | 219 | 290 | 1.96 |
| wa30 | W-13 (1) | | 168 | 240 | 312 | 1.86 |
| wa31 | W-11 (1) | | 268 | 418 | 568 | 2.12 |
| wa32 | W-12 (1) | | 284 | 503 | 722 | 2.54 |
| wa33 | W-13 (1) | | 246 | 515 | 784 | 3.19 |
| wa34 | W-1 (1) | | 162 | 284 | 406 | 2.51 |
| wa35 | W-2 (1) | | 146 | 314 | 482 | 3.30 |
| wa36 | W-6 (1) | | 168 | 276 | 384 | 2.29 |
| wa37 | W-7 (1) | | 148 | 245 | 342 | 2.31 |

TABLE 11

| Dispersion | Amount of nonion (g) | Amount of anion (g) | Ratio of nonion | Amount of first wax (g) | Amount of second wax (g) |
|---|---|---|---|---|---|
| WA1 | 2 | 1 | 67% | 5 | 25 |
| WA2 | 3 | 0 | 100% | 10 | 20 |
| WA3 | 2.5 | 0.5 | 83% | 15 | 15 |
| WA4 | 3 | 0 | 100% | 10 | 20 |
| WA5 | 3 | 0 | 100% | 6 | 24 |
| WA6 | 3 | 0 | 100% | 5 | 25 |
| WA7 | 3 | 0 | 100% | 3 | 27 |
| WA8 | 3 | 0 | 100% | 3.75 | 26.25 |
| WA9 | 3 | 0 | 100% | 15 | 15 |
| WA10 | 3 | 0 | 100% | 5 | 25 |

TABLE 11-continued

| Dispersion | Amount of nonion (g) | Amount of anion (g) | Ratio of nonion | Amount of first wax (g) | Amount of second wax (g) |
|---|---|---|---|---|---|
| WA11 | 2 | 1 | 67% | 5 | 25 |
| WA12 | 3.2 | 0 | 100% | 8 | 24 |
| WA13 | 2.8 | 0.5 | 85% | 15 | 18 |
| WA14 | 3 | 0 | 100% | 15 | 15 |

TABLE 11-continued

| Dispersion | Amount of nonion (g) | Amount of anion (g) | Ratio of nonion | Amount of first wax (g) | Amount of second wax (g) |
|---|---|---|---|---|---|
| WA15 | 3 | 0 | 100% | 12 | 18 |
| WA16 | 3 | 0 | 100% | 15 | 15 |
| WA17 | 3 | 0 | 100% | 6 | 24 |
| WA18 | 3.1 | 0 | 100% | 3.5 | 28 |
| WA19 | 3 | 0 | 100% | 15 | 15 |

TABLE 12

| Dispersion | Amount of nonion (g) | Amount of anion (g) | Ratio of nonion | Amount of first wax (g) | Amount of second wax (g) |
|---|---|---|---|---|---|
| wa21 | 3 | 0 | 100% | 18 | 12 |
| wa22 | 1.4 | 1.6 | 47% | 5 | 25 |
| wa23 | 0 | 3 | 0% | 5 | 25 |
| wa24 | 3 | 0 | 100% | 30 | |
| wa25 | 1.8 | 1.2 | 60% | 30 | |
| wa26 | 3 | 0 | 100% | 30 | |
| wa27 | 3 | 0 | 100% | 30 | |
| wa28 | 3 | 0 | 100% | 30 | |
| wa29 | 3 | 0 | 100% | 30 | |
| wa30 | 3 | 0 | 100% | 30 | |
| wa31 | 0 | 3 | 0% | 30 | |
| wa32 | 0 | 3 | 0% | 30 | |
| wa33 | 0 | 3 | 0% | 30 | |
| wa34 | 0 | 3 | 0% | 30 | |
| wa35 | 0 | 3 | 0% | 30 | |
| wa36 | 0 | 3 | 0% | 30 | |
| wa37 | 0 | 3 | 0% | 30 | |

(1) Preparation of Wax Particle Dispersion WA1

FIG. 3 is a schematic view of a stirring/dispersing device, and FIG. 4 is a plan view of the same. As shown in FIG. 3, cooling water is introduced from 808 to the inside of an outer tank 801 and then is discharged from 807. Reference numeral 802 is a shielding board that stops the flow of the liquid to be treated. The shielding board 802 has an opening in the central portion, and the treated liquid is drawn from the opening and taken out of the device through 805. Reference numeral 803 is a rotating body that is secured to a shaft 806 and rotates at high speed. There are holes (about 1 to 5 mm in size) in the side of the rotating body 803, and the liquid to be treated can move through the holes. The liquid to be treated is put into the tank in an amount of about one-half the capacity (120 ml) of the tank. The maximum rotational speed of the rotating body 803 is 50 m/s. The rotating body 803 has a diameter of 52 mm, and the tank 801 has an internal diameter of 56 mm. Reference numeral 804 is a material inlet used for a continuous treatment. In the case of a batch treatment, the material inlet 804 is closed.

The tank was pressurized at 0.4 Mpa, and 100 g of ion-exchanged water, 2 g of nonionic surface-active agent (ELEMINOL NA 400 manufactured by Sanyo Chemical Industries, Ltd.), 1 g of anionic surface-active agent (SCF manufactured by Sanyo Chemical Industries, Ltd.), 5 g of the first wax (W-1), and 25 g of the second wax (W-11) were blended and treated while the rotating body rotated at a rotational speed of 30 m/s for 5 minutes, and then 50 m/s for 2 minutes. Thus, a wax particle dispersion WA1 was provided.

(2) Preparation of Wax Particle Dispersion WA2

Under the same conditions as (1), 100 g of ion-exchanged water, 3 g of nonionic surface-active agent (ELEMINOL NA 400 manufactured by Sanyo Chemical Industries, Ltd.), 10 g of the first wax (W-2), and 20 g of the second wax (W-12) were blended and treated while the rotating body rotated at a rotational speed of 30 m/s for 3 minutes, and then 50 m/s for 2 minutes. Thus, a wax particle dispersion WA2 was provided.

(3) Preparation of Wax Particle Dispersion WA3

Under the same conditions as (1), 100 g of ion-exchanged water, 2.5 g of nonionic surface-active agent (Newcol 565C manufactured by Nippon Nyukazai Co., Ltd.), 0.5 g of anionic surface-active agent (SCF manufactured by Sanyo Chemical Industries, Ltd.), 15 g of the first wax (W-3), and 15 g of the second wax (W-13) were blended and treated while the rotating body rotated at a rotational speed of 20 m/s for 3 minutes, and then 45 m/s for 2 minutes. Thus, a wax particle dispersion WA3 was provided.

(4) Preparation of Wax Particle Dispersion WA4

Under the same conditions as (1), 100 g of ion-exchanged water, 3 g of nonionic surface-active agent (ELEMINOL NA 400 manufactured by Sanyo Chemical Industries, Ltd.), 10 g of the first wax (W-4), and 20 g of the second wax (W-11) were blended and treated while the rotating body rotated at a rotational speed of 30 m/s for 3 minutes, and then 50 m/s for 2 minutes. Thus, a wax particle dispersion WA4 was provided.

(5) Preparation of Wax Particle Dispersion WA5

FIG. 5 is a schematic view of a stirring/dispersing device, and FIG. 6 is a plan view of the same. Reference numeral 850 is an inlet and 852 is a stator with a floating structure. The stator 852 is pressed down by springs 851, but pushed up by a force created when a rotor 853 rotates at high speed. Therefore, a narrow gap of about 1 μm to 10 μm is formed between the stator 852 and the rotor 853. Reference numeral 854 is a shaft connected to a motor (not shown). Materials are fed into the device from the inlet 850, subjected to a strong shearing force in the gap between the stator 852 and the rotor 853, and thus formed into fine particles dispersed in the liquid. The material liquid thus treated is drawn from outlets 856. As shown in FIG. 6, the material liquid 855 is released radially and collected in a closed container. The rotor 853 has an outer diameter of 100 mm.

The material liquid, in which wax and a surface-active agent were predispersed in a pressurized and heated aqueous medium, was introduced from the inlet 850 and treated instantaneously to make a fine particle dispersion. The amount of material liquid supplied was 1 kg/h, and the maximum rotational speed of the rotor 853 was 100 m/s.

100 g of ion-exchanged water, 3 g of nonionic surface-active agent (ELEMINOL NA 400 manufactured by Sanyo Chemical Industries, Ltd.), 6 g of the first wax (W-5), and 24 g of the second wax (W-12) were blended and treated in a supplied amount of 1 kg/h while the rotor rotated at a rotational speed of 100 m/s. Thus, a wax particle dispersion WA5 was provided.

(6) Preparation of Wax Particle Dispersion WA6

Under the same conditions as (1), 100 g of ion-exchanged water, 3 g of nonionic surface-active agent (ELEMINOL NA 400 manufactured by Sanyo Chemical Industries, Ltd.), 5 g of the first wax (W-1), and 25 g of the second wax (W-13) were blended and treated while the rotating body rotated at a rotational speed of 20 m/s for 3 minutes, and then 45 m/s for 4 minutes. Thus, a wax particle dispersion WA6 was provided.

(7) Preparation of Wax Particle Dispersion WA7

Under the same conditions as (1), 100 g of ion-exchanged water, 3 g of nonionic surface-active agent (ELEMINOL NA 400 manufactured by Sanyo Chemical Industries, Ltd.), 3 g of the first wax (W-2), and 27 g of the second wax (W-11) were blended and treated while the rotating body rotated at a rotational speed of 20 m/s for 3 minutes, and then 50 m/s for 2 minutes. Thus, a wax particle dispersion WA7 was provided.

(8) Preparation of Wax Particle Dispersion WA8

Under the same conditions as (5), 100 g of ion-exchanged water, 3 g of nonionic surface-active agent (ELEMINOL NA 400 manufactured by Sanyo Chemical Industries, Ltd.), 3.75 g of the first wax (W-3), and 26.25 g of the second wax (W-12) were blended and treated in a supplied amount of 1 kg/h while the rotor rotated at a rotational speed of 100 m/s. Thus, a wax particle dispersion WA8 was provided.

(9) Preparation of Wax Particle Dispersion WA9

Under the same conditions as (1), 100 g of ion-exchanged water, 3 g of nonionic surface-active agent (ELEMINOL NA 400 manufactured by Sanyo Chemical Industries, Ltd.), 15 g of the first wax (W-4), and 15 g of the second wax (W-13) were blended and treated while the rotating body rotated at a rotational speed of 20 m/s for 3 minutes, and then 45 m/s for 3 minutes. Thus, a wax particle dispersion WA9 was provided.

(10) Preparation of Wax Particle Dispersion WA10

Under the same conditions as (1), 100 g of ion-exchanged water, 3 g of nonionic surface-active agent (ELEMINOL NA 400 manufactured by Sanyo Chemical Industries, Ltd.), 5 g of the first wax (W-5), and 25 g of the second wax (W-11) were blended and treated while the rotating body rotated at a rotational speed of 30 m/s for 3 minutes, and then 50 m/s for 2 minutes. Thus, a wax particle dispersion WA10 was provided.

(11) Preparation Of Wax Particle Dispersion WA11

FIG. 3 is a schematic view of a stirring/dispersing device, and FIG. 4 is a plan view of the same. As shown in FIG. 3, cooling water is introduced from 808 to the inside of an outer tank 801 and then is discharged from 807. Reference numeral 802 is a shielding board that stops the flow of the liquid to be treated. The shielding board 802 has an opening in the central portion, and the treated liquid is drawn from the opening and taken out of the device through 805. Reference numeral 803 is a rotating body that is secured to a shaft 806 and rotates at high speed. There are holes (about 1 to 5 mm in size) in the side of the rotating body 803, and the liquid to be treated can move through the holes. The liquid to be treated is put into the tank in an amount of about one-half the capacity (120 ml) of the tank. The maximum rotational speed of the rotating body 803 is 50 m/s. The rotating body 803 has a diameter of 52 mm, and the tank 801 has an internal diameter of 56 mm. Reference numeral 804 is a material inlet used for a continuous treatment. In the case of a batch treatment, the material inlet 804 is closed.

The tank was pressurized at 0.4 Mpa, and 100 g of ion-exchanged water, 2 g of nonionic surface-active agent (ELEMINOL NA 400 manufactured by Sanyo Chemical Industries, Ltd.), 1 g of anionic surface-active agent (SCF manufactured by Sanyo Chemical Industries, Ltd.), 5 g of the first wax (W-6), and 25 g of the second wax (W-11) were blended and treated while the rotating body rotated at a rotational speed of 20 m/s for 5 minutes, and then 50 m/s for 2 minutes. Thus, a wax particle dispersion WA11 was provided.

(12) Preparation of Wax Particle Dispersion WA12

Under the same conditions as (1), 100 g of ion-exchanged water, 3.2 g of nonionic surface-active agent (ELEMINOL NA 400 manufactured by Sanyo Chemical Industries, Ltd.), 8 g of the first wax (W-7), and 24 g of the second wax (W-12) were blended and treated while the rotating body rotated at a rotational speed of 20 m/s for 3 minutes, and then 50 m/s for 2 minutes. Thus, a wax particle dispersion WA12 was provided.

(13) Preparation of Wax Particle Dispersion WA13

Under the same conditions as (1), 100 g of ion-exchanged water, 2.8 g of nonionic surface-active agent (Newcol 565C manufactured by Nippon Nyukazai Co., Ltd.), 0.5 g of anionic surface-active agent (SCF manufactured by Sanyo Chemical Industries, Ltd.), 15 g of the first wax (W-8), and 18 g of the second wax (W-13) were blended and treated while the rotating body rotated at a rotational speed of 20 m/s for 3 minutes, and then 45 m/s for 2 minutes. Thus, a wax particle dispersion WA13 was provided.

(14) Preparation of Wax Particle Dispersion WA14

Under the same conditions as (1), 100 g of ion-exchanged water, 3 g of nonionic surface-active agent (ELEMINOL NA 400 manufactured by Sanyo Chemical Industries, Ltd.), 15 g of the first wax (W-9), and 15 g of the second wax (WV-11) were blended and treated while the rotating body rotated at a rotational speed of 20 m/s for 3 minutes, and then 50 m/s for 1 minute. Thus, a wax particle dispersion WA14 was provided.

(15) Preparation of Wax Particle Dispersion WA15

FIG. 5 is a schematic view of a stirring/dispersing device, and FIG. 6 is a plan view of the same. Reference numeral 850 is an inlet and 852 is a stator with a floating structure. The stator 852 is pressed down by springs 851, but pushed up by a force created when a rotor 853 rotates at high speed. Therefore, a narrow gap of about 1 μm to 10 μm is formed between the stator 852 and the rotor 853. Reference numeral 854 is a shaft connected to a motor (not shown). Materials are fed into the device from the inlet 850, subjected to a strong shearing force in the gap between the stator 852 and the rotor 853, and thus formed into fine particles dispersed in the liquid. The material liquid thus treated is drawn from outlets 856. As shown in FIG. 6, the material liquid 855 is released radially and collected in a closed container. The rotor 853 has an outer diameter of 100 mm.

The material liquid, in which wax and a surface-active agent were predispersed in a pressurized and heated aqueous medium, was introduced from the inlet 850 and treated instantaneously to make a fine particle dispersion. The amount of material liquid supplied was 1 kg/h, and the maximum rotational speed of the rotor 853 was 100 m/s.

100 g of ion-exchanged water, 3 g of nonionic surface-active agent (ELEMINOL NA 400 manufactured by Sanyo Chemical Industries, Ltd.), 12 g of the first wax (W-10), and 18 g of the second wax (W-12) were blended and treated in a supplied amount of 1 kg/h while the rotor rotated at a rotational speed of 100 m/s. Thus, a wax particle dispersion WA15 was provided.

(16) Preparation of Wax Particle Dispersion WA16

Under the same conditions as (1), 100 g of ion-exchanged water, 3 g of nonionic surface-active agent (ELEMINOL NA 400 manufactured by Sanyo Chemical Industries, Ltd.), 15 g of the first wax (W-6), and 15 g of the second wax (W-13) were blended and treated while the rotating body rotated at a rotational speed of 20 m/s for 3 minutes, and then 45 m/s for 4 minutes. Thus, a wax particle dispersion WA16 was provided.

(17) Preparation of Wax Particle Dispersion WA17

Under the same conditions as (1), 100 g of ion-exchanged water, 3 g of nonionic surface-active agent (ELEMINOL NA 400 manufactured by Sanyo Chemical Industries, Ltd.), 6 g of the first wax (W-7), and 24 g of the second wax (W-11) were blended and treated while the rotating body rotated at a rotational speed of 20 m/s for 3 minutes, and then 45 m/s for 4 minutes. Thus, a wax particle dispersion WA17 was provided.

(18) Preparation of Wax Particle Dispersion WA18

Under the same conditions as (5), 100 g of ion-exchanged water, 3.1 g of nonionic surface-active agent (ELEMINOL NA 400 manufactured by Sanyo Chemical Industries, Ltd.), 3.5 g of the first wax (W-8), and 28 g of the second wax (W-12) were blended and treated in a supplied amount of 1 kg/h while the rotor rotated at a rotational speed of 100 m/s. Thus, a wax particle dispersion WA18 was provided.

(19) Preparation of Wax Particle Dispersion WA19

Under the same conditions as (1), 100 g of ion-exchanged water, 3 g of nonionic surface-active agent (ELEMINOL NA 400 manufactured by Sanyo Chemical Industries, Ltd.), 15 g of the first wax (W-9), and 15 g of the second wax (W-13) were blended and treated while the rotating body rotated at a rotational speed of 20 m/s for 3 minutes, and then 45 m/s for 4 minutes. Thus, a wax particle dispersion WA19 was provided.

(20) Preparation of Wax Particle Dispersion wa21

Under the same conditions as (4), 100 g of ion-exchanged water, 3 g of nonionic surface-active agent (ELEMINOL NA 400 manufactured by Sanyo Chemical Industries, Ltd.), 18 g of the first wax (W-4), and 12 g of the second wax (W-13) were blended and treated while the rotating body rotated at a rotational speed of 30 m/s for 3 minutes, and then 50 m/s for 2 minutes. Thus, a wax particle dispersion wa21 was provided.

(21) Preparation of Wax Particle Dispersion wa22

Under the same conditions as (6), 100 g of ion-exchanged water, 1.4 g of nonionic surface-active agent (ELEMINOL NA 400 manufactured by Sanyo Chemical Industries, Ltd.), 8 g of anionic surface-active agent (S20-F, 20 wt % concentration aqueous solution, manufactured by Sanyo Chemical Industries, Ltd.), 5 g of the first wax (W-6), and 25 g of the second wax (W-11) were blended and treated while the rotating body rotated at a rotational speed of 20 m/s for 3 minutes, and then 50 m/s for 2 minutes. Thus, a wax particle dispersion wa22 was provided.

(22) Preparation of Wax Particle Dispersion wa23

Under the same conditions as (6), 100 g of ion-exchanged water, 15 g of anionic surface-active agent (S20-F, 20 wt % concentration aqueous solution, manufactured by Sanyo Chemical Industries, Ltd.), 5 g of the first wax (W-6), and 25 g of the second wax (W-11) were blended and treated while the rotating body rotated at a rotational speed of 20 m/s for 3 minutes, and then 50 m/s for 2 minutes. Thus, a wax particle dispersion wa23 was provided.

(23) Preparation of Wax Particle Dispersion wa24

Under the same conditions as (1), 100 g of ion-exchanged water, 3 g of nonionic surface-active agent (ELEMINOL NA 400 manufactured by Sanyo Chemical Industries, Ltd.), and 30 g of the wax (W-1) were blended and treated while the rotating body rotated at a rotational speed of 20 m/s for 3 minutes, and then 45 m/s for 2 minutes. Thus, a wax particle dispersion wa24 was provided.

(24) Preparation of Wax Particle Dispersion wa25

Under the same conditions as (1), 100 g of ion-exchanged water, 1.8 g of nonionic surface-active agent (ELEMINOL NA 400 manufactured by Sanyo Chemical Industries, Ltd.), 6 g of anionic surface-active agent (S20-F, 20 wt % concentration aqueous solution, manufactured by Sanyo Chemical Industries, Ltd.), and 30 g of the wax (W-2) were blended and treated while the rotating body rotated at a rotational speed of 20 m/s for 3 minutes, and then 45 m/s for 2 minutes. Thus, a wax particle dispersion wa25 was provided.

(25) Preparation of Wax Particle Dispersion wa26

Under the same conditions as (1), 100 g of ion-exchanged water, 3 g of nonionic surface-active agent (ELEMINOL NA 400 manufactured by Sanyo Chemical Industries, Ltd.), and 30 g of the wax (W-6) were blended and treated while the rotating body rotated at a rotational speed of 30 m/s for 3 minutes, and then 50 m/s for 2 minutes. Thus, a wax particle dispersion wa26 was provided.

(26) Preparation of Wax Particle Dispersion wa27

Under the same conditions as (1), 100 g of ion-exchanged water, 3 g of nonionic surface-active agent (ELEMINOL NA 400 manufactured by Sanyo Chemical Industries, Ltd.), and 30 g of the wax (W-7) were blended and treated while the rotating body rotated at a rotational speed of 30 m/s for 3 minutes, and then 50 m/s for 2 minutes. Thus, a wax particle dispersion wa27 was provided.

(27) Preparation of Wax Particle Dispersion wa28

Under the same conditions as (1), 100 g of ion-exchanged water, 3 g of nonionic surface-active agent (ELEMINOL NA 400 manufactured by Sanyo Chemical Industries, Ltd.), and 30 g of the wax (W-11) were blended and treated while the rotating body rotated at a rotational speed of 20 m/s for 3 minutes, and then 50 m/s for 2 minutes. Thus, a wax particle dispersion wa28 was provided.

(28) Preparation of Wax Particle Dispersion wa29

Under the same conditions as (1) except that the tank was pressurized at 0.4 Mpa, 100 g of ion-exchanged water, 3 g of nonionic surface-active agent (ELEMINOL NA 400 manufactured by Sanyo Chemical Industries, Ltd.), and 30 g of the wax (W-12) were blended and treated while the rotating body rotated at a rotational speed of 20 m/s for 3 minutes, and then 50 m/s for 2 minutes. Thus, a wax particle dispersion wa29 was provided.

(29) Preparation of Wax Particle Dispersion wa30

Under the same conditions as (1) except that the tank was pressurized at 0.4 Mpa, 100 g of ion-exchanged water, 3 g of nonionic surface-active agent (ELEMINOL NA 400 manufactured by Sanyo Chemical Industries, Ltd.), and 30 g of the wax (W-13) were blended and treated while the rotating body rotated at a rotational speed of 20 m/s for 3 minutes, and then 50 m/s for 2 minutes. Thus, a wax particle dispersion wa30 was provided.

(30) Preparation of Wax Particle Dispersion wa31

100 g of ion-exchanged water, 3 g of anionic surface-active agent (SCF manufactured by Sanyo Chemical Industries, Ltd.), and 30 g of the wax (W-11) were blended and treated for 30 minutes by using a homogenizer. Thus, a wax particle dispersion wa31 was provided.

(31) Preparation of Wax Particle Dispersion wa32

100 g of ion-exchanged water, 3 g of anionic surface-active agent (SCF manufactured by Sanyo Chemical Industries, Ltd.), and 30 g of the wax (W-12) were blended and treated for 30 minutes by using a homogenizer. Thus, a wax particle dispersion wa32 was provided.

(32) Preparation of Wax Particle Dispersion wa33

100 g of ion-exchanged water, 3 g of anionic surface-active agent (SCF manufactured by Sanyo Chemical Industries, Ltd.), and 30 g of the wax (W-13) were blended and treated for 30 minutes by using a homogenizer. Thus, a wax particle dispersion wa33 was provided.

(33) Preparation of Wax Particle Dispersion wa34

100 g of ion-exchanged water, 3 g of anionic surface-active agent (SCF manufactured by Sanyo Chemical Industries, Ltd.), and 30 g of the wax (W-1) were blended and treated for 30 minutes by using a homogenizer. Thus, a wax particle dispersion wa34 was provided.

(34) Preparation of Wax Particle Dispersion wa35

100 g of ion-exchanged water, 3 g of anionic surface-active agent (SCF manufactured by Sanyo Chemical Industries, Ltd.), and 30 g of the wax (W-2) were blended and treated for 30 minutes by using a homogenizer. Thus, a wax particle dispersion wa35 was provided.

(35) Preparation of Wax Particle Dispersion wa36

100 g of ion-exchanged water, 3 g of anionic surface-active agent (SCF manufactured by Sanyo Chemical Industries, Ltd.), and 30 g of the wax (W-6) were blended and treated for 30 minutes by using a homogenizer. Thus, a wax particle dispersion wa36 was provided.

(36) Preparation of Wax Particle Dispersion wa37

100 g of ion-exchanged water, 3 g of anionic surface-active agent (SCF manufactured by Sanyo Chemical Industries, Ltd.), and 30 g of the wax (W-7) were blended and treated for 30 minutes by using a homogenizer Thus, a wax particle dispersion wa37 was provided.

Example 4

Toner Base Production

Tables 13 and 14 show the toner compositions.

In Tables 13 and 14, d50 (μm) is a volume average particle size of the toner base particles. P2 is the number percentage of the toner base particles having a particle size of 2.62 to 4 μm in a number distribution, V46 is the volume percentage of the toner base particles having a particle size of 4 to 6.06 μm in a volume distribution, P46 is the number percentage of the toner base particles having a particle size of 4 to 6.06 μm in the number distribution, and V8 is the volume percentage of the toner base particles having a particle size of not less than 8 μm in the volume distribution.

TABLE 13

| Toner | First resin dispersion | Wax dispersion | Wax dispersion | Pigment dispersion | Second dispersion | d50 (μm) | P2 (pop %) | V46 (vol %) | P46 (pop %) | V8 (vol %) | P46/V46 | Volume-based coefficient of variation |
|---|---|---|---|---|---|---|---|---|---|---|---|---|
| M1 | RL2 | WA1 | | PM1 | RH4 | 4.2 | 73.4 | 26.8 | 39.8 | 0.9 | 1.49 | 17.8 |
| M2 | RL2 | WA2 | | PM1 | RH4 | 6.5 | 13.4 | 66.2 | 67 | 1.2 | 1.01 | 17.9 |
| M3 | RL2 | WA3 | | PM1 | RH4 | 4.9 | 40.1 | 52.9 | 70.2 | 1.2 | 1.33 | 18.9 |
| M4 | RL1 | WA4 | | PM1 | RH4 | 4.4 | 65.8 | 39.8 | 59.8 | 1.3 | 1.50 | 19.2 |
| M5 | RL3 | WA5 | | PM1 | RH4 | 6.7 | 13.1 | 70.4 | 54.9 | 2.8 | 0.78 | 16.8 |
| M6 | RL1 | WA6 | | PM1 | RH4 | 5.2 | 44.1 | 56.8 | 61 | 2.5 | 1.07 | 18.2 |
| M7 | RL3 | WA7 | | PM1 | RH5 | 4.6 | 58.9 | 42.8 | 62.8 | 2.4 | 1.47 | 16.8 |
| M8 | RL3 | WA8 | | PM1 | RH5 | 4.1 | 71.4 | 26.9 | 39.7 | 1.8 | 1.48 | 20.8 |
| M9 | RL2 | WA9 | | PM1 | RH4 | 5.1 | 40.9 | 59.8 | 62.1 | 2.6 | 1.04 | 17.1 |
| M10 | RL2 | WA10 | | PM1 | RH4 | 5.3 | 42.1 | 55.8 | 63.1 | 2.8 | 1.13 | 19.8 |
| M11 | RL2 | WA11 | | PM1 | RH4 | 4.4 | 73 | 26.8 | 39.1 | 2.1 | 1.46 | 18.8 |
| M12 | RL2 | WA12 | | PM1 | RH4 | 6.3 | 12.4 | 66.1 | 66.1 | 1.1 | 1.00 | 18.3 |
| M13 | RL2 | WA13 | | PM1 | RH4 | 5 | 39.8 | 53.1 | 70.1 | 1.9 | 1.32 | 17.5 |
| M14 | RL1 | WA14 | | PM1 | RH4 | 4.4 | 55.8 | 57.9 | 66.2 | 1.3 | 1.14 | 19.2 |
| M15 | RL3 | WA15 | | PM1 | RH4 | 6.6 | 12.9 | 71.5 | 55.9 | 2.9 | 0.78 | 17.9 |
| M16 | RL1 | WA16 | | PM1 | RH4 | 5.1 | 43.5 | 57.6 | 60.8 | 2.9 | 1.06 | 18.9 |
| M17 | RL3 | WA17 | | PM1 | RH5 | 4.8 | 43.8 | 61.8 | 69.8 | 2.4 | 1.13 | 16.8 |
| M18 | RL3 | WA18 | | PM1 | RH5 | 3.9 | 71.2 | 28.9 | 38.4 | 1.2 | 1.33 | 21.5 |
| M19 | RL2 | WA19 | | PM1 | RH4 | 5.1 | 40.9 | 59.8 | 62.1 | 2.6 | 1.04 | 17.1 |
| M20 | RL3 | WA7 | | PM2 | RH5 | 4.8 | 71.1 | 27.1 | 39.2 | 1.8 | 1.45 | 20.1 |

TABLE 14

| Toner | First resin dispersion | Wax dispersion | Wax dispersion | Pigment dispersion | Second dispersion | d50 (μm) | P2 (pop %) | V46 (vol %) | P46 (pop %) | V8 (vol %) | P46/V46 | Volume-based coefficient of variation |
|---|---|---|---|---|---|---|---|---|---|---|---|---|
| m31 | RL1 | wa21 | | PM1 | RH5 | 7.4 | | | | | | 23.8 |
| m32 | RL2 | wa22 | | PM1 | RH4 | 8.4 | | | | | | 24.8 |
| m33 | RL2 | wa23 | | PM1 | RH4 | 10.9 | | | | | | 31.8 |
| m34 | RL1 | wa24 (1) | wa28 (5) | PM1 | RH4 | 5.8 | | | | | | 42.8 |
| m35 | RL1 | wa25 (1) | wa29 (2) | PM1 | RH4 | 4.8 | | | | | | 41.8 |
| m36 | RL1 | wa26 (1) | wa30 (1) | PM1 | RH5 | 7.8 | | | | | | 45.8 |
| m37 | RL2 | wa27 (1) | wa28 (5) | PM1 | RH4 | 8.2 | | | | | | 41.8 |
| m38 | RL2 | wa31 | | PM1 | RH4 | 12.8 | 6.8 | 9.1 | 19.8 | 19.8 | 2.18 | 24.8 |
| m39 | RL2 | wa32 | | PM1 | RH4 | 18.1 | 3.4 | 5.9 | 19.2 | 22.4 | 3.25 | 33.7 |
| m40 | RL2 | wa33 | | PM1 | RH4 | 20.7 | 5.8 | 4.9 | 13.5 | 23.1 | 2.76 | 36.8 |
| m41 | RL1 | wa34 | | PM1 | RH4 | 22.4 | 2.2 | 6 | 18.1 | 19.8 | 3.02 | 33.7 |
| m42 | RL3 | wa35 | | PM1 | RH4 | 20.8 | 3.5 | 4.9 | 14.1 | 22.9 | 2.88 | 30.8 |
| m43 | RL1 | wa36 | | PM1 | RH4 | 18.4 | 2.4 | 6.1 | 18.2 | 19.9 | 2.98 | 34.7 |
| m44 | RL3 | wa37 | | PM1 | RH4 | 19.2 | 3.6 | 4.8 | 13.8 | 23.4 | 2.88 | 31.2 |
| m45 | RL2 | WA7 | | pm3 | RH4 | 8.2 | | | | | | 26.8 |
| m46 | RL2 | WA7 | | pm4 | RH4 | 11.4 | | | | | | 33.9 |

(1) Preparation of toner base M1

In a 2000 ml four-neck flask equipped with a thermometer, a cooling tube, a stirring rod, and a pH meter were placed 204 g of first resin particle dispersion RL2, 20 g of colorant particle dispersion PM1, 50 g of wax particle dispersion WA1, and 200 ml of ion-exchanged water, and then mixed in the same manner as (1). Thus, a mixed particle dispersion was prepared. The pH of the mixed particle dispersion was 2.7.

The pH was increased to 11.8 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 80° C., and then the mixture was heat-treated further for 2 hours. The resultant dispersion had a pH of 9.2. Moreover, the pH was adjusted to 6.6 by the addition of 1N HCl, and then the temperature was raised to 90° C. and the dispersion was heat-treated for 2 hours to provide core particles.

After the water temperature was reduced to 60° C., 43 g of second resin particle dispersion RH4 for forming a shell was added, and the pH was adjusted to 6.6. This mixture was heated at 95° C. for 3 hours, thereby providing resin-fused particles.

After cooling, the reaction product (toner base) was filtered and washed three times with ion-exchanged water. The toner base thus obtained was dried at 40° C. for 6 hours by using a fluid-type dryer, resulting in a toner base M1 with a volume-average particle size of 4.2 μm and a coefficient of variation of 17.8.

When the pH before adding the water-soluble inorganic salt and heating was less than 9.5, the core particles became coarser. When the pH was 12.5, the liberated wax was increased, and it was difficult to incorporate the wax uniformly. When the pH of the liquid at the time of forming the core particles was more than 9.5, the liberated wax was increased due to poor aggregation.

After the temperature was raised from 22° C. to 70° C. at a rate of 5° C./min, and the heat-treatment was performed at 80° C. for 2 hours, if the dispersion was heat-treated without adjusting the pH, or the adjusted pH was more than 6.8, the particles were likely to be slightly larger. If the pH was reduced to 2.2, the effect of the surface-active agent was eliminated, and the particles were likely to be coarser.

When the pH after adding the second resin particle dispersion (RH4 in this example) was 3.0, the adhesion of the second resin particles to the core particles did not occur easily, and the liberated resin particles were increased. When the pH was 7.0, secondary aggregation of the core particles occurred, and the particles became coarser.

(2) Preparation of Toner Base M2

In the same flask as that used for the toner base M1 were placed 204 g of first resin particle dispersion RL2, 20 g of colorant particle dispersion PM1, 65 g of wax particle dispersion WA2, and 200 ml of ion-exchanged water, and then mixed under the same conditions as the toner base M1. Thus, a mixed particle dispersion was prepared. The pH of the mixed particle dispersion was 1.8.

The pH was increased to 9.7 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 80° C., and then the mixture was heat-treated further for 2 hours to provide core particles. The resultant core particle dispersion had a pH of 7.2. Moreover, the temperature was raised to 90° C. and the dispersion was heat-treated for 2 hours to provide core particles.

After the water temperature was reduced to 60° C., 43 g of second resin particle dispersion RH4 for forming a shell was added, and the pH was adjusted to 3.4. This mixture was heated at 95° C. for 3 hours, thereby providing resin-fused particles.

After cooling, the reaction product (toner base) was filtered, washed, and dried under the same conditions as the toner base M1, resulting in a toner base M2 with a volume-average particle size of 6.5 μm and a coefficient of variation of 17.9.

(3) Preparation of Toner Base M3

In the same flask as that used for the toner base M1 were placed 204 g of first resin particle dispersion RL2, 20 g of colorant particle dispersion PM1, 60 g of wax particle dispersion WA3, and 200 ml of ion-exchanged water, and then mixed under the same conditions as the toner base M1. Thus, a mixed particle dispersion was prepared. The pH of the mixed particle dispersion was 4.2.

The pH was increased to 11 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture was heat-treated further for 2 hours to provide core particles. The resultant core particle dispersion had a pH of 8.4. Moreover, the pH was adjusted to 5.4 by the addition of 1N HCl, and then the temperature was raised to 90° C. and the dispersion was heat-treated for 2 hours to provide core particles.

After the water temperature was reduced to 60° C., 43 g of second resin particle dispersion RH4 for forming a shell was added, and the pH was adjusted to 5.4. This mixture was heated at 95° C. for 3 hours, thereby providing resin-fused particles.

After cooling, the reaction product (toner base) was filtered, washed, and dried under the same conditions as the toner base M1, resulting in a toner base M3 with a volume-average particle size of 4.9 μm and a coefficient of variation of 18.9.

(4) Preparation of Toner Base M4

In the same flask as that used for the toner base M1 were placed 204 g of first resin particle dispersion RL1, 20 g of colorant particle dispersion PM1, 60 g of wax particle dispersion WA4, and 200 ml of ion-exchanged water, and then mixed under the same conditions as the toner base M1. Thus, a mixed particle dispersion was prepared. The pH of the mixed particle dispersion was 3.8.

The pH was increased to 11.9 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 80° C., and then the mixture was heat-treated further for 2 hours to provide core particles. The resultant core particle dispersion had a pH of 9.3. Moreover, the pH was adjusted to 3.2 by the addition of 1N HCl, and then the temperature was raised to 90° C. and the dispersion was heat-treated for 2 hours to provide core particles.

After the water temperature was reduced to 60° C., 43 g of second resin particle dispersion RH4 for forming a shell was added, and the pH was adjusted to 3.4. This mixture was heated at 95° C. for 3 hours, thereby providing resin-fused particles.

After cooling, the reaction product (toner base) was filtered, washed, and dried under the same conditions as the toner base M1, resulting in a toner base M4 with a volume-average particle size of 4.4 μm and a coefficient of variation of 19.2.

(5) Preparation of Toner Base M5

In the same flask as that used for the toner base M1 were placed 204 g of first resin particle dispersion RL3, 20 g of colorant particle dispersion PM1, 55 g of wax particle dispersion WA5, and 200 ml of ion-exchanged water, and then mixed under the same conditions as the toner base M1. Thus, a mixed particle dispersion was prepared. The pH of the mixed particle dispersion was 2.2.

The pH was increased to 9.7 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture was heat-treated further for 2 hours to provide core particles. The resultant core particle dispersion had a pH of 7. Moreover, the temperature was raised to 90° C. and the dispersion was heat-treated for 2 hours to provide core particles.

After the water temperature was reduced to 60° C., 43 g of second resin particle dispersion RH4 for forming a shell was added, and the pH was adjusted to 3.4. This mixture was heated at 90° C. for 3 hours, thereby providing resin-fused particles.

After cooling, the reaction product (toner base) was filtered, washed, and dried under the same conditions as the toner base M1, resulting in a toner base M5 with a volume-average particle size of 6.7 μm and a coefficient of variation of 16.8.

(6) Preparation of Toner Base M6

In the same flask as that used for the toner base M1 were placed 204 g of first resin particle dispersion RL1, 20 g of colorant particle dispersion PM1, 70 g of wax particle dispersion WA6, and 200 ml of ion-exchanged water, and then mixed under the same conditions as the toner base M1. Thus, a mixed particle dispersion was prepared. The pH of the mixed particle dispersion was 3.8.

The pH was increased to 10.5 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture was heat-treated further for 2 hours to provide core particles. The resultant core particle dispersion had a pH of 7.9. Moreover, the pH was adjusted to 3.2 by the addition of 1N HCl, and then the temperature was raised to 90° C. and the dispersion was heat-treated for 2 hours to provide core particles.

After the water temperature was reduced to 60° C., 43 g of second resin particle dispersion RH4 for forming a shell was added, and the pH was adjusted to 3.4. This mixture was heated at 90° C. for 3 hours, thereby providing resin-fused particles.

After cooling, the reaction product (toner base) was filtered, washed, and dried under the same conditions as the toner base M1, resulting in a toner base M6 with a volume-average particle size of 5.2 μm and a coefficient of variation of 18.2.

(7) Preparation of Toner Base M7

In the same flask as that used for the toner base M1 were placed 204 g of first resin particle dispersion RL3, 20 g of colorant particle dispersion PM1, 85 g of wax particle dispersion WA7, and 200 ml of ion-exchanged water, and then mixed under the same conditions as the toner base M1. Thus, a mixed particle dispersion was prepared. The pH of the mixed particle dispersion was 1.8.

The pH was increased to 11.2 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture was heat-treated further for 2 hours to provide core particles. The resultant core particle dispersion had a pH of 8.6. Moreover, the pH was adjusted to 3.2 by the addition of 1N HCl, and then the temperature was raised to 90° C. and the dispersion was heat-treated for 2 hours to provide core particles.

After the water temperature was reduced to 60° C., 43 g of second resin particle dispersion RH5 for forming a shell was added, and the pH was adjusted to 3.4. This mixture was heated at 90° C. for 3 hours, thereby providing resin-fused particles.

After cooling, the reaction product (toner base) was filtered, washed, and dried under the same conditions as the toner base M1, resulting in a toner base M7 with a volume-average particle size of 4.6 μm and a coefficient of variation of 16.8.

(8) Preparation of Toner Base M8

In the same flask as that used for the toner base M1 were placed 204 g of first resin particle dispersion RL3, 20 g of colorant particle dispersion PM1, 90 g of wax particle dispersion WA8, and 200 ml of ion-exchanged water, and then mixed under the same conditions as the toner base M1. Thus, a mixed particle dispersion was prepared. The pH of the mixed particle dispersion was 2.1.

The pH was increased to 11.6 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture was heat-treated further for 2 hours to provide core particles. The resultant core particle dispersion had a pH of 8.9. Moreover, the pH was adjusted to 3.2 by the addition of 1N HCl, and then the temperature was raised to 90° C. and the dispersion was heat-treated for 2 hours to provide core particles.

After the water temperature was reduced to 60° C., 43 g of second resin particle dispersion RH5 for forming a shell was added, and the pH was adjusted to 3.4. This mixture was heated at 90° C. for 3 hours, thereby providing resin-fused particles.

After cooling, the reaction product (toner base) was filtered, washed, and dried under the same conditions as the toner base M1, resulting in a toner base M8 with a volume-average particle size of 4.1 μm and a coefficient of variation of 20.8.

(9) Preparation of Toner Base M9

In the same flask as that used for the toner base M1 were placed 204 g of first resin particle dispersion RL2, 20 g of colorant particle dispersion PM1, 70 g of wax particle dispersion WA9, and 200 ml of ion-exchanged water, and then mixed under the same conditions as the toner base M1. Thus, a mixed particle dispersion was prepared. The pH of the mixed particle dispersion was 2.8.

The pH was increased to 10.8 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture was heat-treated further for 2 hours to provide core particles. The resultant core particle dispersion had a pH of 8.1. Moreover, the pH was adjusted to 3.2 by the addition of 1N HCl, and then the temperature was raised to 90° C. and the dispersion was heat-treated for 2 hours to provide core particles.

After the water temperature was reduced to 60° C., 43 g of second resin particle dispersion RH4 for forming a shell was added, and the pH was adjusted to 3.4. This mixture was heated at 90° C. for 3 hours, thereby providing resin-fused particles.

After cooling, the reaction product (toner base) was filtered, washed, and dried under the same conditions as the toner base M1, resulting in a toner base M9 with a volume-average particle size of 5.1 μm and a coefficient of variation of 17.1.

(10) Preparation of Toner Base M10

In the same flask as that used for the toner base M1 were placed 204 g of first resin particle dispersion RL2, 20 g of colorant particle dispersion PM1, 70 g of wax particle dispersion WA10, and 200 ml of ion-exchanged water, and then mixed under the same conditions as the toner base M1. Thus, a mixed particle dispersion was prepared. The pH of the mixed particle dispersion was 1.9.

The pH was increased to 10.7 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture was heat-treated further for 2 hours to provide core particles. The resultant core particle dispersion had a pH of 7.9. Moreover, the pH was adjusted to 3.2 by the addition of 1N HCl, and then the temperature was raised to 90° C. and the dispersion was heat-treated for 2 hours to provide core particles.

After the water temperature was reduced to 60° C., 43 g of second resin particle dispersion RH4 for forming a shell was added, and the pH was adjusted to 3.4. This mixture was heated at 90° C. for 3 hours, thereby providing resin-fused particles.

After cooling, the reaction product (toner base) was filtered, washed, and dried under the same conditions as the toner base M1, resulting in a toner base M10 with a volume-average particle size of 5.3 μm and a coefficient of variation of 19.8.

(11) Preparation of Toner Base M11

In the same flask as that used for the toner base M1 were placed 204 g of first resin particle dispersion RL2, 20 g of colorant particle dispersion PM1, 50 g of wax particle dispersion WA11, and 200 ml of ion-exchanged water, and then mixed under the same conditions as the toner base M1. Thus, a mixed particle dispersion was prepared. The pH of the mixed particle dispersion was 5.7.

The pH was increased to 11.8 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 80° C., and then the mixture was heat-treated further for 2 hours. The resultant dispersion had a pH of 9.2. Moreover, the pH was adjusted to 6.6 by the addition of 1N HCl, and then the temperature was raised to 90° C. and the dispersion was heat-treated for 2 hours to provide core particles.

After the water temperature was reduced to 60° C., 43 g of second resin particle dispersion RH4 for forming a shell was added, and the pH was adjusted to 6.6. This mixture was heated at 95° C. for 3 hours, thereby providing resin-fused particles.

After cooling, the reaction product (toner base) was filtered, washed, and dried under the same conditions as the toner base M1, resulting in a toner base M11 with a volume-average particle size of 4.4 μm and a coefficient of variation of 18.8.

When the pH before adding the water-soluble inorganic salt and heating was less than 9.5, the core particles became coarser. When the pH was 12.5, the liberated wax was increased, and it was difficult to incorporate the wax uniformly. When the pH of the liquid at the time of forming the core particles was more than 9.5, the liberated wax was increased due to poor aggregation.

After the temperature was raised from 22° C. to 70° C. at a rate of 5° C./min, and the heat-treatment was performed at 80° C. for 2 hours, if the dispersion was heat-treated without adjusting the pH, or the adjusted pH was more than 6.8, the particles were likely to be larger. If the pH was reduced to 2.2, the effect of the surface-active agent was eliminated, and the particles were likely to be coarser.

When the pH after adding the second resin particle dispersion (RH4 or RH5 in this example) was 3.0, the adhesion of the second resin particles to the core particles did not occur easily, and the liberated resin particles were increased. When the pH was 7.0, secondary aggregation of the core particles occurred, and the particles became coarser.

(12) Preparation of Toner Base M12

In the same flask as that used for the toner base M1 were placed 204 g of first resin particle dispersion RL2, 20 g of colorant particle dispersion PM1, 65 g of wax particle dispersion WA12, and 200 ml of ion-exchanged water, and then mixed under the same conditions as the toner base M1. Thus, a mixed particle dispersion was prepared. The pH of the mixed particle dispersion was 2.8.

The pH was increased to 9.7 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 80° C., and then the mixture was heat-treated further for 2 hours to provide core particles. The resultant core particle dispersion had a pH of 7.2. Moreover, the temperature was raised to 90° C. and the dispersion was heat-treated for 2 hours to provide core particles.

After the water temperature was reduced to 60° C., 43 g of second resin particle dispersion RH4 for forming a shell was added, and the pH was adjusted to 3.4. This mixture was heated at 95° C. for 3 hours, thereby providing resin-fused particles.

After cooling, the reaction product (toner base) was filtered, washed, and dried under the same conditions as the toner base M1, resulting in a toner base M12 with a volume-average particle size of 6.3 μm and a coefficient of variation of 18.3.

(13) Preparation of Toner Base M13

In the same flask as that used for the toner base M1 were placed 204 g of first resin particle dispersion RL2, 20 g of colorant particle dispersion PM1, 60 g of wax particle dispersion WA13, and 200 ml of ion-exchanged water, and then mixed under the same conditions as the toner base M1. Thus, a mixed particle dispersion was prepared. The pH of the mixed particle dispersion was 4.2.

The pH was increased to 11.2 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture was heat-treated further for 2 hours to provide core particles. The resultant core particle dispersion had a pH of 8.5. Moreover, the pH was adjusted to 5.4 by the addition of 1N HCl, and then the temperature was raised to 90° C. and the dispersion was heat-treated for 2 hours to provide core particles.

After the water temperature was reduced to 60° C., 43 g of second resin particle dispersion RH4 for forming a shell was added, and the pH was adjusted to 5.0. This mixture was heated at 95° C. for 2 hours. Then, the pH was adjusted to 8.6, and the mixture was heated for 1 hour, thereby providing resin-fused particles.

After cooling, the reaction product (toner base) was filtered, washed, and dried under the same conditions as the toner base M1, resulting in a toner base M13 with a volume-average particle size of 5 μm and a coefficient of variation of 17.5.

(14) Preparation of Toner Base M14

In the same flask as that used for the toner base M1 were placed 204 g of first resin particle dispersion RL1, 20 g of colorant particle dispersion PM1, 60 g of wax particle dispersion WA14, and 200 ml of ion-exchanged water, and then mixed under the same conditions as the toner base M1. Thus, a mixed particle dispersion was prepared. The pH of the mixed particle dispersion was 5.8.

The pH was increased to 11.9 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 80° C., and then the mixture was heat-treated further for 2 hours to provide core particles. The resultant core particle dispersion had a pH of 9.3. Moreover, the pH was adjusted to 3.2 by the addition of 1N HCl, and then the temperature was raised to 90° C. and the dispersion was heat-treated for 2 hours to provide core particles.

After the water temperature was reduced to 60° C., 43 g of second resin particle dispersion RH4 for forming a shell was added, and the pH was adjusted to 3.4. This mixture was heated at 95° C. for 3 hours, thereby providing resin-fused particles.

After cooling, the reaction product (toner base) was filtered, washed, and dried under the same conditions as the toner base M1, resulting in a toner base M14 with a volume-average particle size of 4.4 μm and a coefficient of variation of 19.2.

(15) Preparation of Toner Base M15

In the same flask as that used for the toner base M1 were placed 204 g of first resin particle dispersion RL3, 20 g of colorant particle dispersion PM1, 55 g of wax particle dispersion WA15, and 200 ml of ion-exchanged water, and then mixed under the same conditions as the toner base M1. Thus, a mixed particle dispersion was prepared. The pH of the mixed particle dispersion was 2.2.

The pH was increased to 9.7 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture was heat-treated further for 2 hours to provide core particles. The resultant core particle dispersion had a pH of 7.0. Moreover, the temperature was raised to 90° C. and the dispersion was heat-treated for 2 hours to provide core particles.

After the water temperature was reduced to 60° C., 43 g of second resin particle dispersion RH4 for forming a shell was added, and the pH was adjusted to 3.4. This mixture was heated at 90° C. for 2 hours. Then, the pH was adjusted to 5.4, and the mixture was heated for 1 hour, thereby providing resin-fused particles.

After cooling, the reaction product (toner base) was filtered, washed, and dried under the same conditions as the toner base M1, resulting in a toner base M15 with a volume-average particle size of 6.6 μm and a coefficient of variation of 17.9.

(16) Preparation of Toner Base M16

In the same flask as that used for the toner base M1 were placed 204 g of first resin particle dispersion RL1, 20 g of colorant particle dispersion PM1, 70 g of wax particle dispersion WA16, and 200 ml of ion-exchanged water, and then mixed under the same conditions as the toner base M1. Thus, a mixed particle dispersion was prepared. The pH of the mixed particle dispersion was 3.8.

The pH was increased to 11.2 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture was heat-treated further for 2 hours to provide core particles. The resultant core particle dispersion had a pH of 8.3. Moreover, the pH was adjusted to 3.2 by the addition of 1N HCl, and then the temperature was raised to 90° C. and the dispersion was heat-treated for 2 hours to provide core particles.

After the water temperature was reduced to 60° C., 43 g of second resin particle dispersion RH4 for forming a shell was added, and the pH was adjusted to 3.4. This mixture was heated at 90° C. for 3 hours, thereby providing resin-fused particles.

After cooling, the reaction product (toner base) was filtered, washed, and dried under the same conditions as the toner base M1, resulting in a toner base M16 with a volume-average particle size of 4.2 μm and a coefficient of variation of 18.9.

(17) Preparation of Toner Base M17

In the same flask as that used for the toner base M1 were placed 204 g of first resin particle dispersion RL3, 20 g of colorant particle dispersion PM1, 85 g of wax particle dispersion WA17, and 200 ml of ion-exchanged water, and then mixed under the same conditions as the toner base M1. Thus, a mixed particle dispersion was prepared. The pH of the mixed particle dispersion was 4.2.

The pH was increased to 11.2 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture was heat-treated further for 2 hours to provide core particles. The resultant core particle dispersion had a pH of 8.6. Moreover, the pH was adjusted to 3.2 by the addition of 1N HCl, and then the temperature was raised to 90° C. and the dispersion was heat-treated for 2 hours to provide core particles.

After the water temperature was reduced to 60° C., 43 g of second resin particle dispersion RH5 for forming a shell was added, and the pH was adjusted to 3.4. This mixture was heated at 90° C. for 2 hours. Then, the pH was adjusted to 5.4, and the mixture was heated for 1 hour. Subsequently, the pH was adjusted to 2.4, and the mixture was heated for 1 hour, thereby providing resin-fused particles.

After cooling, the reaction product (toner base) was filtered, washed, and dried under the same conditions as the toner base M1, resulting in a toner base M17 with a volume-average particle size of 4.8 μm and a coefficient of variation of 16.8. The toner base M17 included particles with substantially smooth surfaces having almost no unevenness. Table 16 shows the pH, the temperature, and the volume-average particle size (d50) at each treatment time (2 hours, 1 hour, and 1 hour) after the addition of the shell resin.

(18) Preparation of Toner Base M18

In the same flask as that used for the toner base M1 were placed 204 g of first resin particle dispersion RL3, 20 g of colorant particle dispersion PM1, 90 g of wax particle dispersion WA18, and 200 ml of ion-exchanged water, and then mixed under the same conditions as the toner base M1. Thus, a mixed particle dispersion was prepared. The pH of the mixed particle dispersion was 4.3.

The pH was increased to 11.6 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture was heat-treated further for 2 hours to provide core particles. The resultant core particle dispersion had a pH of 8.9. Moreover, the pH was adjusted to 3.2 by the addition of 1N HCl, and then the temperature was raised to 90° C. and the dispersion was heat-treated for 2 hours to provide core particles.

After the water temperature was reduced to 60° C., 43 g of second resin particle dispersion RH5 for forming a shell was added, and the pH was adjusted to 3.4. This mixture was heated at 90° C. for 3 hours, thereby providing resin-fused particles.

After cooling, the reaction product (toner base) was filtered, washed, and dried under the same conditions as the toner base M1, resulting in a toner base M18 with a volume-average particle size of 3.9 μm and a coefficient of variation of 21.5.

(19) Preparation of Toner Base M19

In the same flask as that used for the toner base M1 were placed 204 g of first resin particle dispersion RL2, 20 g of colorant particle dispersion PM1, 70 g of wax particle dispersion WA19, and 200 ml of ion-exchanged water, and then mixed under the same conditions as the toner base M1. Thus, a mixed particle dispersion was prepared. The pH of the mixed particle dispersion was 3.8.

The pH was increased to 11.2 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture was heat-treated further for 2 hours to provide core particles. The resultant core particle dispersion had a pH of 8.5. Moreover, the pH was adjusted to 3.2 by the addition of 1N HCl, and then the temperature was raised to 90° C. and the dispersion was heat-treated for 2 hours to provide core particles.

After the water temperature was reduced to 60° C., 43 g of second resin particle dispersion RH4 for forming a shell was added, and the pH was adjusted to 3.4. This mixture was heated at 90° C. for 2 hours. Then, the pH was adjusted to 5.4, and the mixture was heated for 1 hour. Subsequently, the pH was adjusted to 6.6, and the mixture was heated for 1 hour, thereby providing resin-fused particles.

After cooling, the reaction product (toner base) was filtered, washed, and dried under the same conditions as the toner base M1, resulting in a toner base M19 with a volume-average particle size of 5.1 μm and a coefficient of variation of 17.1. The toner base M19 included particles with substantially smooth surfaces having almost no unevenness. Table 16 shows the pH, the temperature, and the volume-average particle size (d50) at each treatment time (2 hours, 1 hour, and 1 hour) after the addition of the shell resin.

(20) Preparation of Toner Base M20

In the same flask as that used for the toner base M1 were placed 204 g of first resin particle dispersion RL3, 20 g of colorant particle dispersion PM2, 85 g of wax particle dispersion WA7, and 200 ml of ion-exchanged water, and then mixed under the same conditions as the toner base M1. Thus, a mixed particle dispersion was prepared. The pH of the mixed particle dispersion was 2.6.

The pH was increased to 11.7 by adding 1N NaOH to the mixed particle dispersion. Subsequently, 200 g of magnesium sulfate aqueous solution (30% concentration) was added and stirred for 10 minutes. After the temperature was raised from 20° C. to 70° C. at a rate of 5° C./min, the mixture was heat-treated at 70° C. for 2 hours. The temperature was raised to 85° C., and then the mixture was heat-treated further for 2 hours to provide core particles. The resultant core particle dispersion had a pH of 9.2. Moreover, the pH was adjusted to 3.2 by the addition of 1N HCl, and then the temperature was raised to 90° C. and the dispersion was heat-treated for 2 hours to provide core particles.

After the water temperature was reduced to 60° C., 43 g of second resin particle dispersion RH5 for forming a shell was added, and the pH was adjusted to 3.4. This mixture was heated at 90° C. for 3 hours, thereby providing resin-fused particles.

After cooling, the reaction product (toner base) was filtered, washed, and dried under the same conditions as the toner base M1, resulting in a toner base M20 with a volume-average particle size of 4.8 μm and a coefficient of variation of 20.1.

(21) Preparation of Toner Base m31

In the same flask as that used for the toner base M1 were placed 204 g of first resin particle dispersion RL1, 20 g of colorant particle dispersion PM1, 40 g of wax particle dispersion wa21, and 200 ml of ion-exchanged water, and then mixed under the same conditions as the toner base M1. Thus, a mixed particle dispersion was prepared. The pH of the mixed particle dispersion was 2.8.

The pH was increased to 11.7 by adding 1N NaOH to the mixed particle dispersion. Subsequently, 200 g of magnesium sulfate aqueous solution (30% concentration) was added and stirred for 10 minutes. After the temperature was raised from 20° C. to 90° C. at a rate of 1° C./min, the mixture was heat-treated for 3 hours to provide core particles. The resultant core particle dispersion had a pH of 9.1.

After the water temperature was reduced to 60° C., 43 g of second resin particle dispersion RH5 for forming a shell was added, and the pH was adjusted to 5. This mixture was heated at 95° C. for 3 hours, thereby providing resin-fused particles.

After cooling, the reaction product (toner base) was filtered, washed, and dried under the same conditions as the toner base M1, resulting in a toner base m31 with a volume-average particle size of 7.4 μm and a coefficient of variation of 23.8. The toner base m31 had a slightly broader particle size distribution.

(22) Preparation of Toner Base m32

In the same flask as that used for the toner base M1 were placed 204 g of first resin particle dispersion RL2, 20 g of colorant particle dispersion PM1, 50 g of wax particle dispersion wa22, and 200 ml of ion-exchanged water, and then mixed under the same conditions as the toner base M1. Thus, a mixed particle dispersion was prepared. The pH of the mixed particle dispersion was 2.8.

The pH was increased to 11.8 by adding 1N NaOH to the mixed particle dispersion. Subsequently, 200 g of magnesium sulfate aqueous solution (30% concentration) was added and stirred for 10 minutes. After the temperature was raised from 20° C. to 90° C. at a rate of 1° C./min, the mixture was heat-treated for 3 hours to provide core particles. The resultant core particle dispersion had a pH of 9.2.

After the water temperature was reduced to 60° C., 43 g of second resin particle dispersion RH4 for forming a shell was added, and the pH was adjusted to 5. This mixture was heated at 95° C. for 3 hours, thereby providing resin-fused particles.

After cooling, the reaction product (toner base) was filtered, washed, and dried under the same conditions as the toner base M1, resulting in a toner base m32 with a volume-average particle size of 8.4 μm and a coefficient of variation of 24.8. The toner base m32 had a slightly broader particle size distribution. Part of the aqueous medium remained white.

(23) Preparation of Toner Base m33

In the same flask as that used for the toner base M1 were placed 204 g of first resin particle dispersion RL2, 20 g of colorant particle dispersion PM1, 50 g of wax particle dispersion wa23, and 200 ml of ion-exchanged water, and then mixed under the same conditions as the toner base M1. Thus, a mixed particle dispersion was prepared. The pH of the mixed particle dispersion was 3.8.

The pH was increased to 11.8 by adding 1N NaOH to the mixed particle dispersion. Subsequently, 200 g of magnesium sulfate aqueous solution (30% concentration) was added and stirred for 10 minutes. After the temperature was raised from 20° C. to 90° C. at a rate of 1° C./min, the mixture was heat-treated for 3 hours to provide core particles. The resultant core particle dispersion had a pH of 9.2.

After the water temperature was reduced to 60° C., 43 g of second resin particle dispersion RH4 for forming a shell was added, and the pH was adjusted to 8.5. This mixture was heated at 95° C. for 3 hours, thereby providing resin-fused particles.

After cooling, the reaction product (toner base) was filtered, washed, and dried under the same conditions as the toner base M1, resulting in a toner base m33 with a volume-average particle size of 10.9 μm and a coefficient of variation of 31.8. The toner base m33 had a broader particle size distribution. Part of the aqueous medium remained white.

(24) Preparation of Toner Base M34

In the same flask as that used for the toner base M1 were placed 204 g of first resin particle dispersion RL1, 20 g of colorant particle dispersion PM1, 14.2 g of wax particle dispersion wa24, 71 g of wax particle dispersion wa28, and 200 ml of ion-exchanged water, and then mixed under the same conditions as the toner base M1. Thus, a mixed particle dispersion was prepared. The pH of the mixed particle dispersion was 3.5.

The pH was increased to 11.8 by adding 1N NaOH to the mixed particle dispersion. Subsequently, 200 g of magnesium sulfate aqueous solution (30% concentration) was added and stirred for 10 minutes. After the temperature was raised from 20° C. to 90° C. at a rate of 1° C./min, the mixture was heat-treated for 3 hours to provide core particles. The resultant core particle dispersion had a pH of 9.2.

After the water temperature was reduced to 60° C., 43 g of second resin particle dispersion RH4 for forming a shell was added, and the pH was adjusted to 5. This mixture was heated at 95° C. for 3 hours, thereby providing resin-fused particles.

After cooling, the reaction product (toner base) was filtered, washed, and dried under the same conditions as the toner base M1, resulting in a toner base m34 with a volume-average particle size of 5.8 μm and a coefficient of variation of 42.8. The toner base m34 had a broader particle size distribution. Part of the aqueous medium remained white due to the presence of suspended wax particles.

(25) Preparation of Toner Base m35

In the same flask as that used for the toner base M1 were placed 204 g of first resin particle dispersion RL1, 20 g of colorant particle dispersion PM1, 21.7 g of wax particle dispersion wa25, 43.4 g of wax particle dispersion wa29, and 200 ml of ion-exchanged water, and then mixed under the same conditions as the toner base M1. Thus, a mixed particle dispersion was prepared. The pH of the mixed particle dispersion was 3.8.

The pH was increased to 9.7 by adding 1N NaOH to the mixed particle dispersion. Subsequently, 200 g of magnesium sulfate aqueous solution (30% concentration) was added and stirred for 10 minutes. After the temperature was raised from 20° C. to 90° C. at a rate of 1° C./min, the mixture was heat-treated for 3 hours to provide core particles. The resultant core particle dispersion had a pH of 7.2.

After the water temperature was reduced to 60° C., 43 g of second resin particle dispersion RH4 for forming a shell was added, and the pH was adjusted to 5. This mixture was heated at 95° C. for 3 hours, thereby providing resin-fused particles.

After cooling, the reaction product (toner base) was filtered, washed, and dried under the same conditions as the toner base M1, resulting in a toner base m35 with a volume-average particle size of 4.8 μm and a coefficient of variation of 41.8. The toner base m35 had a broader particle size distribution. Part of the aqueous medium remained white due to the presence of suspended wax particles.

(26) Preparation of Toner Base m36

In the same flask as that used for the toner base M1 were placed 204 g of first resin particle dispersion RL1, 20 g of colorant particle dispersion PM1, 32.5 g of wax particle dispersion wa26, 32.5 g of wax particle dispersion wa30, and 200 ml of ion-exchanged water, and then mixed under the same conditions as the toner base M1. Thus, a mixed particle dispersion was prepared. The pH of the mixed particle dispersion was 3.9.

The pH was increased to 11.1 by adding 1N NaOH to the mixed particle dispersion. Subsequently, 200 g of magnesium sulfate aqueous solution (30% concentration) was added and stirred for 10 minutes. After the temperature was raised from 20° C. to 90° C. at a rate of 1° C./min, the mixture was heat-treated for 3 hours to provide core particles. The resultant core particle dispersion had a pH of 8.5.

After the water temperature was reduced to 60° C., 43 g of second resin particle dispersion RH5 for forming a shell was added, and the pH was adjusted to 5. This mixture was heated at 95° C. for 3 hours, thereby providing resin-fused particles.

After cooling, the reaction product (toner base) was filtered, washed, and dried under the same conditions as the toner base M1, resulting in a toner base m36 with a volume-average particle size of 7.8 μm and a coefficient of variation of 45.8. The toner base m36 had a broader particle size distribution. Part of the aqueous medium remained white due to the presence of suspended wax particles.

(27) Preparation of Toner Base m37

In the same flask as that used for the toner base M1 were placed 204 g of first resin particle dispersion RL2, 20 g of colorant particle dispersion PM1, 8.3 g of wax particle dispersion wa27, 41.5 g of wax particle dispersion wa28, and 200 ml of ion-exchanged water, and then mixed under the same conditions as the toner base M1. Thus, a mixed particle dispersion was prepared. The pH of the mixed particle dispersion was 3.9.

The pH was increased to 11.8 by adding 1N NaOH to the mixed particle dispersion. Subsequently, 200 g of magnesium sulfate aqueous solution (30% concentration) was added and stirred for 10 minutes. After the temperature was raised from 20° C. to 90° C. at a rate of 1° C./min, the mixture was heat-treated for 3 hours to provide core particles. The resultant core particle dispersion had a pH of 9.2.

After the water temperature was reduced to 60° C., 43 g of second resin particle dispersion RH4 for forming a shell was added, and the pH was adjusted to 7.0. This mixture was heated at 95° C. for 3 hours, thereby providing resin-fused particles.

After cooling, the reaction product (toner base) was filtered, washed, and dried under the same conditions as the toner base M1, resulting in a toner base m37 with a volume-average particle size of 8.2 μm and a coefficient of variation of 41.8. The toner base m37 had a broader particle size distribution. Part of the aqueous medium remained white due to the presence of suspended wax particles.

(28) Preparation of Toner Base m38

In the same flask as that used for the toner base M1 were placed 204 g of first resin particle dispersion RL2, 20 g of colorant particle dispersion PM1, 50 g of wax particle dispersion wa31, and 200 ml of ion-exchanged water, and then mixed under the same conditions as the toner base M1. Thus, a mixed particle dispersion was prepared. The pH of the mixed particle dispersion was 3.7.

The pH was increased to 9.7 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 80° C., and then the mixture was heat-treated further for 2 hours. The resultant dispersion had a pH of 6.8. Moreover, the temperature was raised to 90° C. and the dispersion was heat-treated for 2 hours to provide core particles.

After the water temperature was reduced to 60° C., 43 g of second resin particle dispersion RH4 for forming a shell was added, and the pH was adjusted to 3.4. This mixture was heated at 90° C. for 3 hours, thereby providing resin-fused particles.

After cooling, the reaction product (toner base) was filtered, washed, and dried under the same conditions as the toner base M1, resulting in a toner base m38 with a volume-average particle size of 12.8 μm and a coefficient of variation of 24.8.

(29) Preparation of Toner Base m39

In the same flask as that used for the toner base M1 were placed 204 g of first resin particle dispersion RL2, 20 g of colorant particle dispersion PM1, 50 g of wax particle dispersion wa32, and 200 ml of ion-exchanged water, and then mixed under the same conditions as the toner base M1. Thus, a mixed particle dispersion was prepared. The pH of the mixed particle dispersion was 2.8.

The pH was increased to 9.7 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 80° C., and then the mixture was heat-treated further for 2 hours to provide core particles. The resultant core particle dispersion had a pH of 6.9. Moreover, the temperature was raised to 90° C. and the dispersion was heat-treated for 2 hours to provide core particles.

After the water temperature was reduced to 60° C., 43 g of second resin particle dispersion RH4 for forming a shell was added, and the pH was adjusted to 3.4. This mixture was heated at 95° C. for 3 hours, thereby providing resin-fused particles.

After cooling, the reaction product (toner base) was filtered, washed, and dried under the same conditions as the toner base M1, resulting in a toner base m39 with a volume-average particle size of 18.1 μm and a coefficient of variation of 33.7.

(30) Preparation of Toner Base m40

In the same flask as that used for the toner base M1 were placed 204 g of first resin particle dispersion RL2, 20 g of colorant particle dispersion PM1, 50 g of wax particle dispersion wa33, and 200 ml of ion-exchanged water, and then mixed under the same conditions as the toner base M1. Thus, a mixed particle dispersion was prepared. The pH of the mixed particle dispersion was 3.2.

The pH was increased to 9.7 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 80° C., and then the mixture was heat-treated further for 2 hours to provide core particles. The resultant core particle dispersion had a pH of 7.0. Moreover, the temperature was raised to 90° C. and the dispersion was heat-treated for 2 hours to provide core particles.

After the water temperature was reduced to 60° C., 43 g of second resin particle dispersion RH4 for forming a shell was added, and the pH was adjusted to 5.0. This mixture was heated at 95° C. for 3 hours, thereby providing resin-fused particles.

After cooling, the reaction product (toner base) was filtered, washed, and dried under the same conditions as the toner base M1, resulting in a toner base m40 with a volume-average particle size of 20.7 μm and a coefficient of variation of 36.8.

(31) Preparation of Toner Base m41

In the same flask as that used for the toner base M1 were placed 204 g of first resin particle dispersion RL1, 20 g of colorant particle dispersion PM1, 50 g of wax particle dispersion wa34, and 200 ml of ion-exchanged water, and then mixed under the same conditions as the toner base M1. Thus, a mixed particle dispersion was prepared. The pH of the mixed particle dispersion was 3.8.

The pH was increased to 9.7 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 80° C., and then the mixture was heat-treated further for 2 hours to provide core particles. The resultant core particle dispersion had a pH of 6.8. Moreover, the temperature was raised to 90° C. and the dispersion was heat-treated for 2 hours to provide core particles.

After the water temperature was reduced to 60° C., 43 g of second resin particle dispersion RH4 for forming a shell was added, and the pH was adjusted to 2. This mixture was heated at 95° C. for 3 hours, thereby providing resin-fused particles.

After cooling, the reaction product (toner base) was filtered, washed, and dried under the same conditions as the toner base M1, resulting in a toner base m41 with a volume-average particle size of 22.4 μm and a coefficient of variation of 33.7.

(32) Preparation of Toner Base m42

In the same flask as that used for the toner base M1 were placed 204 g of first resin particle dispersion RL3, 20 g of colorant particle dispersion PM1, 55 g of wax particle dispersion wa35, and 200 ml of ion-exchanged water, and then mixed under the same conditions as the toner base M1. Thus, a mixed particle dispersion was prepared, The pH of the mixed particle dispersion was 2.2

The pH was increased to 9.0 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 80° C., and then the mixture was heat-treated further for 2 hours to provide core particles. The resultant core particle dispersion had a pH of 6.0. Moreover, the temperature was raised to 90° C. and the dispersion was heat-treated for 2 hours to provide core particles.

After the water temperature was reduced to 60° C., 43 g of second resin particle dispersion RH4 for forming a shell was added, and the pH was adjusted to 2. This mixture was heated at 90° C. for 3 hours, thereby providing resin-fused particles.

After cooling, the reaction product (toner base) was filtered, washed, and dried under the same conditions as the toner base M1, resulting in a toner base m42 with a volume-average particle size of 20.8 μm and a coefficient of variation of 30.8.

(33) Preparation of Toner Base m43

In the same flask as that used for the toner base M1 were placed 204 g of first resin particle dispersion RL1, 20 g of colorant particle dispersion PM1, 50 g of wax particle dispersion wa36, and 200 ml of ion-exchanged water, and then mixed under the same conditions as the toner base M1. Thus, a mixed particle dispersion was prepared. The pH of the mixed particle dispersion was 5.8.

The pH was increased to 9.7 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 80° C., and then the mixture was heat-treated further for 2 hours to provide core particles. The resultant core particle dispersion had a pH of 6.8. Moreover, the temperature was raised to 90° C. and the dispersion was heat-treated for 2 hours to provide core particles.

After the water temperature was reduced to 60° C., 43 g of second resin particle dispersion RH4 for forming a shell was added, and the pH was adjusted to 2.0. This mixture was heated at 95° C. for 3 hours, thereby providing resin-fused particles.

After cooling, the reaction product (toner base) was filtered, washed, and dried under the same conditions as the toner base M1, resulting in a toner base m43 with a volume-average particle size of 18.4 μm and a coefficient of variation of 34.7.

(34) Preparation of Toner Base m44

In the same flask as that used for the toner base M1 were placed 204 g of first resin particle dispersion RL3, 20 g of colorant particle dispersion PM1, 55 g of wax particle dispersion wa37, and 200 ml of ion-exchanged water, and then mixed under the same conditions as the toner base M1. Thus, a mixed particle dispersion was prepared. The pH of the mixed particle dispersion was 2.2.

The pH was increased to 9.0 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 80° C., and then the mixture was heat-treated further for 2 hours to provide core particles. The resultant core particle dispersion had a pH of 6.0. Moreover, the temperature was raised to 90° C. and the dispersion was heat-treated for 2 hours to provide core particles.

After the water temperature was reduced to 60° C., 43 g of second resin particle dispersion RH4 for forming a shell was added, and the pH was adjusted to 2.0. This mixture was heated at 90° C. for 3 hours, thereby providing resin-fused particles.

After cooling, the reaction product (toner base) was filtered, washed, and dried under the same conditions as the toner base M1, resulting in a toner base m44 with a volume-average particle size of 19.2 μm and a coefficient of variation of 31.2.

(35) Preparation of Toner Base m45

In the same flask as that used for the toner base M1 were placed 204 g of first resin particle dispersion RL2, 30 g of colorant particle dispersion pm3, 50 g of wax particle dispersion WA7, and 300 ml of ion-exchanged water, and then mixed under the same conditions as the toner base M1. Thus, a mixed particle dispersion was prepared. The pH of the mixed particle dispersion was 3.2.

The pH was increased to 11.7 by adding 1N NaOH to the mixed particle dispersion. Subsequently, 281 g of magnesium sulfate aqueous solution (23 wt % concentration) was added and stirred for 10 minutes. After the temperature was raised from 20° C. to 90° C. at a rate of 1° C./min, the mixture was heat-treated for 3 hours to provide core particles. The resultant core particle dispersion had a pH of 9.2. Moreover, the water temperature was raised to 90° C., and 43 g of second resin particle dispersion RH4 having a pH of 5 was added at a dropping rate of 5 g/min. After the dropping was finished, the mixture was heated at 95° C. for 2 hours, thereby providing particles fused with the second resin particles. Then, the reaction product (toner base) was filtered, washed, and dried under the same conditions as the toner base M1, resulting in a toner base m45 with a volume-average particle size of 8.2 μm and a coefficient of variation of 26.8. The toner base m45 had a slightly broader particle size distribution.

(36) Preparation of Toner Base m46

In the same flask as that used for the toner base M1 were placed 204 g of first resin particle dispersion RL2, 30 g of colorant particle dispersion pm4, 50 g of wax particle dispersion WAY, and 300 ml of ion-exchanged water, and then mixed under the same conditions as the toner base M1. Thus, a mixed particle dispersion was prepared. The pH of the mixed particle dispersion was 3.2.

The pH was increased to 11.7 by adding 1N NaOH to the mixed particle dispersion. Subsequently, 281 g of magnesium sulfate aqueous solution (23 wt % concentration) was added and stirred for 10 minutes. After the temperature was raised from 20° C. to 90° C. at a rate of 1° C./min, the mixture was heat-treated for 3 hours to provide core particles. The resultant core particle dispersion had a pH of 9.2.

Moreover, the water temperature was raised to 90° C., and 43 g of second resin particle dispersion RH4 having a pH of 5 was added at a dropping rate of 5 g/min. After the dropping was finished, the mixture was heated at 95° C. for 2 hours, thereby providing particles fused with the second resin particles. Then, the reaction product (toner base) was filtered, washed, and dried under the same conditions as the toner base M1, resulting in a toner base m46 with a volume-average particle size of 11.4 μm and a coefficient of variation of 33.9. The toner base m46 had a broader particle size distribution.

Figure 7:
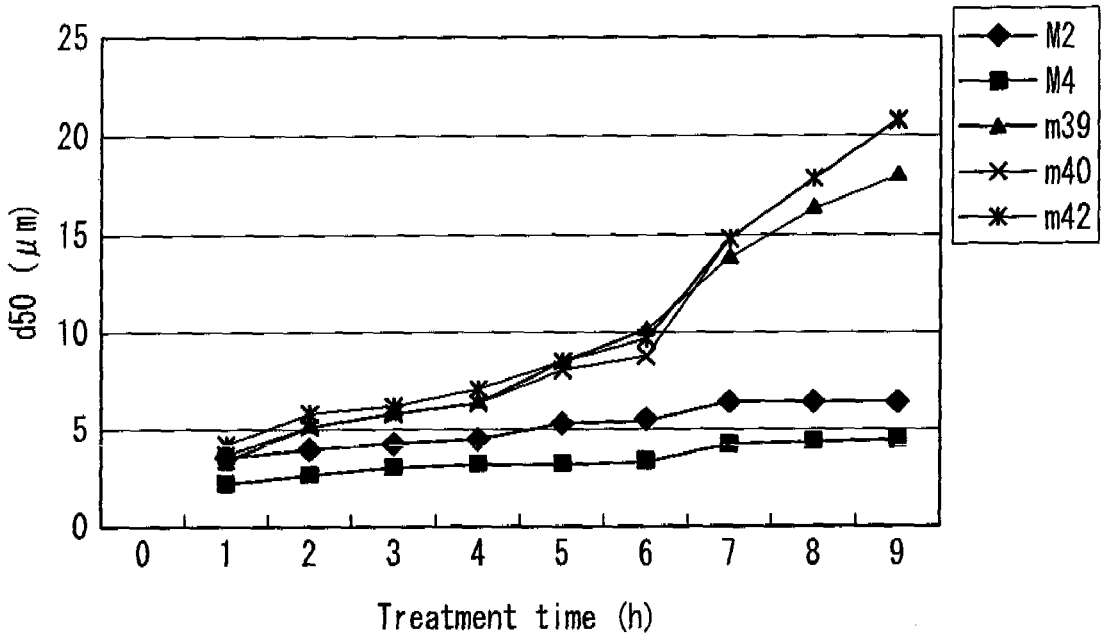
FIG. 7 is a graph showing the progression of a particle size of toner used in an example of the present invention.

Tables 15, 16, and 17 show the pH, temperature, and volume-average particle size (d50 (μm)) in the aqueous medium. FIG. 7 shows changes in particle size of the toner bases M2, M4, m39, m40, and m42 with treatment time. As shown in FIG. 7, the particle size changes of M2 and M4 are relatively stable. However, the particle size of m39, m40, and m42 is likely to be larger after the fusion reaction of the shell resin in the latter part of the treatment.

TABLE 15

| Toner base | | Treatment time (h) | | | | | | | | | |
|---|---|---|---|---|---|---|---|---|---|---|---|
| particles | | 0 | 1 | 2 | 3 | 4 | 5 | 6 | 7 | 8 | 9 |
| M1 | pH | 11.8 | | | | 9.2 | 6.6 | | 6.6 | | |
| | temperature (° C.) | | 70° C. | 70° C. | 80° C. | 80° C. | 90° C. | 90° C. | 95° C. | 95° C. | 95° C. |
| | d50 (μm) | | 2.46 | 2.71 | 2.88 | 3.01 | 3.04 | 3.08 | 4.11 | 4.17 | 4.21 |
| M2 | pH | 9.7 | | | | 7.2 | | | 3.4 | | |
| | temperature (° C.) | | 70° C. | 70° C. | 80° C. | 80° C. | 90° C. | 90° C. | 95° C. | 95° C. | 95° C. |
| | d50 (μm) | | 3.57 | 4.08 | 4.28 | 4.58 | 5.27 | 5.41 | 6.38 | 6.48 | 6.51 |
| M3 | pH | 11 | | | | 8.4 | 5.4 | | 5.4 | | |
| | temperature (° C.) | | 70° C. | 70° C. | 85° C. | 85° C. | 90° C. | 90° C. | 95° C. | 95° C. | 95° C. |
| | d50 (μm) | | 2.89 | 3.42 | 3.68 | 3.78 | 3.81 | 3.98 | 4.82 | 4.89 | 4.92 |
| M4 | pH | 11.9 | | | | 9.3 | 3.2 | | 3.4 | | |
| | temperature (° C.) | | 70° C. | 70° C. | 80° C. | 80° C. | 90° C. | 90° C. | 95° C. | 95° C. | 95° C. |
| | d50 (μm) | | 2.28 | 2.68 | 3.07 | 3.17 | 3.28 | 3.37 | 4.24 | 4.31 | 4.44 |
| M5 | pH | 9.7 | | | | 7 | | | 3.4 | | |
| | temperature (° C.) | | 70° C. | 70° C. | 85° C. | 85° C. | 90° C. | 90° C. | 90° C. | 90° C. | 90° C. |
| | d50 (μm) | | 4.08 | 4.58 | 4.75 | 4.87 | 5.59 | 5.67 | 6.57 | 6.64 | 6.72 |
| M6 | pH | 10.5 | | | | 7.9 | 3.2 | | 3.4 | | |
| | temperature (° C.) | | 70° C. | 70° C. | 85° C. | 85° C. | 90° C. | 90° C. | 90° C. | 90° C. | 90° C. |
| | d50 (μm) | | 3.42 | 3.68 | 3.98 | 4.08 | 4.18 | 4.19 | 5.18 | 5.21 | 5.24 |
| M7 | pH | 11.2 | | | | 8.6 | 3.2 | | 3.4 | | |
| | temperature (° C.) | | 70° C. | 70° C. | 85° C. | 85° C. | 90° C. | 90° C. | 90° C. | 90° C. | 90° C. |
| | d50 (μm) | | 2.89 | 3.08 | 3.29 | 3.38 | 3.45 | 3.49 | 4.58 | 4.62 | 4.63 |
| M8 | pH | 11.6 | | | | 8.9 | 3.2 | | 3.4 | | |
| | temperature (° C.) | | 70° C. | 70° C. | 85° C. | 85° C. | 90° C. | 90° C. | 90° C. | 90° C. | 90° C. |
| | d50 (μm) | | 2.38 | 2.61 | 2.67 | 2.68 | 2.78 | 2.81 | 3.88 | 3.98 | 4.1 |
| M9 | pH | 10.8 | | | | 8.1 | 3.2 | | 3.4 | | |
| | temperature (° C.) | | 70° C. | 70° C. | 85° C. | 85° C. | 90° C. | 90° C. | 90° C. | 90° C. | 90° C. |
| | d50 (μm) | | 3.21 | 3.58 | 3.62 | 3.62 | 3.87 | 3.99 | 5.09 | 5.11 | 5.12 |
| M10 | pH | 10.7 | | | | 7.9 | 3.2 | | 3.4 | | |
| | temperature (° C.) | | 70° C. | 70° C. | 85° C. | 85° C. | 90° C. | 90° C. | 90° C. | 90° C. | 90° C. |
| | d50 (μm) | | 3.18 | 3.48 | 3.88 | 3.89 | 4.08 | 4.18 | 5.18 | 5.31 | 5.32 |

TABLE 16

| Toner base particles | | Treatment time (h) 0 | 1 | 2 | 3 | 4 | 5 | 6 | 7 | 8 | 9 |
|---|---|---|---|---|---|---|---|---|---|---|---|
| M11 | pH | 11.8 | | | | 9.2 | 6.6 | | 6.6 | | |
| | temperature (° C.) | | 70° C. | 70° C. | 80° C. | 80° C. | 90° C. | 90° C. | 95° C. | 95° C. | 95° C. |
| | d50 (μm) | | 2.56 | 2.68 | 2.89 | 3.01 | 3.24 | 3.34 | 4.32 | 4.35 | 4.41 |
| M12 | pH | 9.7 | | | | 7.2 | | | 3.4 | | |
| | temperature (° C.) | | 70° C. | 70° C. | 80° C. | 80° C. | 90° C. | 90° C. | 95° C. | 95° C. | 95° C. |
| | d50 (μm) | | 3.28 | 3.34 | 3.87 | 3.98 | 4.89 | 5.27 | 6.19 | 6.28 | 6.32 |
| M13 | pH | 11.2 | | | | 8.5 | 5.4 | | 5 | | 8.6 |
| | temperature (° C.) | | 70° C. | 70° C. | 85° C. | 85° C. | 90° C. | 90° C. | 95° C. | 95° C. | 95° C. |
| | d50 (μm) | | 2.87 | 3.42 | 3.54 | 3.67 | 3.78 | 3.82 | 4.81 | 4.89 | 5.01 |
| M14 | pH | 11.9 | | | | 9.3 | 3.2 | | 3.4 | | |
| | temperature (° C.) | | 70° C. | 70° C. | 80° C. | 80° C. | 90° C. | 90° C. | 95° C. | 95° C. | 95° C. |
| | d50 (μm) | | 2.04 | 2.57 | 2.67 | 2.89 | 3.02 | 3.18 | 4.3 | 4.34 | 4.42 |
| M15 | pH | 9.7 | | | | 7 | | | 3.4 | | 5.4 |
| | temperature (° C.) | | 70° C. | 70° C. | 85° C. | 85° C. | 90° C. | 90° C. | 90° C. | 90° C. | 90° C. |
| | d50 (μm) | | 3.07 | 4.08 | 4.27 | 4.57 | 5.29 | 5.37 | 6.48 | 6.56 | 6.64 |
| M16 | pH | 11.2 | | | | 8.3 | 3.2 | | 3.4 | | |
| | temperature (° C.) | | 70° C. | 70° C. | 85° C. | 85° C. | 90° C. | 90° C. | 90° C. | 90° C. | 90° C. |
| | d50 (μm) | | 2.04 | 2.57 | 2.67 | 2.89 | 3.02 | 3.18 | 4.3 | 4.34 | 4.42 |
| M17 | pH | 11.2 | | | | 8.6 | 3.2 | | 3.4 | | |
| | temperature (° C.) | | 70° C. | 70° C. | 85° C. | 85° C. | 90° C. | 90° C. | 90° C. | 90° C. | 90° C. |
| | d50 (μm) | | 2.35 | 2.84 | 2.98 | 3.08 | 3.37 | 3.47 | 4.67 | 4.78 | 4.82 |
| M18 | pH | 11.6 | | | | 8.9 | 3.2 | | 3.4 | | |
| | temperature (° C.) | | 70° C. | 70° C. | 85° C. | 85° C. | 90° C. | 90° C. | 90° C. | 90° C. | 90° C. |
| | d50 (μm) | | 2.07 | 2.28 | 2.34 | 2.48 | 2.57 | 2.68 | 3.75 | 3.78 | 3.9 |
| M19 | pH | 11.2 | | | | 8.5 | 3.2 | | 3.4 | | |
| | temperature (° C.) | | 70° C. | 70° C. | 85° C. | 85° C. | 90° C. | 90° C. | 90° C. | 90° C. | 90° C. |
| | d50 (μm) | | 2.64 | 2.98 | 3.34 | 3.48 | 3.75 | 3.89 | 5.01 | 5.03 | 5.13 |

TABLE 17

| Toner base particles | | Treatment time (h) 0 | 1 | 2 | 3 | 4 | 5 | 6 | 7 | 8 | 9 |
|---|---|---|---|---|---|---|---|---|---|---|---|
| m38 | pH | 9.7 | | | | 6.8 | | | 3.4 | | |
| | temperature (° C.) | | 70° C. | 70° C. | 80° C. | 80° C. | 90° C. | 90° C. | 90° C. | 90° C. | 90° C. |
| | d50 (μm) | | 3.08 | 4.25 | 5.38 | 5.68 | 7.89 | 8.24 | 9.57 | 10.87 | 12.83 |
| m39 | pH | 9.7 | | | | 6.9 | | | 3.4 | | |
| | temperature (° C.) | | 70° C. | 70° C. | 80° C. | 80° C. | 90° C. | 90° C. | 95° C. | 95° C. | 95° C. |
| | d50 (μm) | | 3.57 | 5.48 | 6.08 | 6.48 | 8.57 | 10.28 | 13.78 | 16.48 | 18.12 |
| m40 | pH | 9.7 | | | | 7 | | | 5 | | |
| | temperature (° C.) | | 70° C. | 70° C. | 80° C. | 80° C. | 90° C. | 90° C. | 95° C. | 95° C. | 95° C. |
| | d50 (μm) | | 3.98 | 5.48 | 6.24 | 6.42 | 8.08 | 8.98 | 14.89 | 17.8 | 20.73 |
| m41 | pH | 9.7 | | | | 6.8 | | | 2 | | |
| | temperature (° C.) | | 70° C. | 70° C. | 80° C. | 80° C. | 90° C. | 90° C. | 95° C. | 95° C. | 95° C. |
| | d50 (μm) | | 3.98 | 5.07 | 6.08 | 6.48 | 8.28 | 8.97 | 15.47 | 18.97 | 22.4 |
| m42 | pH | 9 | | | | 6 | | | 2 | | |
| | temperature (° C.) | | 70° C. | 70° C. | 80° C. | 80° C. | 90° C. | 90° C. | 90° C. | 90° C. | 90° C. |
| | d50 (μm) | | 4.28 | 5.89 | 6.28 | 7.08 | 8.48 | 9.78 | 14.82 | 17.89 | 20.81 |
| m43 | pH | 9.7 | | | | 6.8 | | | 2 | | |
| | temperature (° C.) | | 70° C. | 70° C. | 80° C. | 80° C. | 90° C. | 90° C. | 95° C. | 95° C. | 95° C. |
| | d50 (μm) | | 3.67 | 5.08 | 5.48 | 5.89 | 7.28 | 7.89 | 13.27 | 16.78 | 18.44 |
| m44 | pH | 9 | | | | 6 | | | 2 | | |
| | temperature (° C.) | | 70° C. | 70° C. | 80° C. | 80° C. | 90° C. | 90° C. | 90° C. | 90° C. | 90° C. |
| | d50 (μm) | | 3.27 | 4.98 | 5.67 | 6.08 | 8.38 | 8.79 | 12.67 | 15.87 | 19.23 |

Table 18 shows the additives used in this example. The amount of charge was measured by a blow-off method using frictional charge with an uncoated ferrite carrier. Under the environmental conditions of 25° C. and 45% RH, 50 g of carrier and 0.1 g of silica or the like were mixed in a 100 ml polyethylene container, and then stirred by vertical rotation at a speed of 100 $min^{-1}$ for 5 minutes and 30 minutes, respectively. Thereafter, 0.3 g of sample was taken for each stirring time, and a nitrogen gas was blown on the samples at $1.96\times10^4$ (Pa) for 1 minute.

TABLE 18

| Inorganic fine powder | Material | Treatment material A | Treatment material B | Particle size (nm) | Methanol titration (%) | Moisture absorption (wt %) | Ignition loss (wt %) | Drying loss (wt %) | 5-min value | 30-min value | 5-min/ 30-min value |
|---|---|---|---|---|---|---|---|---|---|---|---|
| S1 | Silica | Silica treated with dimethylpolysiloxane | | 6 | 88 | 0.1 | 10.5 | 0.2 | −820 | −710 | 86.6 |
| S2 | Silica | Silica treated with methyl hydrogen polysiloxane | | 16 | 88 | 0.1 | 5.5 | 0.2 | −560 | −450 | 80.4 |
| S3 | Silica | Methyl hydrogen polysiloxane (1) | | 40 | 88 | 0.1 | 10.8 | 0.2 | −580 | −480 | 82.8 |
| S4 | Silica | Dimethylpolysiloxane (20) | Aluminium distearate (2) | 40 | 84 | 0.09 | 24.5 | 0.2 | −740 | −580 | 78.4 |
| S5 | Silica | Methyl hydrogen polysiloxane (1) | Stearic acid amide (1) | 40 | 88 | 0.1 | 10.8 | 0.2 | −580 | −480 | 82.8 |
| S6 | Silica | Dimethylpolysiloxan (2) | Fatty acid pentaerythritol monoester (1) | 80 | 88 | 0.12 | 15.8 | 0.2 | −620 | −475 | 76.6 |
| S7 | Silica | Methyl hydrogen polysiloxane (1) | | 150 | 89 | 0.10 | 6.8 | 0.2 | −580 | −480 | 82.8 |
| S8 | Titanium oxide | Diphenylpolysiloxan (10) | Sodium stearate (1) | 80 | 88 | 0.1 | 18.5 | 0.2 | −750 | −650 | 86.7 |
| S9 | Silica | Silica treated with hexamethyldisilazane | | 16 | 68 | 0.60 | 1.6 | 0.2 | −800 | −620 | 77.5 |

It is preferable that the 5-minute value is −100 to −800 μC/g and the 30-minute value is −50 to −600 μC/g for the negative chargeability. Silica having a high charge amount can function well in a small quantity.

Tables 19 and 20 show the toner material compositions used in this example. The compositions of black toner, cyan toner, and yellow toner were the same as the composition of magenta toner except for pigment, i.e., PB1, PC1, and PY1 were used for the black toner, the cyan toner, and the yellow toner, respectively.

TABLE 19

| Toner | Toner base | Additive A | Additive B | Additive C |
|---|---|---|---|---|
| TM1 | M1 | S1 (0.6) | S3 (2.5) | |
| TM2 | M2 | S2 (1.8) | S4 (1.5) | |
| TM3 | M3 | S1 (1.8) | S5 (1.2) | |
| TM4 | M4 | S2 (2.5) | | |
| TM5 | M5 | S1 (2.0) | S6 (2.0) | |
| TM6 | M6 | S2 (1.8) | S7 (3.5) | |
| TM7 | M7 | S1 (0.6) | S8 (2.0) | |
| TM8 | M8 | S1 (0.6) | S7 (3.5) | |
| TM9 | M9 | S2 (1.0) | S8 (2.5) | |
| TM10 | M10 | S2 (1.0) | S8 (2.5) | S7 (1.5) |
| TM11 | M11 | S1 (0.6) | S3 (2.5) | |
| TM12 | M12 | S2 (1.8) | S4 (1.5) | |
| TM13 | M13 | S1 (1.8) | S5 (1.2) | |
| TM14 | M14 | S2 (2.5) | | |
| TM15 | M15 | S1 (2.0) | S6 (2.0) | |
| TM16 | M16 | S2 (1.8) | S7 (3.5) | |
| TM17 | M17 | S1 (0.6) | S8 (2.0) | |
| TM18 | M18 | S1 (0.6) | S7 (3.5) | |
| TM19 | M19 | S2 (1.0) | S8 (2.5) | |
| TM20 | M20 | S1 (0.6) | S8 (2.0) | |

TABLE 20

| Toner | Toner base | Additive A |
|---|---|---|
| tm31 | m31 | S1 (1.0) |
| tm32 | m32 | S2 (1.0) |
| tm33 | m33 | S9 (1.0) |
| tm38 | m38 | S9 (0.5) |
| tm39 | m39 | S9 (0.5) |

TABLE 20-continued

| Toner | Toner base | Additive A |
|---|---|---|
| tm40 | m40 | S9 (0.5) |
| tm41 | m41 | S9 (0.5) |
| tm42 | m42 | S9 (0.5) |
| tm43 | m43 | S9 (0.5) |
| tm44 | m44 | S9 (0.5) |

FIG. 1 is a cross-sectional view showing the configuration of a full color image forming apparatus used in this example. In FIG. 1, the outer housing of a color electrophotographic printer is not shown. A transfer belt unit 17 includes a transfer belt 12, a first color (yellow) transfer roller 10Y, a second color (magenta) transfer roller 10M, a third color (cyan) transfer roller 10C, a fourth color (black) transfer roller 10K, a driving roller 11 made of aluminum, a second transfer roller 14 made of an elastic body, a second transfer follower roller 13, a belt cleaner blade 16 for cleaning a toner image that remains on the transfer belt 12, and a roller 15 located opposite to the belt cleaner blade 16. The first to fourth color transfer rollers 10Y, 10M, 10C, and 10K are made of an elastic body. A distance between the first color (Y) transfer position and the second color (M) transfer position is 70 mm (which is the same as a distance between the second color (M) transfer position and the third color (C) transfer position and a distance between the third color (C) transfer position and the fourth color (K) transfer position). The circumferential velocity of a photoconductive member is 125 mm/s.

The transfer belt 12 was obtained in the following manner: 5 parts by weight of a conductive carbon (e.g., "KETJEN- BLACK") were added to 95 parts by weight of an insulating resin such as a polycarbonate resin (e.g., European Z300 manufactured by Mitsubishi Gas Kagaku Co., Ltd.) and then kneaded to form a film using an extruder. The surface of the film was coated with a fluorocarbon resin. The film had a thickness of about 100 μm, a volume resistance of $10^7$ to $10^{12}\Omega\cdot$cm, and a surface resistance of $10^7$ to $10^{12}\Omega/\square$ (square). The use of this film can improve the dot reproducibility. When the volume resistance is less than $10^7\Omega\cdot$cm, retransfer is likely to occur. When the volume resistance is more than $10^{12}\Omega\cdot$cm, the transfer efficiency is degraded.

A first transfer roller 10 is a conductive polyurethane foam including carbon black and has an outer diameter of 8 mm. The resistance value is $10^2$ to $10^6\Omega$. In the first transfer operation, the first transfer roller 10 is pressed against a photoconductive member 1 with a force of about 1.0 to 9.8 (N) via the transfer belt 12, so that the toner is transferred from the photoconductive member 1 to the transfer belt 12. When the resistance value is less than $10^2\Omega$, retransfer is likely to occur. When the resistance value is more than $10^6\Omega$, a transfer failure is likely to occur. The force less than 1.0 (N) may cause a transfer failure, and the force more than 9.8 (N) may cause transfer voids.

The second transfer roller 14 is a conductive polyurethane foam including carbon black and has an outer diameter of 10 mm. The resistance value is $10^2$ to $10^6\Omega$. The second transfer roller 14 is pressed against the follower roller 13 via the transfer belt 12 and a transfer medium 19 such as a paper or OHP sheet. The follower roller 13 is rotated in accordance with the movement of the transfer belt 12. In the second transfer operation, the second transfer roller 14 is pressed against the follower roller 13 with a force of 5.0 to 21.8 (N), so that the toner is transferred from the transfer belt 12 to the transfer medium 19. When the resistance value is less than $10^2\Omega$, retransfer is likely to occur. When the resistance value is more than $10^6\Omega$, a transfer failure is likely to occur. The force less than 5.0 (N) may cause a transfer failure, and the force more than 21.8 (N) may increase the load and generate jitter easily.

Four image forming units 18Y, 18M, 18C, and 18K for yellow (Y), magenta (M), cyan (C), and black (K) are arranged in series, as shown in FIG. 1.

The image forming units 18Y, 18M, 18C, and 18K have the same components except for a developer contained therein. For simplification, only the image forming unit 18Y for yellow (Y) will be described, and an explanation of the other units will not be repeated.

The image forming unit is configured as follows. Reference numeral 1 is a photoconductive member, 3 is pixel laser signal light, and 4 is a developing roller of aluminum that has an outer diameter of 10 mm and includes a magnet with a magnetic force of 1200 gauss. The developing roller 4 is located opposite to the photoconductive member 1 with a gap of 0.3 mm between them, and rotates in the direction of the arrow. A stirring roller 6 stirs toner and a carrier in a developing unit and supplies the toner to the developing roller 4. The mixing ratio of the toner to the carrier is read from a permeability sensor (not shown), and the toner is supplied timely from a toner hopper (not shown). A magnetic blade 5 is made of metal and controls a magnetic brush layer of a developer on the developing roller 4. In this example, 150 g of developer was introduced, and the gap was 0.4 mm. Although a power supply is not shown in FIG. 1, a direct voltage of −500 V and an alternating voltage of 1.5 kV (p-p) at a frequency of 6 kHz were applied to the developing roller 4. The circumferential velocity ratio of the photoconductive member 1 to the developing roller 4 was 1:1.6. The mixing ratio of the toner to the carrier was 93:7. The amount of developer in the developing unit was 150 g.

A charging roller 2 is made of epichlorohydrin rubber and has an outer diameter of 10 mm. A direct-current bias of −1.2 kV is applied to the charging roller 2 for charging the surface of the photoconductive member 1 to −600 V. Reference numeral 8 is a cleaner, 9 is a waste toner box, and 7 is a developer.

A paper is conveyed from the lower side of the transfer belt unit 17, and a paper conveying path is formed so that a paper 19 is transported by a paper feed roller (not shown) to a nip portion where the transfer belt 12 and the second transfer roller 14 are pressed against each other.

The toner is transferred from the transfer belt 12 to the paper 19 by +1000 V applied to the second transfer roller 14, and then is conveyed to a fixing portion in which the toner is fixed. The fixing portion includes a fixing roller 201, a pressure roller 202, a fixing belt 203, a heat roller 204, and an induction heater 205.

Figure 2:
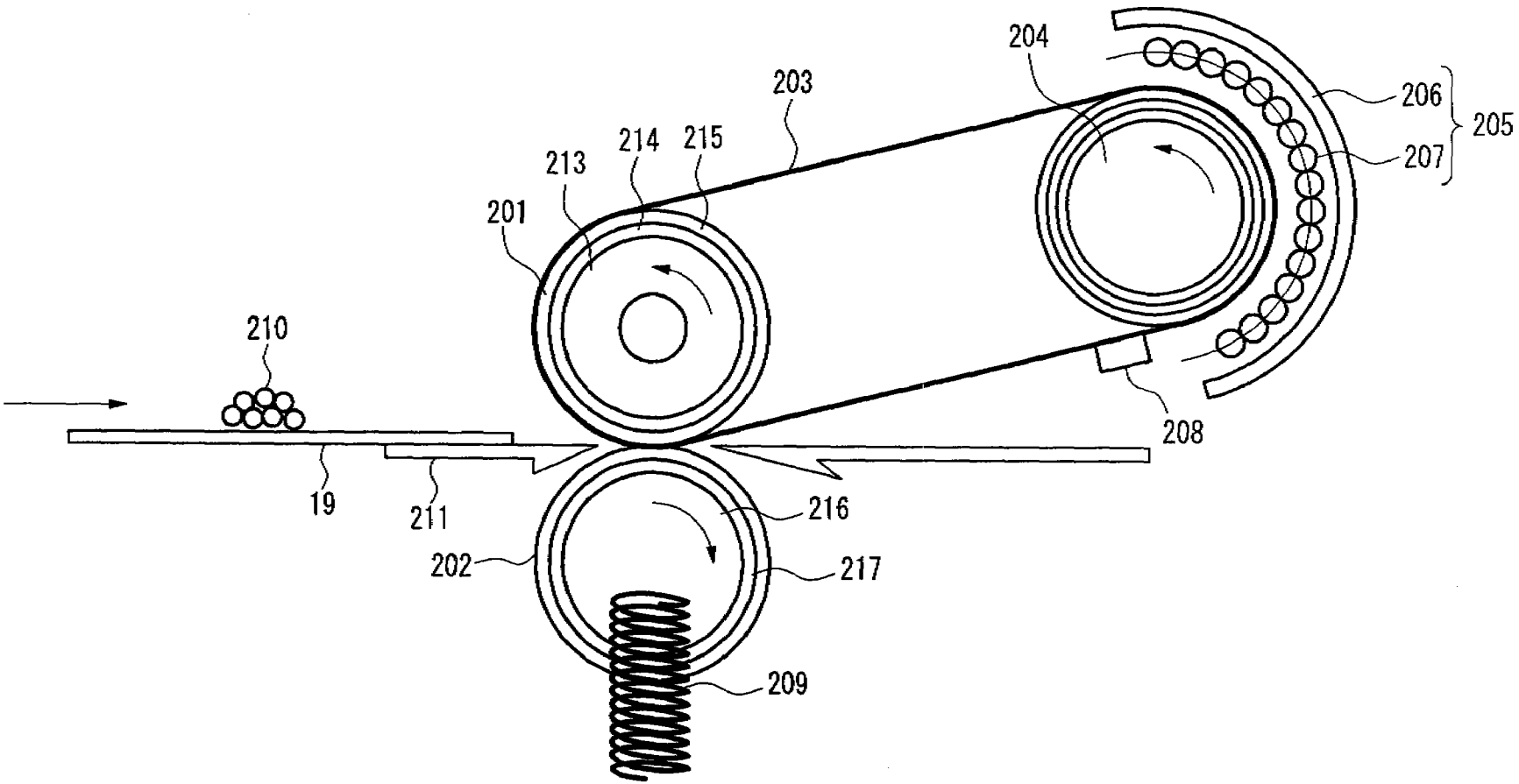
FIG. 2 is a cross-sectional view showing the configuration of a fixing unit used in an example of the present invention.

FIG. 2 shows a fixing process. A belt 203 runs between the fixing roller 201 and the heat roller 204. A predetermined load is applied between the fixing roller 201 and the pressure roller 202 so that a nip is formed between the belt 203 and the pressure roller 202. The induction heater 205 including a ferrite core 206 and a coil 207 is provided on the periphery of the heat roller 204, and a temperature sensor 208 is arranged on the outer surface.

The belt 203 is formed by arranging a Ni substrate (30 μm), silicone rubber (150 μm), and PFA (tetrafluoroethylene-perfluoroalkyl vinyl ether copolymer) (30 μm) in layers.

The pressure roller 202 is pressed against the fixing roller 201 by a spring 209. A recording material 19 with the toner 210 is moved along a guide plate 211.

The fixing roller 201 (fixing member) includes a hollow core 213, an elastic layer 214 formed on the hollow core 213, and a silicone rubber layer 215 formed on the elastic layer 214. The hollow core 213 is made of aluminum and has a length of 250 mm, an outer diameter of 14 mm, and a thickness of 1 mm. The elastic layer 214 is made of silicone rubber with a rubber hardness (JIS-A) of 20 degrees based on the JIS standard and has a thickness of 3 mm. The silicone rubber layer 215 has a thickness of 3 mm. Therefore, the outer diameter of the fixing roller 201 is about 26 mm. The fixing roller 201 is rotated at 125 mm/s by receiving a driving force from a driving motor (not shown).

The heat roller 204 includes a hollow pipe having a thickness of 1 mm and an outer diameter of 20 mm. The surface temperature of the fixing belt is controlled to 170° C. by using a thermistor.

The pressure roller 202 (pressure member) has a length of 250 mm and an outer diameter of 20 mm, and includes a hollow core 216 and an elastic layer 217 formed on the hollow core 216. The hollow core 216 is made of aluminum and has an outer diameter of 16 mm and a thickness of 1 mm. The elastic layer 217 is made of silicone rubber with a rubber hardness (JIS-A) of 55 degrees based on the JIS standard and has a thickness of 2 mm, The pressure roller 202 is mounted rotatably, and a 5.0 mm width nip is formed between the pressure roller 202 and the fixing roller 201 under a one-sided load of 147 N given by the spring 209.

The operations will be described below. In the full color mode, all the first transfer rollers 10 of Y, M, C, and K are lifted and pressed against the respective photoconductive members 1 of the image forming units via the transfer belt 12. At this time, a direct-current bias of +800 V is applied to each of the first transfer rollers 10. An image signal is transmitted through the laser beam 3 and enters the photoconductive member 1 whose surface has been charged by the charging roller 2, thus forming an electrostatic latent image. The electrostatic latent image formed on the photoconductive member 1 is made visible by the toner on the developing roller 4 that is rotated in contact with the photoconductive member 1.

In this case, the image formation rate (125 mm/s, which is equal to the circumferential velocity of the photoconductive member) of the image forming unit 18Y is set so that the speed of the photoconductive member is 0.5 to 1.5% slower than the traveling speed of the transfer belt 12.

In the image forming process, signal light 3Y is input to the image forming unit 18Y, and an image is formed with Y toner. At the same time as the image formation, the Y toner image is transferred from the photoconductive member 1Y to the transfer belt 12 by the action of the first transfer roller 10Y, to which a direct voltage of +800 V is applied.

There is a time lag between the first transfer of the first color (Y) and the first transfer of the second color (M). Then, signal light 3M is input to the image forming unit 18M, and an image is formed with M toner. At the same time as the image formation, the M toner image is transferred from the photoconductive member 1M to the transfer belt 12 by the action of the first transfer roller 10M. In this case, the M toner is transferred onto the first color (Y) toner that has been formed on the transfer bolt 12. Subsequently, the C (cyan) toner and K (black) toner images are formed in the same manner and transferred by the action of the first transfer rollers 10C and 10K. Thus, YMCK toner images are formed on the transfer belt 12. This is a so-called tandem process.

A color image is formed on the transfer belt 12 by superimposing the four color toner images in registration. After the last transfer of the K toner image, the four color toner images are transferred collectively to the paper 19 fed by a feeding cassette (not shown) at matched timing by the action of the second transfer roller 14. In this case, the follower roller 13 is grounded, and a direct voltage of +1 kV is applied to the second transfer roller 14. The toner images transferred to the paper 19 are fixed by a pair of fixing rollers 201 and 202. Then, the paper 19 is ejected through a pair of ejecting rollers (not shown) to the outside of the apparatus. The toner that is not transferred and remains on the transfer belt 12 is cleaned by the belt cleaner blade 16 to prepare for the next image formation.

Tables 21 and 22 show the results of visual images formed by the electrophotographic apparatus in FIG. 1. The results were evaluated by the following criteria: filming of the toner on a photoconductive member; a change in image density before and after the durability test; the state of fog that indicates the degree of adhesion of the toner to a non-image portion; uniformity of a solid image; transfer scattering or so-called transfer voids (part of the toner is not transferred and remains on a photoconductive member) in the character portion of a full color image with three colors (magenta, cyan, and yellow) of toner; and reverse transfer in which yellow or magenta toner that has been previously transferred adheres back to the photoconductive member at the time of subsequent transfer of magenta, cyan, or black toner.

TABLE 21

| Developer | Toner | Carrier | Filming on photoconductive member | Image density (ID) initial/after test | Fog | Uniformity of solid image | Transfer skipping in characters | Reverse transfer | Transfer voids |
|---|---|---|---|---|---|---|---|---|---|
| DM11 | TM1 | A1 | Not occur | 1.43/1.42 | ○ | ○ | ○ | ○ | ○ |
| DM12 | TM2 | B1 | Not occur | 1.47/1.49 | ○ | ○ | ○ | ○ | ○ |
| DM13 | TM3 | C1 | Not occur | 1.44/1.46 | ○ | ○ | ○ | ○ | ○ |
| DM14 | TM4 | A2 | Not occur | 1.32/1.31 | ○ | ○ | ○ | ○ | ○ |
| DM15 | TM5 | A1 | Not occur | 1.43/1.41 | ○ | ○ | ○ | ○ | ○ |
| DM16 | TM6 | B1 | Not occur | 1.48/1.42 | ○ | ○ | ○ | ○ | ○ |
| DM17 | TM7 | C1 | Not occur | 1.49/1.43 | ○ | ○ | ○ | ○ | ○ |
| DM18 | TM8 | A2 | Not occur | 1.38/1.32 | ○ | ○ | ○ | ○ | ○ |
| DM19 | TM9 | A2 | Not occur | 1.37/1.32 | ○ | ○ | ○ | ○ | ○ |
| DM20 | TM10 | A1 | Not occur | 1.45/1.42 | ○ | ○ | ○ | ○ | ○ |
| DM11 | TM11 | A1 | Not occur | 1.45/1.44 | ○ | ○ | ○ | ○ | ○ |
| DM12 | TM12 | B1 | Not occur | 1.43/1.48 | ○ | ○ | ○ | ○ | ○ |
| DM13 | TM13 | C1 | Not occur | 1.41/1.42 | ○ | ○ | ○ | ○ | ○ |
| DM14 | TM14 | A2 | Not occur | 1.31/1.33 | ○ | ○ | ○ | ○ | ○ |
| DM15 | TM15 | A1 | Not occur | 1.41/1.44 | ○ | ○ | ○ | ○ | ○ |
| DM16 | TM16 | B1 | Not occur | 1.46/1.43 | ○ | ○ | ○ | ○ | ○ |
| DM17 | TM17 | C1 | Not occur | 1.48/1.52 | ○ | ○ | ○ | ○ | ○ |
| DM18 | TM18 | A2 | Not occur | 1.32/1.35 | ○ | ○ | ○ | ○ | ○ |
| DM19 | TM19 | A2 | Not occur | 1.34/1.31 | ○ | ○ | ○ | ○ | ○ |
| DM20 | TM20 | A1 | Not occur | 1.44/1.40 | ○ | ○ | ○ | ○ | ○ |

TABLE 22

| Developer | Toner | Carrier | Filming on photoconductive member | Image density (ID) initial/after test | Fog | Uniformity of solid image | Transfer skipping in characters | Reverse transfer | Transfer voids |
|---|---|---|---|---|---|---|---|---|---|
| cm31 | tm31 | B1 | Occur | 1.48/1.45 | X | X | X | X | X |
| cm32 | tm32 | C1 | Occur | 1.50/1.52 | X | X | X | X | X |
| cm33 | tm33 | A2 | Occur | 1.35/1.32 | X | X | X | X | X |
| cm38 | tm38 | a1 | Not occur | 1.12/1.17 | ○ | X | X | X | X |

TABLE 22-continued

| Developer | Toner | Carrier | Filming on photoconductive member | Image density (ID) initial/after test | Fog | Uniformity of solid image | Transfer skipping in characters | Reverse transfer | Transfer voids |
|---|---|---|---|---|---|---|---|---|---|
| cm39 | tm39 | d2 | Not occur | 1.45/1.21 | X | X | X | X | X |
| cm40 | tm40 | d3 | Not occur | 1.39/1.19 | X | X | X | X | X |
| cm41 | tm41 | a1 | Not occur | 1.29/1.12 | ○ | X | X | X | X |
| cm42 | tm42 | d2 | Not occur | 1.39/1.11 | X | X | X | X | X |
| cm43 | tm43 | a1 | Not occur | 1.28/1.15 | ○ | X | X | X | X |
| cm44 | tm44 | d2 | Not occur | 1.38/1.12 | X | X | X | X | X |

The amount of charge was measured by a blow-off method using frictional charge with a ferrite carrier. Under the environmental conditions of 25° C. and 45% RH, 0.3 g of sample was taken to evaluate the durability, and a nitrogen gas was blown on the sample at $1.96\times10^4$ (Pa) for 1 minute.

When visual images were formed by using a developer, a high image density was achieved, and no background fog occurred in the non-image portions. There was also no scattering of toner. Moreover, high-resolution images having a high image density of not less than 1.3 were obtained. In the long period durability test with 100,000 copies of A4 paper, the flowability and the image density were not changed much, and the characteristics were stable. The solid images in development also had favorable uniformity, and a developing memory was not generated.

Moreover, unusual images with vertical strips did not occur over continuous use. There was almost no spent of the toner components on the carrier. Both a change in carrier resistance and a decrease in charge amount were suppressed. The charge build-up property was good even after quick supply of the toner. Fog was not increased under high humidity conditions.

Moreover, high saturation charge was maintained over a long period of use. The amount of charge hardly varied at low temperature and low humidity. Even if the mixing ratio of the toner to the carrier was changed from 5 to 20 wt %, changes in image density and image quality (such as background fog) were small, thus controlling a wide range of the toner concentration.

The transfer voids were not a problem for practical use, and the transfer efficiency was about 95%. The filming of the toner on the photoconductive member or the transfer belt also was not a problem for practical use. A cleaning failure of the transfer belt did not occur. There was almost no disturbance or scattering of the toner during fixing. In the case of a full color image formed by superimposing three colors, a transfer failure did not occur, and a paper was not wound around the fixing belt.

For the developers cm31 to cm33 and cm38 to cm44, the charge was raised, and considerable fog was generated. When the solid images were developed continuously by two-component development, and then the toner was supplied quickly, the charge was reduced, and fog was increased. This phenomenon became worse, particularly under high humidity conditions. Moreover, when the mixing ratio of the toner to the carrier was in the range of 5 to 8 wt %, changes in image density and image quality (such as background fog) were small, even if the toner concentration was changed. However, the image density was reduced as the mixing ratio was smaller than this range, while the background fog was increased as the mixing ratio was larger than this range. Moreover, transfer voids and scattering of the toner around the characters occurred during transfer.

Next, a solid image was fixed in an amount of 1.2 mg/cm$^2$ at a process speed of 125 mm/s by using a fixing device provided with an oilless belt, as shown in FIG. 2, and the OHP transmittance (fixing temperature: 160° C.), the minimum fixing temperature at which cold offset (i.e., the transfer of unfused toner to the fixing belt) does not occur, the offset resistance at high temperatures, the storage stability at 60° C. for 5 hours, and the winding of a paper around the fixing belt during fixing were evaluated. Tables 23 and 24 show the results of the evaluation.

TABLE 23

| Toner | OHP transmittance (%) | Minimum fixing temperature (° C.) | High-temperature offset generation (° C.) | Storage stability test | Winding around fixing belt | Toner disturbance during fixing |
|---|---|---|---|---|---|---|
| TM1 | 86.7 | 135 | 210 | ○ | Not occur | None |
| TM2 | 82.7 | 140 | 215 | ○ | Not occur | None |
| TM3 | 83.7 | 135 | 210 | ○ | Not occur | None |
| TM4 | 87.9 | 135 | 220 | ○ | Not occur | None |
| TM5 | 86.1 | 135 | 215 | ○ | Not occur | None |
| TM6 | 83.4 | 125 | 210 | ○ | Not occur | None |
| TM7 | 88.4 | 130 | 215 | ○ | Not occur | None |
| TM8 | 87.6 | 130 | 210 | ○ | Not occur | None |
| TM9 | 90.1 | 130 | 210 | ○ | Not occur | None |
| TM10 | 84.9 | 130 | 210 | ○ | Not occur | None |
| TM11 | 86.8 | 135 | 210 | ○ | Not occur | None |
| TM12 | 82.1 | 140 | 215 | ○ | Not occur | None |
| TM13 | 84.6 | 135 | 210 | ○ | Not occur | None |
| TM14 | 88.7 | 135 | 220 | ○ | Not occur | None |
| TM15 | 82.1 | 135 | 215 | ○ | Not occur | None |
| TM16 | 84.1 | 125 | 210 | ○ | Not occur | None |
| TM17 | 89.8 | 130 | 215 | ○ | Not occur | None |

TABLE 23-continued

| Toner | OHP transmittance (%) | Minimum fixing temperature (° C.) | High-temperature offset generation (° C.) | Storage stability test | Winding around fixing belt | Toner disturbance during fixing |
|---|---|---|---|---|---|---|
| TM18 | 88.7 | 130 | 210 | ○ | Not occur | None |
| TM19 | 92.1 | 130 | 210 | ○ | Not occur | None |

TABLE 24

| Toner | OHP transmittance (%) | Minimum fixing temperature (° C.) | High-temperature offset generation (° C.) | Storage stability test | Winding around fixing belt | Toner disturbance during fixing |
|---|---|---|---|---|---|---|
| tm31 | 90.2 | 140 | 180 | ○ | Not occur | None |
| tm32 | 83.2 | 140 | 210 | X | Not occur | None |
| tm33 | 81.8 | 140 | 210 | X | Not occur | None |
| tm38 | 50.1 | 170 | 190 | ○ | Occur | Scattering |
| tm39 | 49.8 | 170 | 190 | ○ | Occur | Scattering |
| tm40 | 45.6 | 170 | 190 | ○ | Occur | Scattering |
| tm41 | 90.8 | 140 | 150 | X | Occur | Scattering |
| tm42 | 91.8 | 140 | 150 | X | Occur | Scattering |
| tm43 | 87.9 | 140 | 160 | ○ | Occur | Scattering |
| tm44 | 83.2 | 140 | 160 | ○ | Occur | Scattering |

The OHP transmittance was measured with 700 nm light by using a spectrophotometer (U-3200 manufactured by Hitachi, Ltd.). The storage stability was evaluated after being left standing at 60° C. for 5 hours.

For the toners TM1 to TM19, paper jam did not occur in the nip portion. When a green solid image was fixed on a plain paper, no offset occurred until 200,000 copies. Even if a silicone or fluorine-based fixing belt was used without oil, the surface of the belt did not wear. The OHP transmittance was not less than 80%. The temperature range of offset resistance was increased by using the fixing belt without oil. Moreover, agglomeration hardly was observed in the storage stability test (indicated by ○).

For the toners tm31, tm41, tm42, tm43, and tm44, the temperature at which the high-temperature offset generated was low, and the offset margin was narrow. The toners tm32, tm33 tm41, and tm42 had poor storage stability that was attributed to the effect of residual wax on the toner particle surfaces. The toners tm38, tm39, and tm40 had a high minimum fixing temperature and a narrow fixing margin.

INDUSTRIAL APPLICABILITY

The present invention is useful not only for an electrophotographic system including a photoconductive member, but also for a printing system in which the toner adheres directly on paper or the toner including a conductive material is applied on a substrate as a wiring pattern.

The invention claimed is:

1. Toner produced by mixing in an aqueous medium at least a resin particle dispersion in which resin particles are dispersed, a colorant particle dispersion in which colorant particles are dispersed, and a wax particle dispersion in which wax particles are dispersed and heating and aggregating the mixed dispersion, wherein a main component of a surface-active agent used for the resin particle dispersion includes a mixture of a nonionic surface-active agent and an anionic surface-active agent, and a content of the nonionic surface-active agent in the mixture is 60 wt % to 95 wt %, and a main component of at least one surface-active agent selected from a surface-active agent used for the wax particle dispersion and a surface-active agent used for the colorant particle dispersion is a nonionic surface-active agent, and wherein the wax comprises at least a first wax including wax that has an endothermic peak temperature (melting point represented by Tmw1 (° C.)) of 50° C. to 90° C. based on a DSC method, and a second wax including wax that has an endothermic peak temperature (melting point represented by Tmw2 (° C.)) 5° C. (2 to 70° C. higher than Tmw1 of the first wax based on the DSC method, the first wax includes wax that has an iodine value of not more than 25 and a saponification value of 30 to 300 or ester wax that includes at least one of higher alcohol having a carbon number of 16 to 24 and higher fatty acid having a carbon number of 16 to 24, the second wax includes aliphatic hydrocarbon wax, and TW2/EW1 is 1 to 9 where EW1 and TW2 are weight ratios of the first wax and the second wax to 100 parts by weight of the wax in the wax particle dispersion, respectively.

2. The toner according to claim 1, wherein the first wax has an endothermic peak temperature of 50° C. to 90° C. based on a DSC method, and the second wax has an endothermic peak temperature of 80° C. to 120° C. based on the DSC method.

3. The toner according to claim 1, wherein the wax particle dispersion is produced by mixing, emulsifying, and dispersing the first wax and the second wax.

4. The toner according to claim 1, wherein the toner has a volume-average particle size of 3 μm to 7 μm, a content of toner base particles having a particle size of 2.52 μm to 4 μm in a number distribution is 10% to 75% by number, the toner base particles having a particle size of 4 μm to 6.06 μm in a volume distribution is 25% to 75% by volume, the toner base particles having a particle size of not less than 8 μm in the volume distribution is not more than 5% by volume, and P46N46 is in a range of 0.5 to 1.5 where V46 is a volume percentage of the toner base particles having a particle size of 4 μm to 6.06 μm in the volume distribution and P46 is a number percentage of the toner base particles having a particle size of 4 μm to 6.06 μm in the number distribution.

5. A method for producing toner by mixing in an aqueous medium at least a resin particle dispersion in which resin particles are dispersed, a colorant particle dispersion in which colorant particles are dispersed, and a wax particle dispersion in which wax particles are dispersed and heating and aggregating the mixed particle dispersion, the method comprising:

preparing the mixed dispersion of at least the resin particle dispersion, the colorant particle dispersion, and the wax particle dispersion;

adjusting a pH of the mixed dispersion in a range of 9.5 to 12.2;

adding a water-soluble inorganic salt to the mixed dispersion; and heat-treating the mixed dispersion so that the resin particles, the colorant particles, and the wax particles are aggregated to form aggregated particles at least part of which is melted, wherein a main component of a surface-active agent used for the resin particle dispersion is a nonionic surface-active agent, and a main component of at least one surface-active agent selected from a surface-active agent used for the wax particle dispersion and a surface-active agent used for the colorant particle dispersion is a nonionic surface-active agent, and wherein the wax particle dispersion comprises at least a first wax including wax that has an endothermic peak temperature (melting point represented by Tmw1 (° C.)) of 50° C. to 90° C. based on a DSC method, and a second wax including wax that has an endothermic peak temperature (melting point represented by Tmw2 (° C.)) 5° C. to 70° C. higher than Tmw1 of the first wax based on the DSC method.

6. The method according to claim 5, wherein the pH of the mixed dispersion at the time of forming the particles is in a range of 7.0 to 9.5, and ten the pH further is adjusted in a range of 22 to 6.8 and the mixed dispersion is heat-treated to form aggregated particles at least part of which is melted.

7. The method according to claim 5, further comprising:

adding a second resin particle dispersion in which second resin particles are dispersed to an aggregated particle dispersion in which the aggregated particles are dispersed;

adjusting a pH of the aggregated particle dispersion in a range of 2.2 to 6.8;

heat-treating the mixed dispersion of the aggregated particles and the second resin particles at temperatures not less than a glass transition point of the second resin particles;

adjusting a pH of the mixed dispersion in a range of 5.2 to 8.8; and fusing the second resin particles with the aggregated particles by heat-treating the mixed dispersion at temperatures not less than the glass transition point of the second resin particles.

8. The method according to claim 5, further comprising:

adding a second resin particle dispersion in which second resin particles are dispersed to an aggregated particle dispersion in which the aggregated particles are dispersed;

adjusting a pH of the aggregated particle dispersion in a range of 2.2 to 6.8;

heat-treating the mixed dispersion of the aggregated particles and the second resin particles at temperatures not less than a glass transition point of the second resin particles;

adjusting a pH of the mixed dispersion in a range of 5.2 to 8.8;

heat-treating the mixed dispersion at temperatures not less then the glass transition point of the second resin particles;

adjusting the pH of the mixed dispersion in a range of 2.2 to 6.8; and fusing the second resin particles with the aggregated particles by further heat-treating the mixed dispersion at temperatures not less than the glass transition point of the second resin particles.

9. The method according to claim 5, wherein the wax particle dispersion is produced by mixing, emulsifying, and dispersing the first wax, the second wax, and the surface-active agent.

10. The method according to claim 5, wherein the first wax includes wax that has an iodine value of not more than 25 and a saponification value of 30 to 300 or ester wax that includes at least one of higher alcohol having a carbon number of 16 to 24 and higher fatty acid having a carbon number of 16 to 24, and the second wax includes aliphatic hydrocarbon wax.

11. The meted according to claim 5, wherein the main component of the surface-active agent used for the wax particle dispersion or the colorant particle dispersion is only a nonionic surface-active agent, and the surface-active agent used for the resin particle dispersion is a mixture of a nonionic surface-active agent and an ionic surface-active agent.

12. The method according to claim 5, wherein the main component of the surface-active agent used for each of the resin particle dispersion, the wax particle dispersion, and the colorant particle dispersion is a nonionic surface-active agent.

13. The method according to claim 5, wherein the second wax has an endothermic peak temperature of 80° C. to 120° C. based on the DSC method.

14. The toner according to claim 1, wherein the surface-active agent used for the wax particle dispersion includes a nonionic surface-active agent, and a content of the nonionic surface-active agent in the wax particle dispersion is 50 wt % or more of the whole surface-active agent used for the wax particle dispersion.

15. The toner according to claim 1, wherein the surface-active agent used for the colorant particle dispersion includes a nonionic surface-active agent, and a content of the nonionic surface-active agent in the colorant particle dispersion is 50 wt % or more of the whole surface-active agent used for the colorant particle dispersion.

16. The method according to claim 5, wherein TW2/EW1 is 1 to 9 where EW1 and TW2 are weight ratios of the first wax and the second wax to 100 parts by weight of the wax in the wax particle dispersion, respectively.

17. The method according to claim 5, wherein the surface-active agent used for the wax particle dispersion includes a nonionic surface-active agent, and a content of the nonionic surface-active agent in the wax particle dispersion is 50 wt % or more of the whole surface-active agent used for the wax particle dispersion.

18. The method according to claim 5, wherein the surface-active agent used for the resin particle dispersion includes a mixture of a nonionic surface-active agent and an anionic surface-active agent, and a content of the nonionic surface-active agent in the resin particle dispersion is 60 wt % to 95 wt % of the whole surface-active agent used for the resin particle dispersion.

19. The method according to claim 5, wherein the surface-active agent used for the colorant particle dispersion includes a nonionic surface-active agent and a content of the nonionic surface-active agent in the colorant particle dispersion is 50 wt % or more of the whole surface-active agent used for the colorant particle dispersion.

20. A method for producing toner by mixing in an aqueous medium at least a resin particle dispersion in which resin particles are dispersed, a colorant particle dispersion in which colorant particles are dispersed, and a wax particle dispersion in which wax particles are dispersed and heating and aggregating the mixed particle dispersion, the method comprising:

preparing the mixed dispersion of at least the resin particle dispersion, the colorant particle dispersion, and the wax particle dispersion;

adjusting a pH of the mixed dispersion in a range of 9.5 to 12.2;

adding a water-soluble inorganic salt to the mixed dispersion; and heat-treating the mixed dispersion so that the resin particles, the colorant particles, and the wax particles are aggregated to form aggregated particles at least part of which is melted, wherein the wax particle dispersion comprises at least a first wax including wax that has an endothermic peak temperature (melting point represented by Tmw1 (° C.)) of 50° C. to 90° C. based on a DSC method, and a second wax including wax that has an endothermic peak temperature (melting point represented by Tmw2 (° C.)) 5° C. to 70° C. higher than Tmw1 of the first wax based on the DSC method.

21. The method according to claim 20, wherein a surface-active agent is included in at least one dispersion selected from the group consisting of the resin particle dispersion, the colorant particle dispersion, and the wax particle dispersion.

22. The method according to claim 20, wherein the pH of the mixed dispersion at the time of forming the particles is in a range of 7.0 to 9.5, and then the pH further is adjusted in a range of 2.2 to 6.8 and the mixed dispersion is heat-treated to form aggregated particles at least part of which is melted.

23. The method according to claim 20, further comprising:

adding a second resin particle dispersion in which second resin particles are dispersed to an aggregated particle dispersion in which the aggregated particles are dispersed;

adjusting a pH of the aggregated particle dispersion in a range of 22 to 6.8;

heat-treating the mixed dispersion of the aggregated particles and the second resin particles at temperatures not less than a glass transition point of the second resin particles;

adjusting a pH of the mixed dispersion in a range of 5.2 to 8.8; and fusing the second resin particles with the aggregated particles by heat-treating the mixed dispersion at temperatures not less than the glass transition point of the second resin particles.

24. The method according to claim 20, further comprising:

adding a second resin particle dispersion in which second resin particles are dispersed to an aggregated particle dispersion in which the aggregated particles are dispersed;

adjusting a pH of the aggregated particle dispersion in a range of 2.2 to 6.8;

heat-treating the mixed dispersion of the aggregated particles and the second resin particles at temperatures not less than a glass transition point of the second resin particles;

adjusting a pH of the mixed dispersion in a range of 5.2 to 8.8;

heat-treating the mixed dispersion at temperatures not less than the glass transition point of the second resin particles;

adjusting the pH of the mixed dispersion in a range of 2.2 to 6.8; and fusing the second resin particles with the aggregated particles by further heat-treating the mixed dispersion at temperatures not less than the glass transition point of the second resin particles.

25. The method according to claim 20, wherein the wax particle dispersion is produced by mixing, emulsifying, and dispersing the first wax, the second wax, and the surface-active agent.

26. The method according to claim 20 wherein the first wax includes wax that has an iodine value of not more than 25 and a saponification value of 30 to 300 or ester wax that includes at least one of higher alcohol having a carbon number of 16 to 24 and higher fatty acid having a carbon number of 16 to 24, and the second wax includes aliphatic hydrocarbon wax.

27. The method according to claim 20, wherein the second wax has an endothermic peak temperature of 80° C. to 120° C. based on the DSC method.

28. Tbe method according to claim 20, wherein TW2/EW1 is 1 to 9 where EW1 and TW2 are weight ratios of the first wax and the second wax to 100 parts by weight of the wax in the wax particle dispersion, respectively.

29. The method according to claim 21, wherein the main component of the surface-active agent used for the wax particle dispersion or the colorant particle dispersion is only a nonionic surface-active agent, and the surface-active agent used for the resin particle dispersion is a mixture of a nonionic surface-active agent and an ionic surface-active agent.

30. The method according to claim 21, wherein the main component of the surface-active agent used for each of the resin particle dispersion, the wax particle dispersion, and the colorant particle dispersion is a nonionic surface-active agent.

31. The method according to claim 21, wherein the surface-active agent used for the wax particle dispersion includes a nonionic surface-active agent, and a content of the nonionic surface-active agent in the wax particle dispersion is 50 wt % or more of the whole surface-active agent used for the wax particle dispersion.

32. The method according to claim 21, wherein the surface-active agent used for the resin particle dispersion includes a mixture of a nonionic surface-active agent and an anionic surface-active agent, and a content of the nonionic surface-active agent in the resin particle dispersion is 60 wt % to 95 wt % of the whole surface-active agent used for the resin particle dispersion.

33. The method according to claim 21, wherein the surface-active agent used for the colorant particle dispersion includes a nonionic surface-active agent, and a content of the nonionic surface-active agent in the colorant particle dispersion is 50 wt % or more of the whole surface-active agent used for the colorant particle dispersion.

34. Toner produced by mixing in an aqueous medium at least a resin particle dispersion in which resin particles are dispersed, a colorant particle dispersion in which colorant particles are dispersed, and a wax particle dispersion in which wax particles are dispersed and heating and aggregating the mixed dispersion, wherein the wax comprises at least a first wax including wax that has an endothermic peak temperature (melting point represented by Tmw1 (° C.)) of 50° C. to 90° C. based on a DSC method, and a second wax including wax that has an endothermic peak temperature (melting point represented by Tmw2 (° C.)) 5° C. to 70° C. higher than Tmw1 of the first wax based on the DSC method, the first wax includes wax that has an iodine value of not more than 25 and a saponification value of 30 to 300 or ester wax that includes at least one of higher alcohol having a carbon number of 16 to 24 and higher fatty acid having a carbon number of 16 to 24, the second wax includes aliphatic hydrocarbon wax, and TW2/EW1 is 1 to 9 where EW1 and TW2 are weight ratios of the first wax and the second wax to 100 parts by weight of the wax in the wax particle dispersion, respectively.

35. The toner according to claim 34, wherein the first wax has an endothermic peak temperature of 50° C. to 90° C. based on a DSC method, and the second wax has an endothermic peak temperature of 80° C. to 120° C. based on the DSC method.

36. The toner according to claim 34, wherein the wax particle dispersion is produced by mixing, emulsifying, and dispersing the first wax and the second wax.

37. The toner according to claim 34, wherein the toner has a volume-average particle size of 3 μm to 7 μm, a content of toner base particles having a particle size of 2.52 μm to 4 μm in a number distribution is 10% to 75% by number, the toner base particles having a particle size of 4 μm to 6.06 μm in a volume distribution is 25% to 75% by volume, the toner base particles having a particle size of not less than 8 μm in the volume distribution is not more than 5% by volume, and P46/V46 is in a range of 0.5 to 1.5 where V46 is a volume percentage of the toner base particles having a particle size of 4 μm to 6.06 μm in the volume distribution and P46 is a number percentage of the toner base particles having a particle size of 4 μm to 6.06 μm in the number distribution.

38. The toner according to claim 34, wherein the surface-active agent used for the wax particle dispersion includes a nonionic surface-active agent, and a content of the nonionic surface-active agent in the wax particle dispersion is 50 wt % or more of the whole surface-active agent used for the wax particle dispersion.

39. The toner according to 34, wherein the surface-active agent used for the colorant particle dispersion includes a nonionic surface-active agent, and a content of the nonionic surface-active agent in the colorant particle dispersion is 50 wt % or more of the whale surface-active agent used for the colorant particle dispersion.

* * * * *